US006297000B1

(12) United States Patent
Suzuki et al.

(10) Patent No.: US 6,297,000 B1
(45) Date of Patent: Oct. 2, 2001

(54) THERMOGRAPHIC RECORDING ELEMENT

(75) Inventors: Hiroyuki Suzuki; Toshihide Ezoe; Kohzaburoh Yamada, all of Kanagawa (JP)

(73) Assignee: Fuji Photo Film Co., Ltd., Minami-ashigara (JP)

( * ) Notice: Subject to any disclaimer, the term of this patent is extended or adjusted under 35 U.S.C. 154(b) by 0 days.

(21) Appl. No.: 09/559,967

(22) Filed: Apr. 28, 2000

Related U.S. Application Data

(63) Continuation-in-part of application No. 09/160,182, filed on Sep. 25, 1998, now abandoned.

(30) Foreign Application Priority Data

Oct. 14, 1997 (JP) ..... 9-296174

(51) Int. Cl.[7] ..... G03C 1/498

(52) U.S. Cl. ..... 430/617; 430/264; 430/531; 430/613; 430/619

(58) Field of Search ..... 430/619, 264, 430/613, 614, 607, 611, 531, 965, 617

(56) References Cited

U.S. PATENT DOCUMENTS

| | | |
|---|---|---|
| 5,496,695 | 3/1996 | Simpson et al. . |
| 5,545,515 | 8/1996 | Murray et al. . |
| 5,635,339 | 6/1997 | Murray . |
| 5,654,130 | 8/1997 | Murray . |
| 5,686,228 | 11/1997 | Murray et al. . |
| 5,869,229 | 2/1999 | Okada et al. . |

*Primary Examiner*—Thorl Chea
(74) *Attorney, Agent, or Firm*—Birch, Stewart, Kolasch & Birch, LLP

(57) ABSTRACT

A thermographic recording element having at least one image forming layer contains an organic silver salt, a reducing agent, and an adsorption promoting group-bearing alkene compound. The element has high Dmax, high sensitivity, satisfactory contrast and shelf stability.

19 Claims, No Drawings

THERMOGRAPHIC RECORDING ELEMENT

This application is a C-I-P of Ser. No. 09/160,182 filed Sept. 25, 1998, now abandoned.

This invention relates to a thermographic recording element and more particularly, to a thermographic recording element suitable for the manufacture of graphic printing plates.

BACKGROUND OF THE INVENTION

Photothermographic materials which are processed by a thermographic process to form photographic images are disclosed, for example, in U.S. Pat. Nos. 3,152,904 and 3,457,075, D. Morgan and B. Shely, "Thermally Processed Silver Systems" in "Imaging Processes and Materials," Neblette, 8th Ed., Sturge, V. Walworth and A. Shepp Ed., page 2, 1969.

These photothermographic materials generally contain a reducible silver source (e.g., organic silver salt), a catalytic amount of a photocatalyst (e.g., silver halide), a toner for controlling the tone of silver, and a reducing agent, typically dispersed in a binder matrix. Photothermo-graphic materials are stable at room temperature. When they are heated at an elevated temperature (e.g., 80° C. or higher) after exposure, redox reaction takes place between the reducible silver source (functioning as an oxidizing agent) and the reducing agent to form silver. This redox reaction is promoted by the catalysis of a latent image produced by exposure. Silver formed by reaction of the organic silver salt in exposed regions provides black images in contrast to unexposed regions, forming an image.

Such photothermographic materials have been used as microphotographic and medical photosensitive materials. However, only a few have been used as a graphic printing photosensitive material because the image quality is poor for the printing purpose as demonstrated by low maximum density (Dmax) and soft gradation.

With the recent advance of lasers and light-emitting diodes, scanners and image setters having an oscillation wavelength of 600 to 800 nm find widespread use. There is a strong desire to have a high contrast photosensitive material which has so high sensitivity and Dmax that it may comply with such output devices.

From the contemporary standpoints of environmental protection and space saving, it is strongly desired in the graphic printing field to reduce the quantity of spent solution. Needed in this regard is a technology relating to thermographic photosensitive materials for use in the graphic printing field which can be effectively exposed by means of laser image setters and produce clear black images having a high resolution and sharpness. These thermographic photosensitive materials offer to the customer a simple thermographic system which eliminates a need for solution type chemical agents and is not detrimental to the environment.

U.S. Pat. No. 3,667,958 discloses that a photothermographic element comprising a polyhydroxybenzene combined with a hydroxylamine, reductone or hydrazine has high image quality discrimination and resolution. This combination of reducing agents, however, was found to incur an increase of fog.

For producing a thermographic recording element having high Dmax and high contrast, it is effective to add to the element the hydrazine derivatives described in U.S. Pat. No. 5,496,695. Although this results in a thermographic recording element having high Dmax and high contrast, all of sensitivity, contrast, Dmax, Dmin and storage stability of compounds are not fully satisfied.

Improvements in contrast and storage stability of compounds are achieved by using the hydrazine derivatives described in EP 762196A1, but the fully satisfactory level has not been reached.

Further, U.S. Pat. No. 5,545,515 and 5,635,339 disclose the use of acrylonitriles as the co-developer. With these acrylonitrile compounds, a fully satisfactory high contrast is not achieved and sometimes black pepper develops.

SUMMARY OF THE INVENTION

An object of the present invention is to provide a thermographic recording element having a high sensitivity, high Dmax, high contrast, and shelf stability. Another object of the present invention is to provide a recording element for use in the manufacture of graphic printing plates which forms an image of quality and can be processed in a fully dry basis without a need for wet processing.

The invention provides a thermographic recording element comprising at least one image forming layer and containing an organic silver salt, a reducing agent, and a compound of the following general formula (I).

(I)

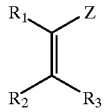

In formula (I), $R_1$, $R_2$ and $R_3$ are independently hydrogen or monovalent substituents, Z is an electron attractive group or silyl group, or $R_1$ and Z, $R_2$ and $R_3$, $R_1$ and $R_2$, and $R_3$ and Z, taken together, may form a cyclic structure, at least one of $R_1$, $R_2$, $R_3$ and Z has a group represented by $—L_1—(R_4—L_2)_{n1}—(R_5)_{n2}—X$ wherein $R_4$ and $R_5$ are independently divalent aliphatic or aromatic groups, $L_1$ and $L_2$ are independently divalent linking groups, X is a group for promoting adsorption to a silver salt, and $n_1$ and $n_2$ are independently equal to 0 or 1.

In one preferred embodiment, the thermographic recording element further contains a hydrazine derivative of the following general formula (H).

(H)

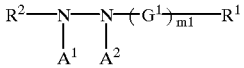

In formula (H), $R^1$ is hydrogen or a block group, $R^2$ is an aliphatic, aromatic or heterocyclic group, $G^1$ is —CO—, —COCO—, —C(=S)—, $—SO_2—$, —SO—, $—PO(R^3)—$ or iminomethylene group, $R^3$ is selected from the same range as defined for $R^1$ and may be different from $R^1$, $A^1$ and $A^2$ are hydrogen, alkylsulfonyl, arylsulfonyl or acyl groups, at least one of $A^1$ and $A^2$ is hydrogen, letter $m_1$ is equal to 0 or 1, with the proviso that $R^1$ is an aliphatic, aromatic or heterocyclic group when $m_1$ is 0.

Also preferably, the thermographic recording element further contains a photosensitive silver halide. The invention then provides a photothermographic recording element.

DETAILED DESCRIPTION OF THE INVENTION

The thermographic recording element of the invention has at least one image forming layer and contains an organic silver salt and a reducing agent. Preferably it further contains a photosensitive silver halide, providing a photothermographic recording element. More preferably, it is a high contrast photothermographic recording element suitable as a printing plate.

According to the invention, a compound of formula (I) is contained in the thermographic recording element for achieving a fully satisfactory high contrast and shelf stability. The containment of this compound is also effective for achieving a high Dmax and high sensitivity. For producing high contrast images, the concurrent use of a hydrazine derivative is also preferred.

In contrast, acrylonitrile compounds analogous to formula (I) fail to achieve both the effects of contrast enhancement and storage stabilization.

Now the compounds of formula (I) are described in detail.

In formula (I), $R_1$, $R_2$ and $R_3$ are independently hydrogen or monovalent substituents. Examples of the monovalent substituents represented by $R_1$, $R_2$ and $R_3$ include halogen atoms (e.g., fluorine, chlorine, bromine and iodine atoms), alkyl groups (including aralkyl, cycloalkyl and active methine groups), alkenyl groups, alkynyl groups, aryl groups, heterocyclic groups, quaternized nitrogen atom-containing heterocyclic groups (e.g., pyridinio), acyl groups, alkoxycarbonyl groups, aryloxycarbonyl groups, carbamoyl groups, carboxy groups or salts thereof, sulfonyl-carbamoyl groups, acylcarbamoyl groups, sulfamoylcarbamoyl groups, carbazoyl groups, oxalyl groups, oxamoyl groups, cyano groups, thiocarbamoyl groups, hydroxy groups or salts thereof, alkoxy groups (including groups containing recurring ethylenoxy or propylenoxy units), aryloxy groups, heterocyclic oxy groups, acyloxy groups, (alkoxy or aryloxy)carbonyloxy groups, carbamoyloxy groups, sulfonyloxy groups, amino groups, (alkyl, aryl or heterocyclic) amino groups, N-substituted nitrogenous heterocyclic groups, acylamino groups (or amide groups), sulfonamide groups, ureido groups, thioureido groups, imino groups, (alkoxy or aryloxy)carbonylamino groups, sulfamoylamino groups, semicarbazide groups, thiosemicarbazide groups, hydrazino groups, quaternary ammonio groups, oxamoylamino groups, (alkyl or aryl)sulfonylureido groups, acylureido groups, acylsulfamoylamino groups, nitro groups, mercapto groups or salts thereof, (alkyl, aryl or heterocyclic) thio groups, (alkyl or aryl)sulfonyl groups, (alkyl or aryl) sulfinyl groups, sulfo groups or salts thereof, sulfamoyl groups, acylsulfamoyl groups, sulfonylsulfamoyl groups or salts thereof, phosphoramide or phosphate ester structure-bearing groups, silyl groups, and stannyl groups. These substituents may be further replaced by other substituents selected from the foregoing examples.

The "salts" as described herein include alkali metal salts (e.g. sodium, potassium and lithium), alkaline earth metal salts (e.g. magnesium and calcium), silver salts, quaternary ammonium salts (e.g., tetraethylammonium salts and dimethylcetylbenzylammonium salts), and quaternary phosphonium salts.

For example, carboxy group salts include alkali metal salts of carboxy (e.g. $—COO^-Na^+$, $—COO^-K^+$, $—COO^-Li^+$), alkaline earth metal salts of carboxy (e.g. $—COO^-Mg^+$, $—COO^-Ca^+$), silver salts of carboxy, quaternary ammonium salts of carboxy and quaternary phosphonium salts of carboxy.

For example, hydroxy group salts include alkali metal salts of hydroxy (e.g. $—O^-Na^+$, $—O^-K^+$, $—O^-Li^+$), alkaline earth metal salts of hydroxy (e.g. $—O^-Mg^+$, $—O^-Ca^+$), silver salts of hydroxy, quaternary ammonium salts of hydroxy and quaternary phosphonium salts of hydroxy.

For example, mercapto group salts include alkali metal salts of mercapto (e.g. $—S^-Na^+$, $—S^-K^+$, $—S^-Li^+$), alkaline earth metal salts of mercapto (e.g. $—S^-Mg^+$, $—S^-Ca^+$), silver salts of mercapto, quaternary ammonium salts of mercapto and quaternary phosphonium salts of mercapto.

For example, sulfo group salts include alkali metal salts of sulfo, alkaline earth metal salts of sulfo, silver salts of sulfo, quaternary ammonium salts of sulfo and quaternary phosphonium salts of sulfo.

For example, sulfamoyl, acylsulfamoyl and sulfonylsulfamoyl group salts include alkali metal salts of sulfamoyl, acylsulfamoyl and sulfonylsulfamoyl; alkaline earth metal salts of sulfamoyl, acylsulfamoyl and sulfonylsulfamoyl; silver salts of sulfamoyl, acylsulfamoyl and sulfonylsulfamoyl; quaternary ammonium salts of sulfamoyl, acylsulfamoyl and sulfonylsulfamoyl; and quaternary phosphonium salts of sulfamoyl, acylsulfamoyl and sulfonylsulfamoyl.

The preferred salts of hydroxy and mercapto are sodium, calcium or potassium salts (i.e. $—O^+Na^-$, $—O^+Ca^-$, $—O^+K^-$, $—S^+Na^-$, $—S^+Ca^-$, $—S^+K^-$).

In formula (I), Z is an electron attractive group or silyl group. The electron attractive group is a substituent whose Hammette substituent constant $\sigma_p$ has a positive value. Exemplary electron attractive groups are cyano groups, alkoxycarbonyl groups, aryloxycarbonyl groups, carbamoyl groups, imino groups, thiocarbonyl groups, sulfonamide groups, sulfamoyl groups, alkylsulfonyl groups, arylsulfonyl groups, nitro groups, halogen atoms, perfluoroalkyl groups, acyl groups, formyl groups, phosphoryl groups, carboxy groups (or salts thereof), sulfo groups (or salts thereof), heterocyclic groups, alkenyl groups, alkynyl groups, acyloxy groups, acylthio groups, sulfonyloxy groups, and aryl groups having such electron attractive groups substituted thereon. The heterocyclic groups include saturated or unsaturated heterocyclic groups, for example, pyridyl, quinolyl, pyrazinyl, benzotriazolyl, imidazolyl, benzimidazolyl, benzoxazolyl, 1,3-oxazolidine-2,4-dion-3-yl, hydantoin-1-yl, succinimide and phthalimide groups.

The electron attractive group represented by Z in formula (I) may have a substituent or substituents which are selected from the same substituents that the monovalent substituents represented by $R_1$, $R_2$ and $R_3$ in formula (I) may have.

In formula (I), $R_1$ and Z, $R_2$ and $R_3$, $R_1$ and $R_2$, and $R_3$ and Z, taken together, may form a cyclic structure, which is a saturated carbocyclic or saturated heterocyclic one.

Preferred examples of the electron attractive group represented by Z in formula (I) include groups having 0 to 20 carbon atoms in total, for example, cyano, alkoxy-carbonyl, aryloxycarbonyl, carbamoyl, imino, sulfamoyl, alkylsulfonyl, arylsulfonyl, nitro, perfluoroalkyl, acyl, formyl, phosphoryl, acyloxy, and acylthio groups, and phenyl groups having an electron attractive group substituted thereon. More preferred examples include cyano, alkoxycarbonyl, carbamoyl, imino, sulfamoyl, alkylsulfonyl, arylsulfonyl, acyl, formyl, phosphoryl, and trifluoromethyl groups, and phenyl groups having an electron attractive group substituted thereon. Further preferred examples include cyano, formyl, acyl, alkoxycarbonyl, imino and carbamoyl groups. Cyano and formyl groups are most preferred.

Examples of the silyl group represented by Z in formula (I) include trimethylsilyl, t-butyldimethylsilyl, phenyldimethylsilyl, triethylsilyl, triisopropylsilyl and trimethylsilyldimethylsilyl groups.

The monovalent substituents represented by $R_1$, $R_2$ and $R_3$ in formula (I) are preferably groups having 0 to 25 carbon atoms in total, for example, the same groups as the electron attractive groups represented by Z in formula (I), as well as alkyl, hydroxy (or salts thereof), mercapto (or salts thereof), alkoxy, aryloxy, heterocyclic oxy, alkylthio, arylthio, heterocyclic thio, amino, alkylamino, arylamino, heterocyclic amino, ureido, amide, and substituted or unsubstituted aryl groups.

In formula (I), $R_1$ is preferably an electron attractive group or aryl or arylthio group. When $R_1$ represents electron attractive groups, they are preferably cyano, nitro, acyl, formyl, alkoxycarbonyl, aryloxycarbonyl, imino, alkylsulfonyl, arylsulfonyl, carbamoyl, sulfamoyl, trifluoromethyl, phosphoryl, thiocarbonyl, halogen, carboxy (or salts thereof), and saturated or unsaturated heterocyclic groups; more preferably cyano, acyl, formyl, alkoxycarbonyl, carbamoyl, imino, sulfamoyl, carboxy (or salts thereof), and saturated or unsaturated heterocyclic groups; most preferably cyano, formyl, acyl, alkoxycarbonyl, carbamoyl, and saturated or unsaturated heterocyclic groups.

When $R_1$ represents aryl groups, they are preferably substituted or unsubstituted phenyl groups having 6 to 20 carbon atoms in total wherein the substituents, if any, are arbitrary.

The monovalent substituents represented by $R_2$ and $R_3$ in formula (I) are preferably the same groups as the electron attractive groups represented by Z in formula (I), as well as alkyl, hydroxy (or salts thereof), mercapto (or salts thereof), alkoxy, aryloxy, heterocyclic oxy, alkylthio, arylthio, heterocyclic thio, amino, alkylamino, arylamino, heterocyclic amino, ureido, substituted or unsubstituted phenyl, and heterocyclic groups; more preferably hydroxy (or salts thereof), mercapto (or salts thereof), alkoxy, heterocyclic oxy, alkylthio, heterocyclic thio, and heterocyclic groups.

It is also preferred that Z and $R_1$, or $R_2$ and $R_3$ in formula (I) form a cyclic structure together. The cyclic structures formed are saturated carbocyclic or saturated heterocyclic structures having 1 to 25 carbon atoms in total.

At least one of $R_1$, $R_2$, $R_3$ and Z has a group represented by $—L_1—(R_4—L_2)_n—(R_5)_{n2}—X$ wherein $R_4$ and $R_5$ are independently divalent aliphatic or aromatic groups, $L_1$ and $L_2$ are independently divalent linking groups, X is a group for promoting adsorption to the silver salt, and $n_1$ and n2 are independently equal to 0 or 1. The divalent aliphatic groups represented by $R_4$ and $R_5$ include substituted or unsubstituted, straight, branched or cyclic alkylene, alkenylene, and alkynylene groups; and the divalent aromatic groups include monocyclic or bicyclic arylene groups. Preferably $R_4$ and R5 are alkylene or arylene groups. More preferably $R_4$ is phenylene and $R_5$ is phenylene or alkylene.

The divalent linking groups represented by $L_1$ and $L_2$ in formula (I) are —O—, —S—, $—N(R_n)—$(wherein $R_N$ is hydrogen, substituted or unsubstituted alkyl or aryl), —CO—, —C(=S)—, $—SO_2—$, —SO—, —P(O)—, alkylene, arylene, saturated or unsaturated heterocyclic groups and combinations thereof. Examples of the combined groups are $—CON(R_N)—$, $—SO_2N(R_N)—$, —COO—, $—N(R_N)CON(R_N)—$, $—N(R_N)CSN(R_N)—$, $—N(R_N)SO_2N(R_N)—$, $—SO_2N(R_N)CO—$, $—SO_2N(R_N)CON(R_N)—$, $—N(R_N)COCON(R_N)—$, $—CON(R_N)CO—$, —S-alkylene-CONH—, —O-alkylene-CONH—, —O-alkylene-NHCO—, $—N(R_N)N(R_N)CONH—$, —NHCO-arylene-$SO_2NH$—, $—OCH_2—$, $—OCH_2CH_2—$, $—SCH_2—$, —S-arylene-, $—OCH_2$—arylene-, $—N(R_N)CH_2—OSO_2—$, $—SO_2$—arylene- and $—SSO_2—$. Understandably, these groups may be attached either on the right side or the left side to the adjacent carbon atom. Letter $n_1$ and $n_2$ are independently equal to 0 or 1.

X is an adsorption promoting group, that is, a group for promoting adsorption to the silver halide or the organic silver salt. The preferred adsorption promoting groups include thioamide, mercapto, and 5- or 6-membered nitrogenous heterocyclic groups.

The thioamide adsorption promoting group is a divalent group of the following formula.

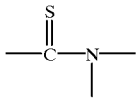

It may be a part of a cyclic structure. Also acyclic thioamide groups are preferred. Useful thioamide adsorption promoting groups are selected from the groups described in U.S. Pat. Nos. 4,030,925, 4,031,127, 4,080,207, 4,245,037, 4,255,511, 4,266,013, and 4,276,364, *Research Disclosure*, Vol. 151, November 1976, item 15162, and ibid., Vol. 176, December 1978, item 17626. Especially preferred thioamide groups are represented by the following formula (II).

(II)

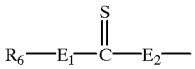

In formula (II), one of $E_1$ and $E_2$ is $—N(R_7)—$, the other is —O—, —S— or $—N(R_8)—$, and R6 represents hydrogen, aliphatic or aromatic groups. Alternatively, $R_6$ forms a 5- or 6-membered heterocyclic ring with $E_1$ or $E_2$. $R_7$ and $R_8$ independently represent hydrogen, aliphatic or aromatic groups.

The thioamide of formula (II) is, for example, thiourea, thiourethane or dithiocarbamate. Examples of the ring that $R_6$ forms with $E_1$ or $E_2$ include those rings appearing as acidic nuclei of merocyanine dyes, for example, 4-thiazoline-2-thion, thiazolidine-2-thion, 4-oxazoline-2-thion, oxazolidine-2-thion, 2-pyrazoline-5-thion, 4-imidazoline-2-thion, 2-thiohydantoin, rhodanine, isorhodanine, 2-thio-2,4-oxazolidine, thiobarbituric acid, tetrazoline-5-thion, 1,2,4-triazoline-3-thion, 1,3,4-thiadiazoline-2-thion, 1,3,4-oxadiazoline-2-thion, benzimidazoline-2-thion, benzoxazoline-2-thion, and benzothiazoline-2-thion. These rings may be further substituted.

The mercapto adsorption promoting groups include aliphatic mercapto, aromatic mercapto and heterocyclic mercapto groups (the groups wherein a nitrogen atom is adjacent to the carbon atom to which a SH group is attached have been already described as the ring-forming thioamide group which is a tautomer). Exemplary aliphatic mercapto groups are mercaptoalkyl groups (e.g., mercaptoethyl and mercaptopropyl), mercaptoalkenyl groups (e.g., mercaptopropenyl) and mercaptoalkynyl groups (e.g., mercaptobutynyl). Exemplary aromatic mercapto groups include 4-mercaptopyridyl, 5-mercaptoquinolyl and 6-mercaptobenzothiazolyl as well as those described above for the ring-forming thioamide groups.

The 5- or 6-membered nitrogenous heterocyclic adsorption promoting groups include those derived from 5- or 6-membered nitrogenous heterocyclic rings comprising nitrogen, oxygen, sulfur and carbon combined (which may have a fused ring). Preferred nitrogenous heterocyclic rings include benzotriazole, triazole, tetrazole, indazole, benzimidazole, imidazole, benzothiazole, thiazole, benzoxazole, oxazole, thiadiazole, oxadiazole, and triazine. They may have suitable substituents. More preferred nitrogenous heterocyclic rings are those capable of forming imino silver, for example, benzotriazole, triazole, tetrazole, and indazole, with the benzotriazole being most preferred.

Illustrative preferred examples of the nitrogenous heterocyclic rings include benzotriazol-5-yl, 6-chlorobenzotriazol-5-yl, benzotriazole-5-carbonyl, 5-phenyl- 1,3,4-triazol-2-yl, 4-(5-methyl-1,3,4-triazol-2-yl)benzoyl, 1H-tetrazol-5-yl, and 3-cyanoindazol-5-yl.

Preferably X in formula (I) represents cyclic thioamide groups (that is, mercapto-substituted nitrogenous heterocyclic groups, such as 2-mercaptothiadiazolyl, 3-mercapto-1,2,4-triazolyl, 5-mercaptotetrazolyl, 2-mercapto-1,3,4-oxadiazolyl and 2-mercaptobenzoxazolyl) and nitrogenous heterocyclic groups (such as benzotriazolyl, benzimidazolyl and indazolyl). More preferably X represents 2-mercaptothiadiazolyl, 5-mercaptotetrazolyl, 3-mercapto-1,2,4-triazolyl, and benzotriazolyl. Most preferred are 3-mercapto-1,2,4-triazolyl and 5-mercaptotetrazolyl.

Of the compounds of formula (I), preferred are those wherein Z is cyano, formyl, acyl, alkoxycarbonyl or carbamoyl, $R_1$ is an electron attractive group or aryl group, either one of $R_2$ and $R_3$ is hydrogen and the other is hydroxy (or salts thereof), mercapto (or salts thereof), alkoxy, alkylthio, heterocyclic oxy, heterocyclic thio or heterocyclic group, and X is 2-mercaptothiadiazolyl, 5-mercaptotetrazolyl, 3-mercapto-1,2,4-triazolyl or benzotriazolyl. When either one of $R_2$ and $R_3$ is hydrogen and the other is a hydroxy (or salt thereof) or mercapto (or salt thereof) group, it is preferred that $L_1$ is —O—, —S—, —N($R_N$)—, —CO—, alkylene, arylene, saturated or unsaturated heterocycle or a combination thereof. It is preferred at this time that the group having $L_1$ is $R_1$, and $n_1$ and $n_2$ are equal to 0. When either one of $R_2$ and $R_3$ is hydrogen and the other is an alkoxy, alkylthio, heterocyclic oxy, heterocyclic thio or heterocyclic group, it is preferred that $L_1$ is —O—, —S—, —N($R_N$)—, —CO—, —C(=S)—, —$SO_2$—, —P(O)—, alkylene, arylene, saturated or unsaturated heterocycle or a combination thereof. It is preferred at this time that the group having $L_1$ is $R_1$, $R_2$ or $R_3$, and $n_1$ and $n_2$ are equal to 0.

Several illustrative, non-limiting, examples of the compounds used herein are given below.

TABLE 1

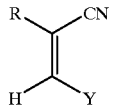

| Y | R: —CN | —$CO_2CH_2CH_3$ | —$SO_2CH_3$ | —P(=O)$(OC_4H_9)_2$ | —CHO |
|---|---|---|---|---|---|
| 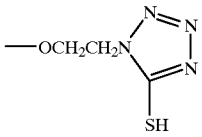 | I-1a | I-1b | I-1c | I-1d | I-1e |
| 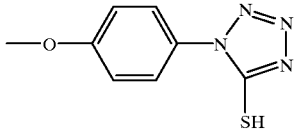 | I-2a | I-2b | I-2c | I-2d | I-2e |
| 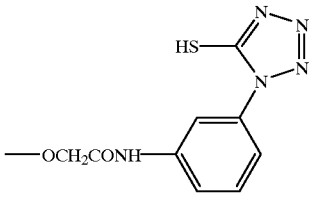 | I-3a | I-3b | I-3c | I-3d | I-3e |
| 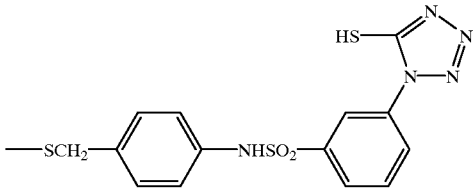 | I-4a | I-4b | I-4c | I-4d | I-4e |

TABLE 1-continued
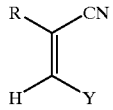
| Y | R: —CN | —$CO_2CH_2CH_3$ | —$SO_2CH_3$ | —$P(=O)(OC_4H_9)_2$ | —CHO |
|---|---|---|---|---|---|
| 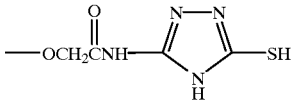 | I-5a | I-5b | I-5c | I-5d | I-5e |
| 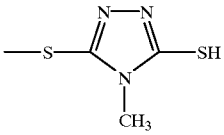 | I-6a | I-6b | I-6c | I-6d | I-6e |
| 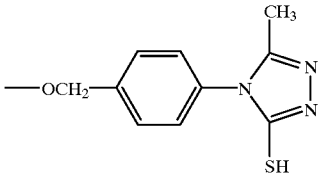 | I-7a | I-7b | I-7c | I-7d | I-7e |
| 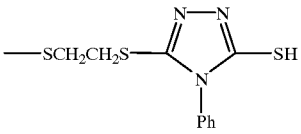 | I-8a | I-8b | I-8c | I-8d | I-8e |
TABLE 2
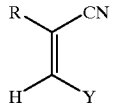
| Y | R: —CN | —$CO_2CH_3$ | —$SO_2Ph$ | —$P(=O)(OC_4H_9)_2$ | —CHO |
|---|---|---|---|---|---|
| 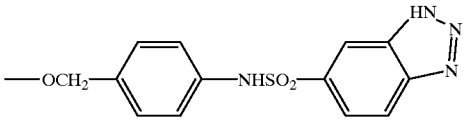 | I-9a | I-9b | I-9c | I-9d | I-9e |
| 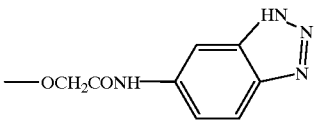 | I-10a | I-10b | I-10c | I-10d | I-10e |

TABLE 2-continued
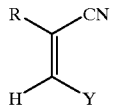
| Y | R | | | | |
|---|---|---|---|---|---|
| | —CN | —$CO_2CH_3$ | —$SO_2Ph$ | —$P(=O)(OC_4H_9)_2$ | —CHO |
| 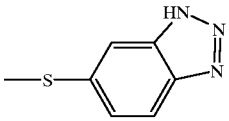 | I-11a | I-11b | I-11c | I-11d | I-11e |
| 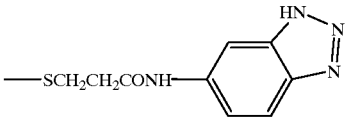 | I-12a | I-12b | I-12c | I-12d | I-12e |
| 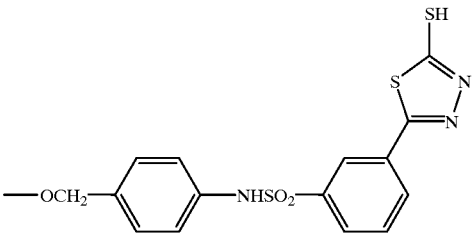 | I-13a | I-13b | I-13c | I-13d | I-13e |
| 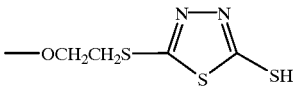 | I-14a | I-14b | I-14c | I-14d | I-14e |
| 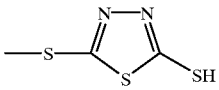 | I-15a | I-15b | I-15c | I-15d | I-15e |
| 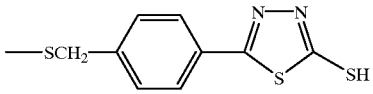 | I-16a | I-16b | I-16c | I-16d | I-16e |

TABLE 3
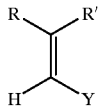
| Y | R, R′ | | | | |
|---|---|---|---|---|---|
| | 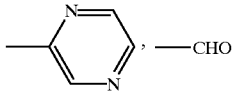 | 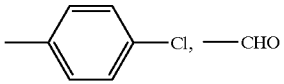 | —CHO, —CHO | 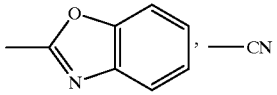 | —CN, —$COCF_3$ |
| 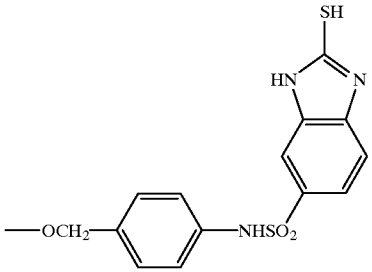 | I-17a | I-17b | I-17c | I-17d | I-17e |
| 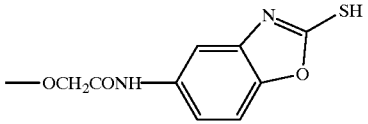 | I-18a | I-18b | I-18c | I-18d | I-18e |
| 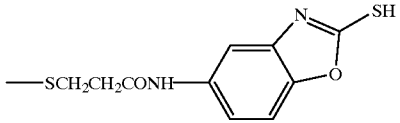 | I-19a | I-19b | I-19c | I-19d | I-19e |

TABLE 3-continued
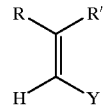
| Y | R, R′ | | | | |
|---|---|---|---|---|---|
| | 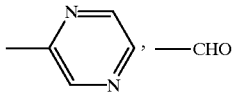 | 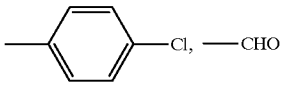 | —CHO, —CHO | 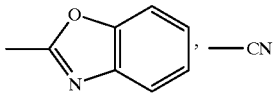 | —CN, —$COCF_3$ |
| 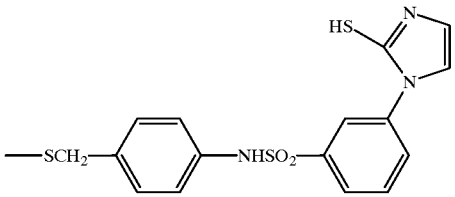 | I-20a | I-20b | I-20c | I-20d | I-20e |
| 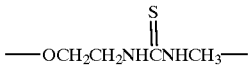 | I-21a | I-21b | I-21c | I-21d | I-21e |
| 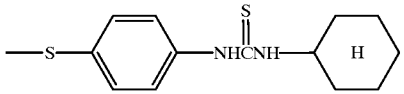 | I-22a | I-22b | I-22c | I-22d | I-22e |
| 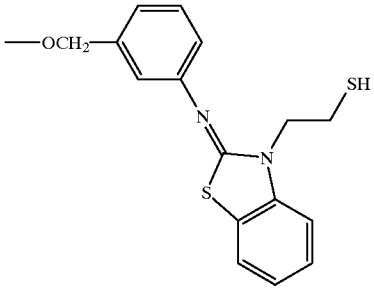 | I-23a | I-23b | I-23c | I-23d | I-23e |

TABLE 3-continued
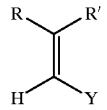
| Y | R, R′ | | | | |
|---|---|---|---|---|---|
| | 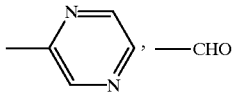 | 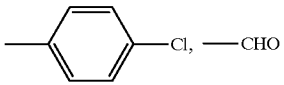 | —CHO, —CHO | 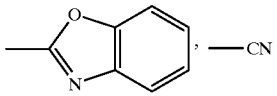 | —CN, —$COCF_3$ |
| | I-24a | I-24b | I-24c | I-24d | I-24e |
| 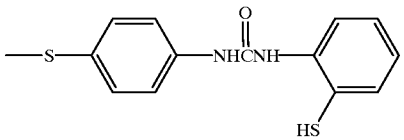 | | | | | |

TABLE 4
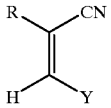
| R | Y: —ONa | Y: —SNa | Y: —$OC_2H_5$ | Y: 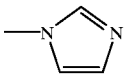 | Y: 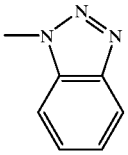 |
|---|---|---|---|---|---|
| 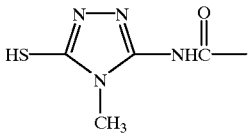 | I-25a | I-25b | I-25c | I-25d | I-25e |
| 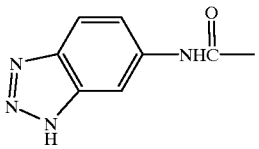 | I-26a | I-26b | I-26c | I-26d | I-26e |
| 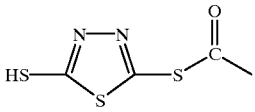 | I-27a | I-27b | I-27c | I-27d | I-27e |
| 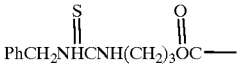 | I-28a | I-28b | I-28c | I-28d | I-28e |
| 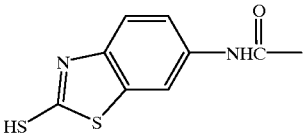 | I-29a | I-29b | I-29c | I-29d | I-29e |
| 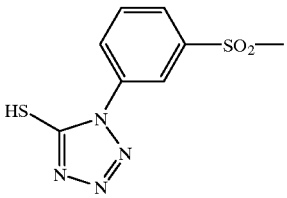 | I-30a | I-30b | I-30c | I-30d | I-30e |
| 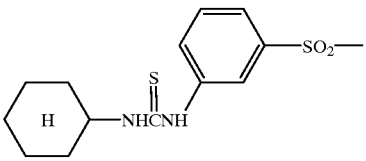 | I-31a | I-31b | I-31c | I-31d | I-31e |

TABLE 4-continued
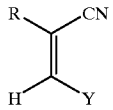
| R | Y | | | | |
|---|---|---|---|---|---|
| | —ONa | —SNa | —$OC_2H_5$ | 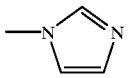 | 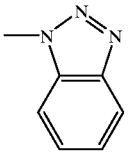 |
| | I-32a | I-32b | I-32c | I-32d | I-32e |
| 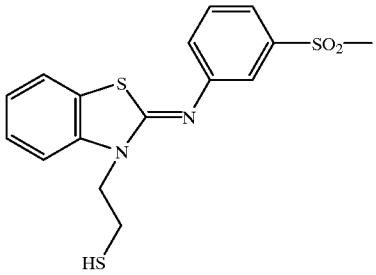 | | | | | |
TABLE 5
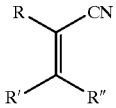
| R | R', R" | | | | |
|---|---|---|---|---|---|
| | 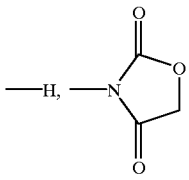 | 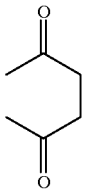 | —H, —$Si(CH_3)_3$ | 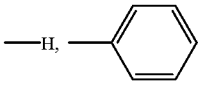 | 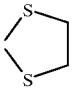 |
| | I-33a | I-33b | I-33c | I-33d | I-33e |
| 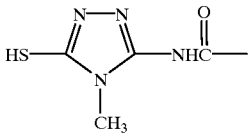 | | | | | |
| | I-34a | I-34b | I-34c | I-34d | I-34e |
| 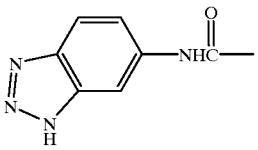 | | | | | |
| | I-35a | I-35b | I-35c | I-35d | I-35e |
| 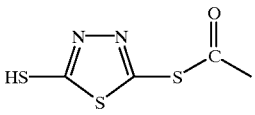 | | | | | |

TABLE 5-continued
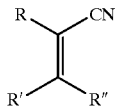
| R | R', R" | | | | |
|---|---|---|---|---|---|
| | —H, 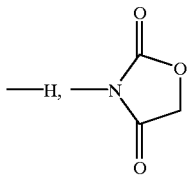 | | —H, —Si(CH$_3$)$_3$ | —H, 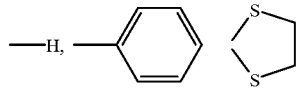 | |
| 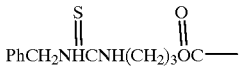 | I-36a | I-36b | I-36c | I-36d | I-36e |
| 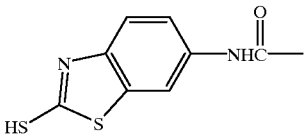 | I-37a | I-37b | I-37c | I-37d | I-37e |
| 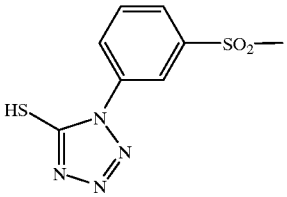 | I-38a | I-38b | I-38c | I-38d | I-38e |
| 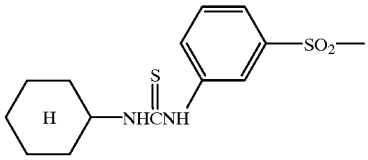 | I-39a | I-39b | I-39c | I-39d | I-39e |
| 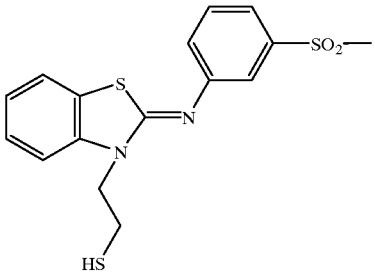 | I-40a | I-40b | I-40c | I-40d | I-40e |

TABLE 6
I-41
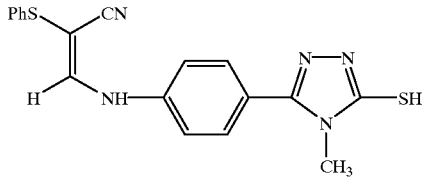
I-42
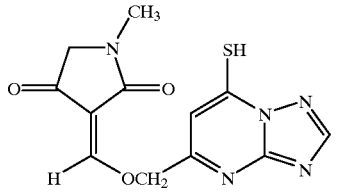
I-43
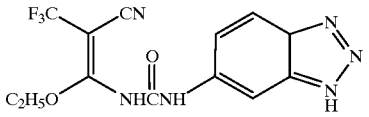
I-44
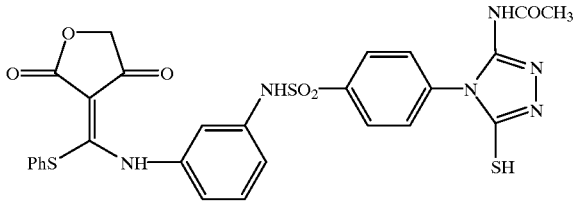
I-45
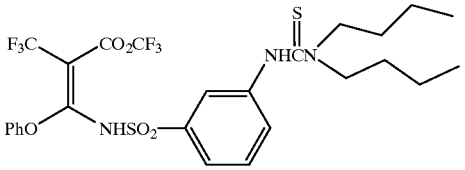
I-46
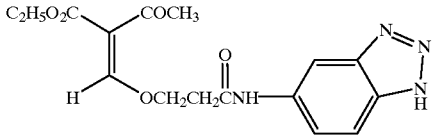
I-47
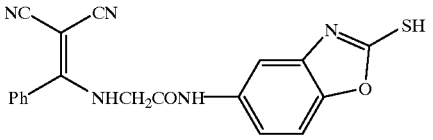
TABLE 6-continued
I-48
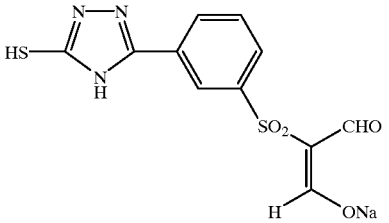
I-49
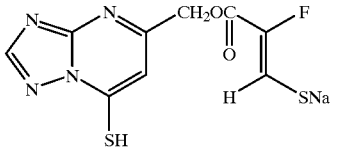
I-50
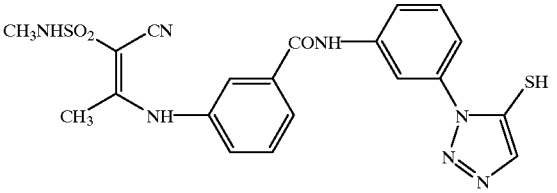
I-51
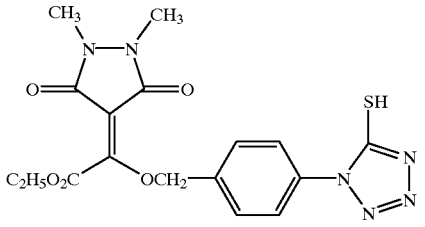
I-52
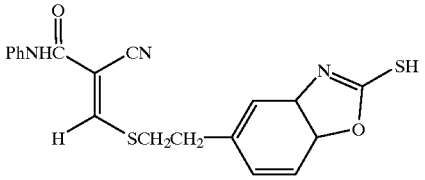
I-53
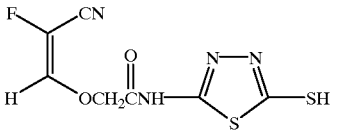

TABLE 6-continued

I-54

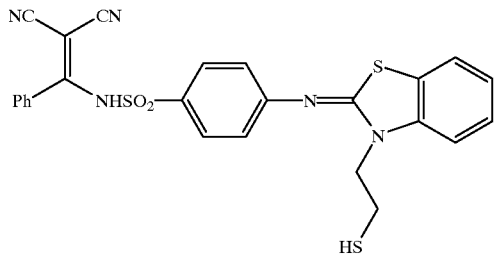

TABLE 7

I-55

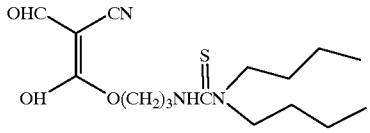

I-56

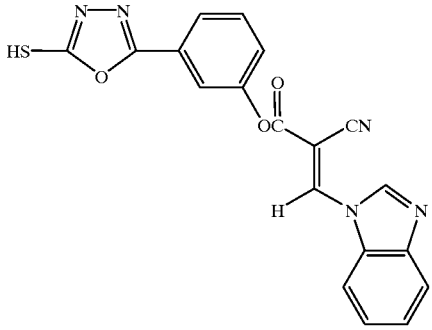

I-57

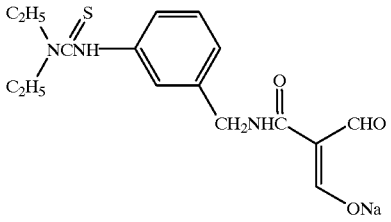

I-58

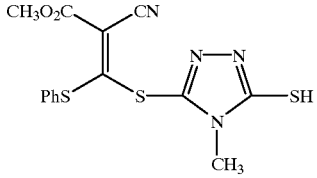

I-59

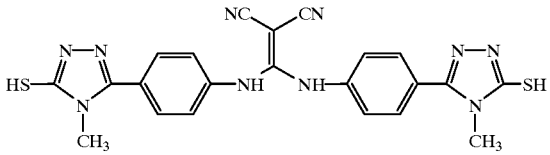

TABLE 7-continued

I-60

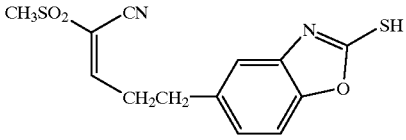

I-61

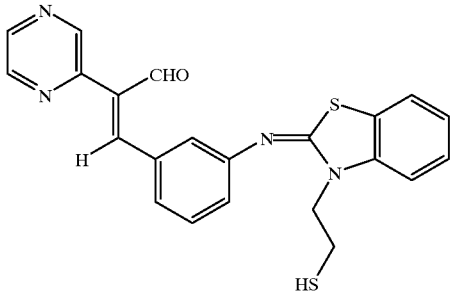

I-62

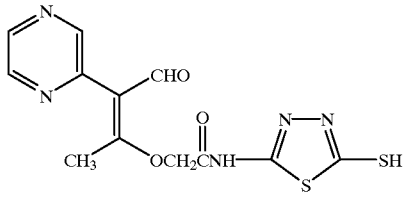

I-63

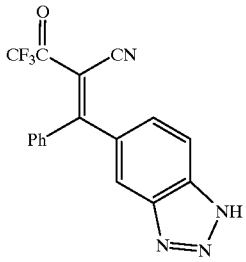

I-64

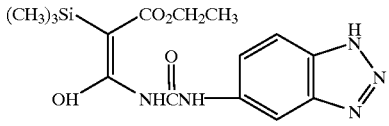

The compounds of formula (I) according to the invention can be synthesized by various well-known methods. It is impossible to describe a common synthesis method because an appropriate synthesis method is selected for a particular compound. Some useful synthesis routes are described below.

SYNTHESIS EXAMPLE

Synthesis of Illustrative Compound I-1a

To a solution containing 15 g of 1-hydroxyethyl-5-mercaptotetrazole in 100 ml of acetonitrile was added 13 ml of triethylamine. After ice cooling, 18 g of phenyl chloroformate was added dropwise to the solution, which was stirred for one hour. Ethyl acetate and dilute hydrochloric acid were added to the reaction solution. The product was extracted, dried and concentrated. To the crude product were added 80 ml of toluene, 12 g of ethoxymethylenemalononitrile, and 0.5 g of potassium carbonate. The mixture was heated under reflux for 4 hours while the ethanol formed was removed. The reaction solution was allowed to cool, the solvent was distilled off, and the reminder was worked up by column chromatography, yielding 6 g of Illustrative Compound I-1a.

It is noted that 1-hydroxyethyl-5-mercaptotetrazole was synthesized by the following procedure. While 200 ml of an aqueous solution containing 20 g of sodium azide was heated at 80° C., 32 g of 2-hydroxyethyl isocyanate was slowly added. The solution was stirred for 2 hours while heating. After cooling, sodium chloride and conc. hydrochloric acid were added to the reaction solution, which was iced cooled whereupon solids precipitated. Filtration yielded 45 g of 1-hydroxyethyl-5-mercaptotetrazole.

Synthesis of Illustrative Compound I-1b

Illustrative Compound I-1b was obtained by the same procedure as the synthesis of Illustrative Compound I-1a except that ethyl ethoxymethylenecyanoacetate was used instead of ethoxymethylenemalononitrile.

Synthesis of Illustrative Compound I-31a

Synthesis of Synthetic Intermediate 1

To a solution containing in 80 ml of acetonitrile 10 g of 3-aminophenylsulfonylacetonitrile obtained by reducing 3-nitrophenylsulfonylacetonitrile with iron, a solution containing 7 g of cyclohexylisothiocyanate in 30 ml of acetonitrile was added. The solution was stirred for 3 hours at 40° C. The reaction solution was iced cooled whereupon solids precipitated. The solids were collected by filtration and recrystallized from acetonitrile, yielding 13 g of Synthetic Intermediate 1 of the following formula.

Synthetic Intermediate 1

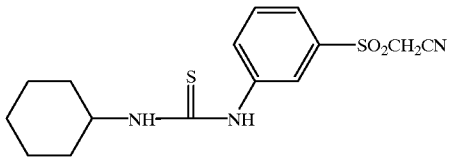

Synthesis of Illustrative Compound I-31a

After a solution containing 3 g of Synthetic Intermediate 1 in 50 ml of tetrahydrofuran was ice cooled, 0.2 g of sodium hydride was slowly added, followed by 15 minutes of stirring. Ethyl formate, 1 g, was added to the solution, which was stirred for 2 hours at room temperature. The solvent was distilled off, and methanol was added to the remainder whereupon solids precipitated. Filtration yielded 2 g of Illustrative Compound I-31a.

In the practice of the invention, the compounds of formula (I) according to the invention may be used as solution in water or suitable organic solvents. Suitable solvents include alcohols (e.g., methanol, ethanol, propanol, and fluorinated alcohols), ketones (e.g., acetone and methyl ethyl ketone), dimethylformamide, dimethyl-sulfoxide and methyl cellosolve.

A well-known emulsifying dispersion method is used for dissolving the inventive compound with the aid of an oil such as dibutyl phthalate, tricresyl phosphate, glyceryl triacetate or diethyl phthalate or an auxiliary solvent such as ethyl acetate or cyclohexanone whereby an emulsified dispersion is mechanically prepared. Alternatively, a method known as a solid dispersion method is used for dispersing the inventive compounds in powder form in water in a ball mill, colloidal mill or ultrasonic mixer.

The inventive compound of formula (I) may be added to an image forming layer or any other layer on the image forming layer side of a support, and preferably to the image forming layer or a layer disposed contiguous thereto.

The amount of the compound of formula (I) added is preferably $1\times10^{-6}$ to 1 mol, more preferably $1\times10^{-5}$ to $5\times10^{-1}$ mol, and most preferably $2\times10^{-5}$ to $2\times10^{-1}$ mol per mol of silver. The inventive compounds may be used alone or in admixture of two or more.

In the thermographic recording element according to one preferred embodiment of the invention, hydrazine derivatives are contained. Preferred hydrazine derivatives are of the following general formula (H).

(H)

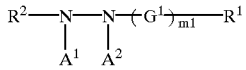

In formula (H), $R^2$ is an aliphatic, aromatic or heterocyclic group. $R^1$ is hydrogen or a block group. $G^1$ is —CO—, —COCO—, —C(=S)—, —$SO_2$—, —SO—, —PO($R^3$)— or iminomethylene group. $R^3$ is selected from the same range as defined for $R^1$ and may be different from $R^1$. Both $A^1$ and $A^2$ are hydrogen, or one of $A^1$ and $A^2$ is hydrogen and the other is a substituted or unsubstituted alkylsulfonyl, substituted or unsubstituted arylsulfonyl or substituted or unsubstituted acyl group. Letter $m_1$ is equal to 0 or 1. $R^1$ is an aliphatic, aromatic or heterocyclic group when $m_1$ is 0.

In formula (H), the aliphatic groups represented by R2 are preferably substituted or unsubstituted, normal, branched or cyclic alkyl, alkenyl and alkynyl groups having 1 to 30 carbon atoms.

In formula (H), the aromatic groups represented by $R^2$ are preferably monocyclic or fused ring aryl groups, for example, phenyl and naphthyl groups derived from benzene and naphthalene rings. The heterocyclic groups represented by $R^2$ are preferably monocyclic or fused ring, saturated or unsaturated, aromatic or non-aromatic heterocyclic groups while the heterocycles in these groups include pyridine, pyrimidine, imidazole, pyrazole, quinoline, isoquinoline, benzimidazole, thiazole, benzothiazole, piperidine, triazine, morpholine, and piperazine rings.

Aryl, alkyl and aromatic heterocyclic groups are most preferred as $R^2$.

The groups represented by $R^2$ may have substituents. Typical substituents include halogen atoms (e.g., fluorine, chlorine, bromine and iodine), alkyl groups (inclusive of aralkyl, cycloalkyl and active methine groups), alkenyl groups, alkynyl groups, aryl groups, heterocyclic groups, heterocyclic groups containing a quaternized nitrogen atom (e.g., pyridinio), acyl groups, alkoxycarbonyl groups, aryloxycarbonyl groups, carbamoyl groups, carboxy groups or salts thereof, sulfonylcarbamoyl groups, acylcarbamoyl groups, sulfamoylcarbamoyl groups, carbazoyl groups, oxalyl groups, oxamoyl groups, cyano groups, thiocarbamoyl groups, hydroxy groups, alkoxy groups (inclusive of groups having recurring ethylenoxy or propylenoxy units), aryloxy groups, heterocyclic oxy groups, acyloxy groups, (alkoxy or aryloxy)carbonyloxy groups, carbamoyloxy groups, sulfonyloxy groups, amino groups, (alkyl, aryl or heterocyclic) amino groups, N-substituted nitrogenous heterocyclic groups, acylamino groups, sulfonamide groups, ureido groups, thioureido groups, imide groups, (alkoxy or aryloxy)-carbonylamino groups, sulfamoylamino groups, semicarbazide groups, thiosemicarbazide groups, hydrazino groups, quaternary ammonio groups, oxamoylamino groups, (alkyl or aryl)sulfonylureido groups, acylureido groups, acyl-sulfamoylamino groups, nitro groups, mercapto groups, (alkyl, aryl or heterocyclic) thio groups, (alkyl or aryl)sulfonyl groups, (alkyl or aryl)sulfinyl groups, sulfo groups or salts thereof, sulfamoyl groups, acylsulfamoyl groups, sulfonylsulfamoyl groups or salts thereof, groups containing a phosphoramide or phosphate structure, silyl groups and stannyl groups. These substituents may be further substituted with such substituents.

Preferred substituents that $R^2$ may have include, where $R^2$ is an aromatic or heterocyclic group, alkyl (inclusive of active methylene), aralkyl, heterocyclic, substituted amino, acylamino, sulfonamide, ureido, sulfamoylamino, imide, thioureido, phosphoramide, hydroxy, alkoxy, aryloxy, acyloxy, acyl, alkoxycarbonyl, aryloxycarbonyl, carbamoyl, carboxy (inclusive of salts thereof), (alkyl, aryl or heterocyclic) thio, sulfo (inclusive of salts thereof), sulfamoyl, halogen, cyano, and nitro groups.

Where $R^2$ is an aliphatic group, preferred substituents include alkyl, aryl, heterocyclic, amino, acylamino, sulfonamide, ureido, sulfamoylamino, imide, thioureido, phosphoramide, hydroxy, alkoxy, aryloxy, acyloxy, acyl, alkoxycarbonyl, aryloxycarbonyl, carbamoyl, carboxy (inclusive of salts thereof), (alkyl, aryl or heterocyclic) thio, sulfo (inclusive of salts thereof), sulfamoyl, halogen, cyano, and nitro groups.

In formula (H), $R^1$ is hydrogen or a block group. Examples of the block group include aliphatic groups (e.g., alkyl, alkenyl and alkynyl groups), aromatic groups (monocyclic or fused ring aryl groups), heterocyclic groups, alkoxy, aryloxy, amino and hydrazino groups.

The alkyl groups represented by $R^1$ are preferably substituted or unsubstituted alkyl groups having 1 to 10 carbon atoms, for example, methyl, ethyl, trifluoromethyl, difluoromethyl, 2-carboxytetrafluoroethyl, pyridiniomethyl, difluoromethoxymethyl, difluorocarboxymethyl, 3-hydroxy-propyl, hydroxymethyl, 3-methanesulfonamidopropyl, benzenesulfonamidemethyl, trifluoroacetylmethyl, dimethyl-aminomethyl, phenylsulfonylmethyl, o-hydroxybenzyl, methoxymethyl, phenoxymethyl, 4-ethylphenoxymethyl, phenyl-thiomethyl, t-butyl, dicyanomethyl, diphenylmethyl, triphenylmethyl, methoxycarbonyldiphenylmethyl, cyano-diphenylmethyl, and methylthiodiphenylmethyl groups. The alkenyl groups are preferably those having 1 to 10 carbon atoms, for example, vinyl, 2-ethoxycarbonylvinyl, 2-trifluoro-2-methoxycarbonylvinyl, 2,2-dicyanovinyl and 2-cyano-2-methoxycarbonylvinyl groups. The alkynyl groups are preferably those having 1 to 10 carbon atoms, for example, ethynyl and 2-methoxycarbonylethynyl groups. The aryl groups are preferably monocyclic or fused ring aryl groups, especially those containing a benzene ring, for example, phenyl, perfluorophenyl, 3,5-dichlorophenyl, 2-methanesulfonamidophenyl, 2-carbamoylphenyl, 4,5-dicyanophenyl, 2-hydroxymethylphenyl, 2,6-dichloro-4-cyanophenyl, and 2-chloro-5-octylsulfamoylphenyl groups.

The heterocyclic groups represented by $R^1$ are preferably 5- and 6-membered, saturated or unsaturated, monocyclic or fused ring, heterocyclic groups containing at least one of nitrogen, oxygen and sulfur atoms, for example, morpholino, piperidino (N-substituted), imidazolyl, indazolyl (e.g., 4-nitroindazolyl), pyrazolyl, triazolyl, benzimidazolyl, tetrazolyl, pyridyl, pyridinio (e.g., N-methyl-3-pyridinio), quinolinio, quinolyl, hydantoyl and imidazolidinyl groups.

The alkoxy groups are preferably those having 1 to 8 carbon atoms, for example, methoxy, 2-hydroxyethoxy, benzyloxy, and t-butoxy groups. The aryloxy groups are preferably substituted or unsubstituted phenoxy groups. The amino groups are preferably unsubstituted amino, alkylamino having 1 to 10 carbon atoms, arylamino, and saturated or unsaturated heterocyclic amino groups (preferably nitrogenous heterocyclic amino groups containing a quaternized nitrogen atom). Examples of the amino group include 2,2,6,6-tetramethylpiperidin-4-ylamino, propylamino, 2-hydroxyethylamino, anilino, o-hydroxyanilino, 5-benzotriazolylamino, and N-benzyl-3-pyridinioamino groups. The hydrazino groups are preferably substituted or unsubstituted hydrazino groups and substituted or unsubstituted phenylhydrazino groups (e.g., 4-benzenesulfonamidophenylhydrazino).

The groups represented by $R^1$ may be substituted ones, with examples of the substituent being as exemplified for the substituent on $R^2$.

In formula (H), $R^1$ may be such a group as to induce cyclization reaction to cleave a $G^1$-$R^1$ moiety from the remaining molecule to generate a cyclic structure containing the atoms of the -$G^1$-$R^1$ moiety. Such examples are described in JP-A 29751/1988, for example.

The hydrazine derivative of formula (H) may have incorporated therein a group capable of adsorbing to silver halide. Such adsorptive groups include alkylthio, arylthio, thiourea, thioamide, mercapto heterocyclic and triazole groups as described in U.S. Pat. Nos. 4,385,108 and 4,459,347, JP-A 195233/1984, 200231/1984, 201045/1984, 201046/1984, 201047/1984, 201048/1984, 201049/1984, 170733/1986, 270744/1986, 948/1987, 234244/1988, 234245/1988, and 234246/1988. These adsorptive groups to silver halide may take the form of precursors. Such precursors are exemplified by the groups described in JP-A 285344/1990.

$R^1$ and $R^2$ in formula (H) may have incorporated therein a ballast group or polymer commonly used in immobile photographic additives such as couplers. The ballast group is a group having at least 8 carbon atoms and relatively inert with respect to photographic properties. It may be selected from, for example, alkyl, aralkyl, alkoxy, phenyl, alkylphenyl, phenoxy, and alkylphenoxy groups. The polymer is exemplified in JP-A 100530/1989, for example.

$R^1$ or $R^2$ in formula (H) may have a plurality of hydrazino groups as a substituent. In this case, the compounds of formula (H) are polymeric with respect to hydrazino groups. Exemplary polymeric compounds are described in JP-A 86134/1989, 16938/1992, 197091/1993, WO 95-32452 and 95-32453, Japanese Patent Application Nos. 351132/1995, 351269/1995, 351168/1995, 351287/1995, and 351279/1995.

$R^1$ or R2 in formula (H) may contain a cationic group (e.g., a group containing a quaternary ammonio group and a nitrogenous heterocyclic group containing a quaternized nitrogen atom), a group containing recurring ethylenoxy or propylenoxy units, an (alkyl, aryl or heterocyclic) thio group, or a group which is dissociable with a base (e.g., carboxy, sulfo, acylsulfamoyl, and carbamoylsulfamoyl). Exemplary compounds containing such a group are described in, for example, in JP-A 234471/1995, 333466/1993, 19032/1994, 19031/1994, 45761/1993, 259240/1991, 5610/1995, and 244348/1995, U.S. Pat. No. 4,994,365 and 4,988,604, and German Patent No. 4006032.

In formula (H), each of $A^1$ and $A^2$ is a hydrogen atom, a substituted or unsubstituted alkyl- or arylsulfonyl group having up to 20 carbon atoms (preferably a phenylsulfonyl group or a phenylsulfonyl group substituted such that the sum of Hammette substituent constants may be −0.5 or more), or a substituted or unsubstituted acyl group having up to 20 carbon atoms (preferably a benzoyl group, a benzoyl group substituted such that the sum of Hammette substituent constants may be −0.5 or more, or a linear, branched or cyclic, substituted or unsubstituted, aliphatic acyl group wherein the substituent is selected from a halogen atom, ether group, sulfonamide group, carbonamide group, hydroxyl group, carboxy group and sulfo group). Most preferably, both $A^1$ and $A^2$ are hydrogen atoms.

The preferable range of the hydrazine derivatives of the general formula (H) is described.

In formula (H), $R^2$ is preferably phenyl, substituted alkyl groups of 1 to 3 carbon atoms or aromatic heterocyclic groups.

Where $R^2$ represents phenyl or aromatic heterocyclic groups, preferred substituents thereon include nitro, cyano, alkoxy, alkyl, acylamino, ureido, sulfonamide, thioureido, carbamoyl, sulfamoyl, sulfonyl, carboxy (or salts thereof), sulfo (or salts thereof), alkoxycarbonyl, and chloro groups.

Where $R^2$ represents substituted alkyl groups of 1 to 3 carbon atoms, they are more preferably substituted methyl groups, and further preferably di- or tri-substituted methyl groups. Exemplary preferred substituents on these methyl groups include methyl, phenyl, cyano, (alkyl, aryl or heterocyclic) thio, alkoxy, aryloxy, chloro, heterocyclic, alkoxycarbonyl, aryloxycarbonyl, carbamoyl, sulfamoyl, amino, acylamino, and sulfonamide groups, and especially, substituted or unsubstituted phenyl groups.

Where $R^2$ represents substituted methyl groups, preferred examples thereof are t-butyl, dicyanomethyl, dicyanophenylmethyl, triphenylmethyl (trityl), diphenylmethyl, methoxycarbonyldiphenylmethyl, cyanodiphenylmethyl, methylthiodiphenylmethyl, cyclopropyldiphenylmethyl groups, with trityl being most preferred.

Where $R^2$ is aromatic heterocyclic groups, it is more preferred that the heterocycles in $R^2$ are pyridine, quinoline, pyrimidine, triazine, benzothiazole, benzimidazole and thiophene rings.

Most preferably, $R^2$ in formula (H) represents substituted or unsubstituted phenyl groups.

In formula (H), $m_1$ is equal to 0 or 1. When $m_1$ is 0, $R^1$ represents aliphatic, aromatic or heterocyclic groups. When $m_1$ is 0, $R^1$ more preferably represents phenyl groups, substituted alkyl groups of 1 to 3 carbon atoms or alkenyl groups. Of these, the preferred ranges of the phenyl and substituted ($C_{1-3}$) alkyl groups are the same as the preferred range of $R^2$. Where $R^1$ represents alkenyl groups, $R^1$ is preferably vinyl groups, especially vinyl groups having one or two substituents selected from among cyano, acyl, alkoxycarbonyl, nitro, trifluoromethyl and carbamoyl groups. Illustrative examples of such substituted vinyl groups are 2,2-dicyanovinyl, 2-cyano-2-methoxycarbonylvinyl, and 2-acetyl-2-ethoxycarbonylvinyl groups.

Preferably $m_1$ is equal to 1.

Where $R^2$ is a phenyl group or aromatic heterocyclic group and $G^1$ is —CO—, the groups represented by $R^1$ are preferably selected from hydrogen, alkyl, alkenyl, alkynyl, aryl and heterocyclic groups, more preferably from hydrogen, alkyl and aryl groups, and most preferably from hydrogen atoms and alkyl groups. Where $R^1$ represents alkyl groups, preferred substituents thereon are halogen, alkoxy, aryloxy, alkylthio, arylthio, hydroxy, sulfonamide, amino, acylamino and carboxy groups.

Where $R^2$ is a substituted methyl group and $G^1$ is —CO—, the groups represented by R1 are preferably selected from hydrogen, alkyl, aryl, heterocyclic, alkoxy, and amino groups (including unsubstituted amino, alkylamino, arylamino and heterocyclic amino groups), more preferably from hydrogen, alkyl, aryl, heterocyclic, alkoxy, alkylamino, arylamino and heterocyclic amino groups. Where $G^1$ is —COCO—, independent of $R^2$, $R^1$ is preferably selected from alkoxy, aryloxy, and amino groups, more preferably from substituted amino groups, specifically alkylamino, arylamino and saturated or unsaturated heterocyclic amino groups.

Where $G^1$ is —$SO_2$—, independent of $R^2$, $R^1$ is preferably selected from alkyl, aryl and substituted amino groups.

In formula (H), $G^1$ is preferably —CO— or —COCO—, and most preferably —CO—.

Illustrative, non-limiting, examples of the compound represented by formula (H) are given below.

TABLE 8

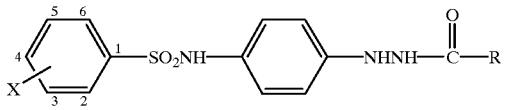

| | | R = | | | |
|---|---|---|---|---|---|
| | X = | —H | —$C_2F_4$—COOH or (—$C_2F_4$—$COO^{\ominus}K^{\oplus}$) | 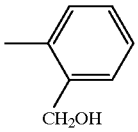 | 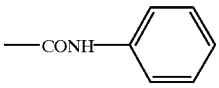 |
| 1 | 3-NHCO—$C_9H_{19}$(n) | 1a | 1b | 1c | 1d |
| 2 | 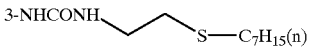 | 2a | 2b | 2c | 2d |
| 3 | 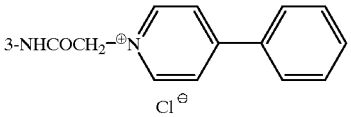 | 3a | 3b | 3c | 3d |

TABLE 8-continued
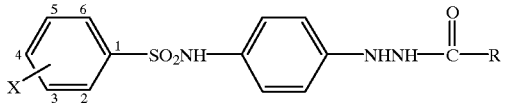
| | X = | R = —H | —$C_2F_4$—COOH or (—$C_2F_4$—$COO^{\ominus}K^{\oplus}$) | 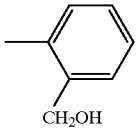 | 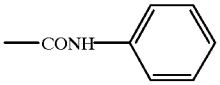 |
|---|---|---|---|---|---|
| 4 | 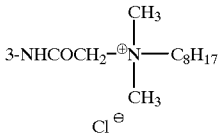 | 4a | 4b | 4c | 4d |
| 5 | 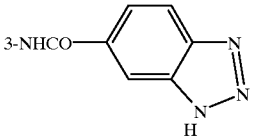 | 5a | 5b | 5c | 5d |
| 6 | 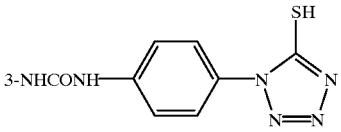 | 6a | 6b | 6c | 6d |
| 7 | 2,4-$(CH_3)_2$-3-$SC_2H_4$—$(OC_2H_4)_4$—$OC_8H_{17}$ | 7a | 7b | 7c | 7d |
TABLE 9
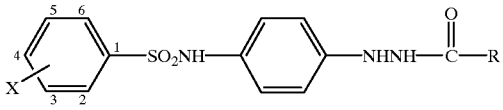
| | X = | R = —H | —$CF_2H$ | 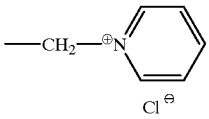 | 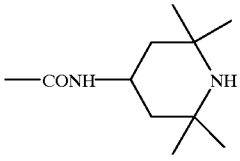 |
|---|---|---|---|---|---|
| 8 | 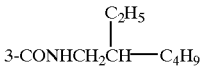 | 8a | | 8e | 8f | 8g |
| 9 | 6-$OCH_3$-3-$C_5H_{11}$(t) | 9a | | 9e | 9f | 9g |
| 10 | 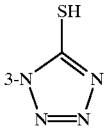 | 10a | | 10e | 10f | 10g |

TABLE 9-continued
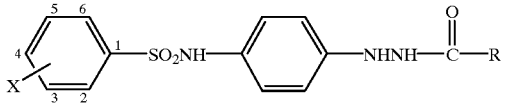
| | X = | R = —H | —$CF_2H$ | —$CH_2$—$^{\oplus}N$(Cl$^{\ominus}$) | —CONH—(NH) |
|---|---|---|---|---|---|
| 11 | 3-$NHCOCH_2SCH$ (Cl) | 11a | | 11e | 11f | 11g |
| 12 | 4-$NHCOCH_2$—S—(N—N, S)—SH | 12a | | 12e | 12f | 12g |
| 13 | 3-NHCOCH($C_8H_{17}$)—$CH_2COOH$ | 13a | | 13e | 13f | 13g |
| 14 | 3,5—(CONHCH($C_2H_5$)$CH_2$—$C_4H_9$)$_2$ | 14a | | 14e | 14f | 14g |
TABLE 10
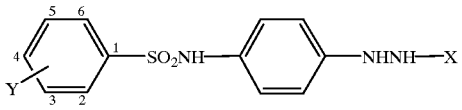
| | Y = | X = —CHO | —$COCF_3$ | —$SO_2CH_3$ | —$P(O)(OC_2H_5)_2$ |
|---|---|---|---|---|---|
| 15 | 3-$NHCOCH_2$$^{\oplus}N$—$CONHC_4H_9$ ($^{\ominus}Cl$) | 15a | 15h | 15i | 15j |
| 16 | 4-$NHCO(CH_2)_2$$^{\oplus}N$—$C_6H_{13}$ ($Cl^{\ominus}$) | 16a | 16h | 16i | 16j |
| 17 | 3-$SO_2NH$—$CH_2CH_2$—O—$CH_2CH_2$—$OC_4H_9$ (4) | 17a | 17h | 17i | 17j |

TABLE 10-continued
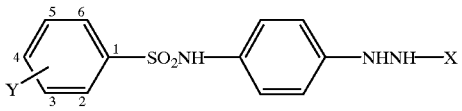
| | Y = | X = —CHO | —COCF$_3$ | —SO$_2$CH$_3$ | —P(=O)(OC$_2$H$_5$)$_2$ |
|---|---|---|---|---|---|
| 18 | 3,4-(COO$\overset{\overset{\displaystyle CH_3}{\vert}}{C}$HCOOC$_4$H$_9$)$_2$ | 18a | 18h | 18i | 18j |
| 19 | 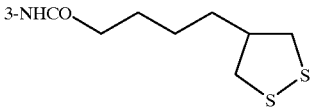 | 19a | 19h | 19i | 19j |
| 20 | 3-NHSO$_2$NH—C$_8$H$_{17}$ | 20a | 20h | 20i | 20j |
| 21 | 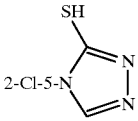 | 21a | 21h | 21i | 21j |

TABLE 11
| | | R = | | | |
|---|---|---|---|---|---|
| | | —H | —$CF_3$ | 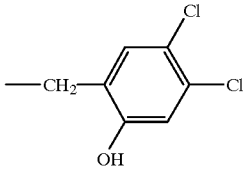 | 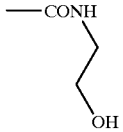 |
| 22 | 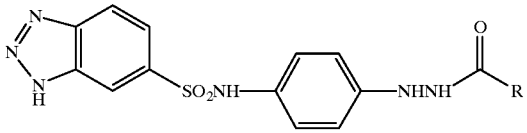 | 22a | 22h | 22k | 22l |
| 23 | 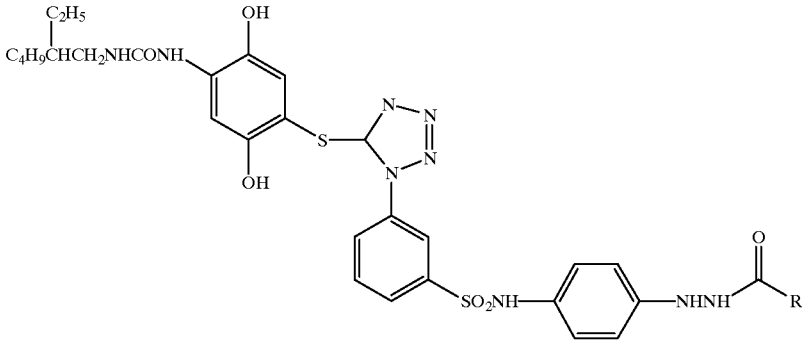 | 23a | 23h | 23k | 23l |

TABLE 11-continued
| | | R = | | | |
|---|---|---|---|---|---|
| | | —H | —$CF_3$ | —$CH_2$— 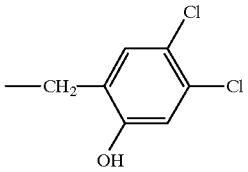 | —CONH— 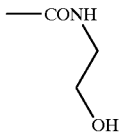 |
| 24 | 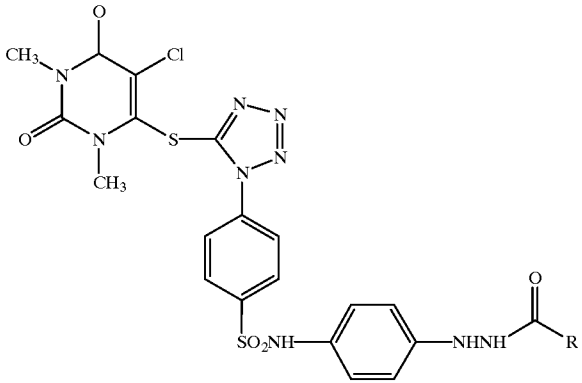 | 24a | 24h | 24k | 24l |
| 25 | 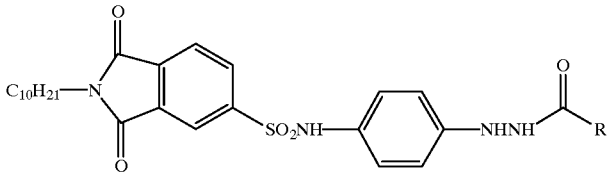 | 25a | 25h | 25k | 25l |

TABLE 11-continued
| | | R = | | | |
|---|---|---|---|---|---|
| | | —H | —$CF_3$ | 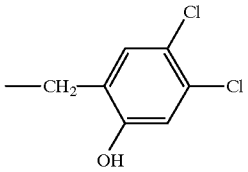 | 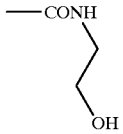 |
| 26 | 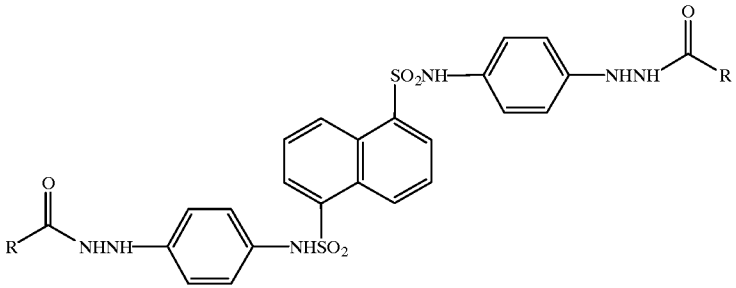 | 26a | 26h | 26k | 26l |
| 27 | 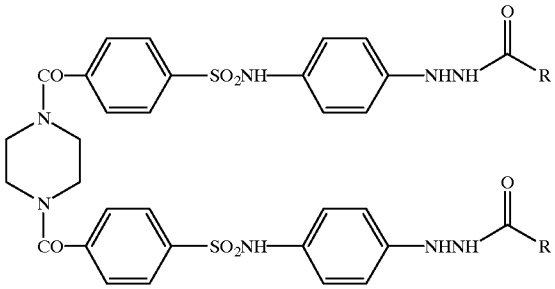 | 27a | 27h | 27k | 27l |

TABLE 11-continued
| | | R = | | | |
|---|---|---|---|---|---|
| | | —H | —$CF_3$ | 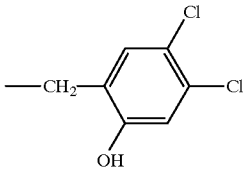 | 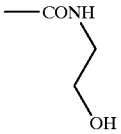 |
| 28 | 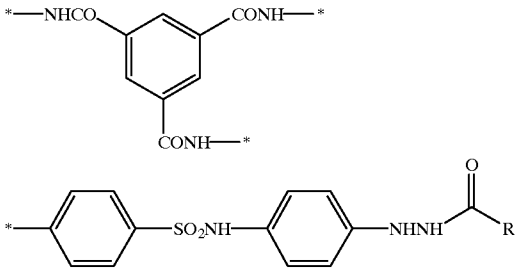 | 28a | 28h | 28k | 28l |

TABLE 12
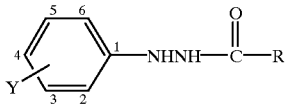
| | Y = | R = —H | —$CH_2OCH_3$ | 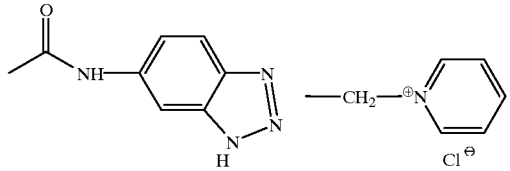 | |
|---|---|---|---|---|---|
| 29 | 4-NHC(=S)NH—$C_8H_{17}$(n) | 29a | 29m | 29n | 29f |
| 30 | 4-NHP(=O)($OCH_2$—$C_6H_4$)$_2$ | 30a | 30m | 30n | 30f |
| 31 | 4-NHCONH—$(CH_2)_3O$—$C_6H_4$—C(CH$_3$)$_2$—CH$_2$ | 31a | 31m | 31n | 31f |
| 32 | 4-OH, 3-NHCONH$CH_2$CH($C_2H_5$)—$C_4H_9$ | 32a | 32m | 32n | 32f |
| 33 | 4-$NHSO_2(CH_2)_2NHCO$—$C_6H_4$—[1,2,3,4-tetrazole-5-SH] | 33a | 33m | 33n | 33f |
| 34 | 4-$OCH_2$—$C_6H_4$ | 34a | 34m | 34n | 34f |
| 35 | 4-NHCONHN(—$CH_2$—$C_6H_4$)$_2$ | 35a | 35m | 35n | 35f |

TABLE 13
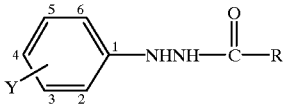
| | Y = | R = —H | —$CF_2SCH_3$ | —$CONHCH_3$ | 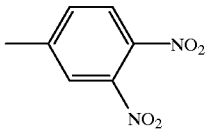 |
|---|---|---|---|---|---|
| 36 | 2-$NHSO_2CH_3$— <br> 4-$NHCONH(CH_2)_3$— 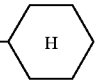 | 36a | 36o | 36p | 36q |
| 37 | 2-$OCH_3$- <br> 4-$NHSO_2C_{12}H_{25}$ | 37a | 37o | 37p | 37q |
| 38 | 3-$NHCOC_{11}H_{23}$- <br> 4-$NHSO_2CF_3$ | 38a | 38o | 38p | 38q |
| 39 | 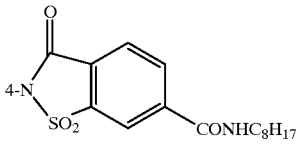 | 39a | 39o | 39p | 39q |
| 40 | 4-$OCO(CH_2)_2COOC_6H_{13}$ | 40a | 40o | 40p | 40q |
| 41 | 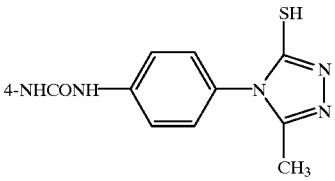 | 41a | 41o | 41p | 41q |
| 42 | 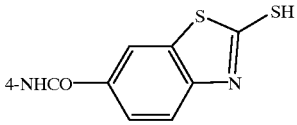 | 42a | 42o | 42p | 42q |
TABLE 14
43
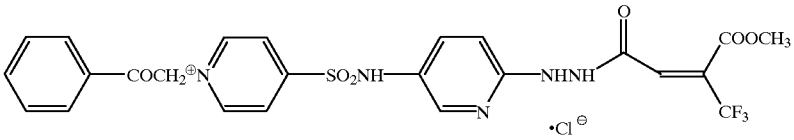
44
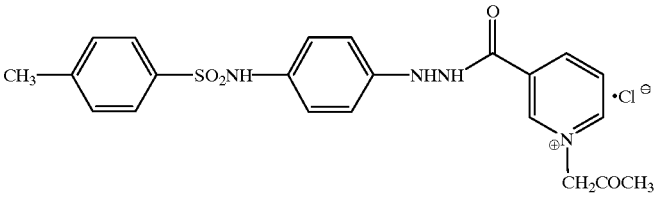

TABLE 14-continued
45
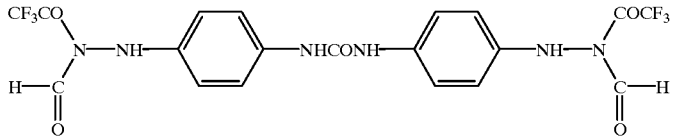
46
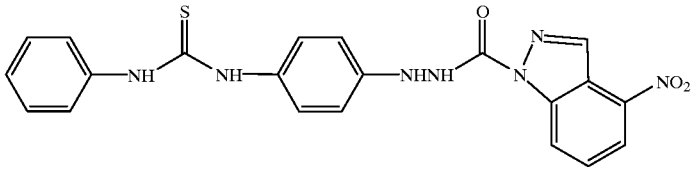
47
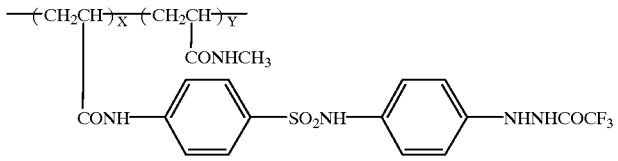
X:Y = 3:97
average molecule weight~100,000
48
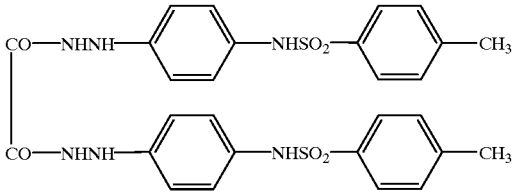
49
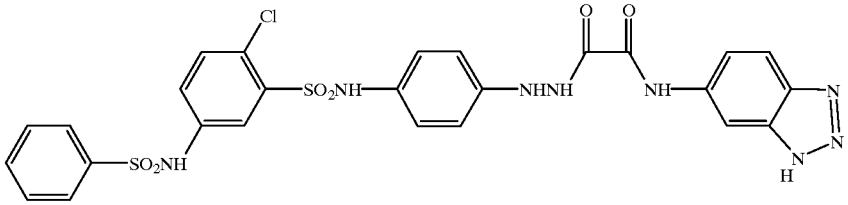
50
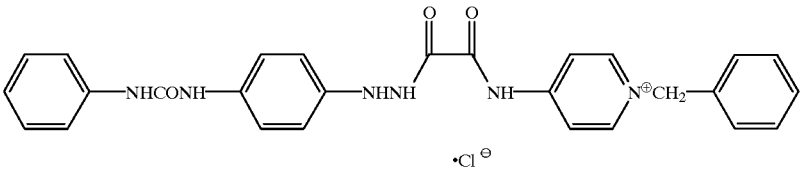
TABLE 15
51
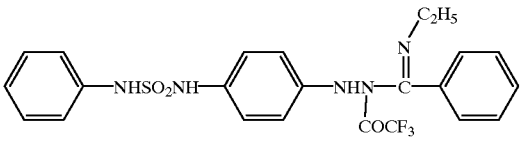
TABLE 15-continued
52
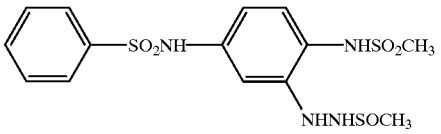
53
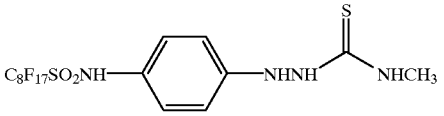

TABLE 16
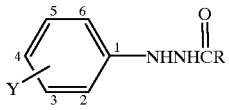
| | | R = | | | |
|---|---|---|---|---|---|
| | Y = | —H | —$CH_2OCH_3$ | —$CH_2O$— 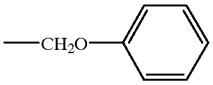 | —$CONHC_3H_7$ |
| 54 | 2-$OCH_3$ | 54a | 54m | 54r | 54s |
| 55 | 2-$OCH_3$ 5-$C_8H_{17}$(t) | 55a | 55m | 55r | 55s |
| 56 | 4-$NO_2$ | 56a | 56m | 56r | 56s |
| 57 | 4-$CH_3$ | 57a | 57m | 57r | 57s |
| 58 | 4-NHCO— 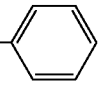 | 58a | 58m | 58r | 58s |
| 59 | 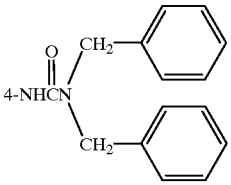 | 59a | 59m | 59r | 59s |
TABLE 17
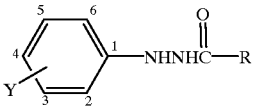
| | | R = | | | |
|---|---|---|---|---|---|
| | Y = | —H | 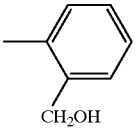 | —$CH_2$— 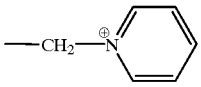 | —CONH— 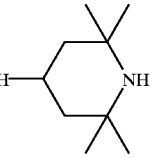 |
| 60 | 2-$OCH_3$ 5-$OCH_3$ | 60a | 60c | 60f | 60g |
| 61 | 4-$C_8H_{17}$(t) | 61a | 61c | 61f | 61g |
| 62 | 4-$OCH_3$ | 62a | 62c | 62f | 62g |
| 63 | 3-$NO_2$ | 63a | 63c | 63f | 63g |
| 64 | 4-NHCO— 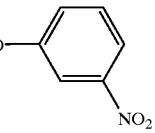 | 64a | 64c | 64f | 64g |

TABLE 17-continued
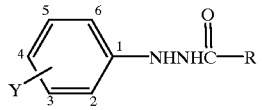
| | R = | | | |
|---|---|---|---|---|
| Y = | —H | 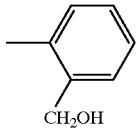 | 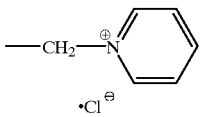 | 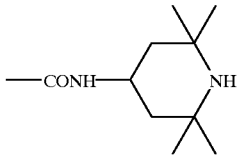 |
| 65 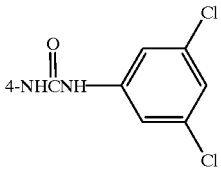 | 65a | 65c | 65f | 65g |
TABLE 18
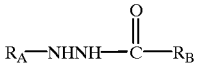
| | $R_B$ = | | | |
|---|---|---|---|---|
| $R_A$ = | —H | 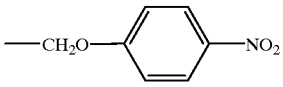 | 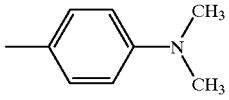 | 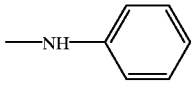 |
| 66 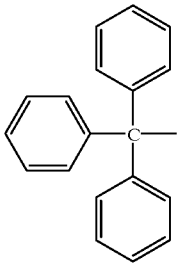 | 66a | 66u | 66v | 66t |
| 67 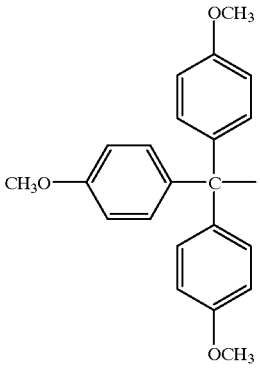 | 67a | 67u | 67v | 67t |

TABLE 18-continued
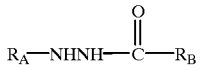
| | $R_A$ = | $R_B$ = —H | —$CH_2O$— 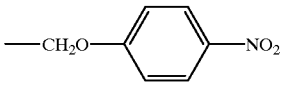 | 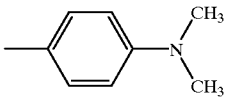 | —NH— 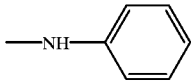 |
|---|---|---|---|---|---|
| 68 | 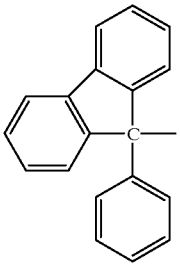 | 68a | 68u | 68v | 68t |
| 69 | 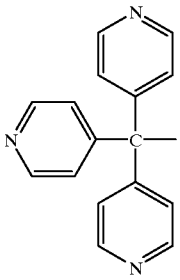 | 69a | 69u | 69v | 69t |
| 70 | 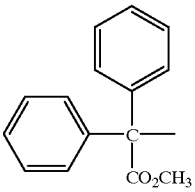 | 70a | 70u | 70v | 70t |
| 71 | 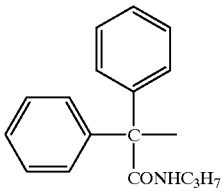 | 71a | 71u | 71v | 71t |

TABLE 19
| | $R_A$= | $R_B$ = | | | |
|---|---|---|---|---|---|
| | | $-C(=O)NHC_3H_7$ | $-C(=O)O-C_4H_9(t)$ | $-OC_4H_9(t)$ | 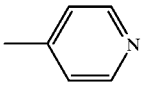 |
| 72 | 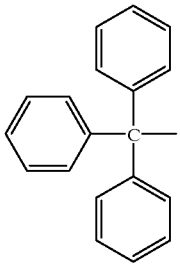 | 72s | 72x | 72y | 72w |
| 73 | 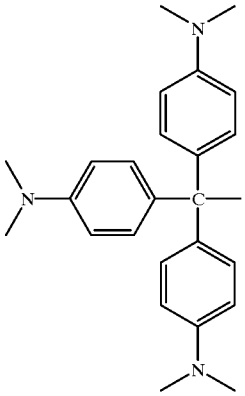 | 73s | 73x | 73y | 73w |
| 74 | 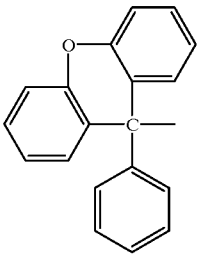 | 74s | 74x | 74y | 74w |
| 75 | 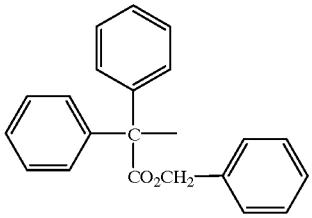 | 75s | 75x | 75y | 75w |

TABLE 19-continued
| | $R_A$—NHNH—C(=O)—$R_B$ | | | |
|---|---|---|---|---|
| | $R_B$ = | | | |
| $R_A$= | —C(=O)NHC$_3$H$_7$ | —C(=O)O—C$_4$H$_9$(t) | —OC$_4$H$_9$(t) | 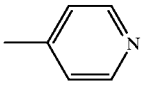 |
| 76 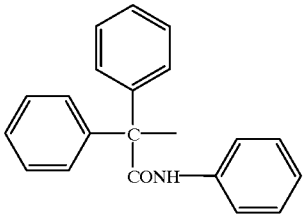 | 76s | 76x | 76y | 76w |
TABLE 20
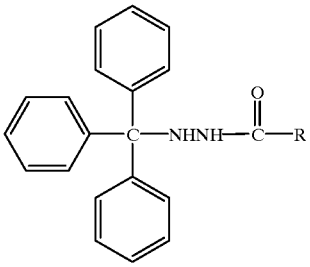
R =
| | |
|---|---|
| 77 | 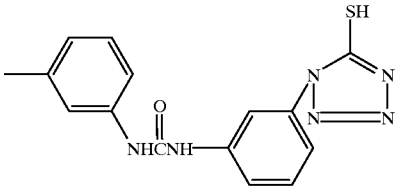 |
| 78 | —$CH_2SCH_2CH_2SO_2$— 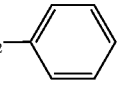 |
| 79 | —$CH_2OCH_2CH_2SCH_2CH_2OCH_3$ |
| 80 | —$CF_2CF_2COOH$ |
| 81 | —$CH_2OCH_2S$— 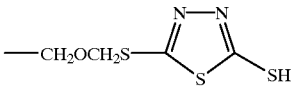 |
| 82 | —$CH_2$— 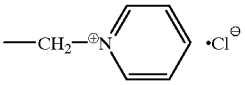 |
TABLE 21
| | |
|---|---|
| 83 | 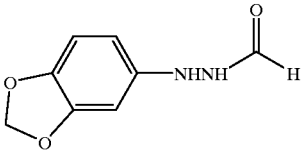 |
| 84 | 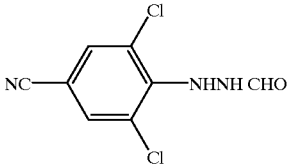 |
| 85 | 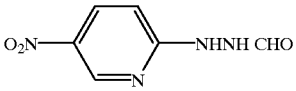 |
| 86 | 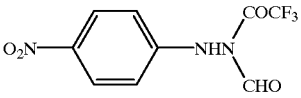 |
| 87 | 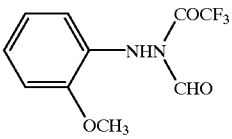 |
| 88 | 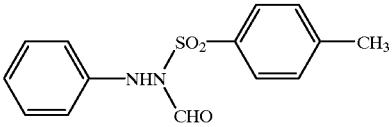 |

TABLE 22
| | |
|---|---|
| 89 | 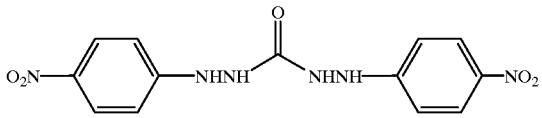 |
| 90 | 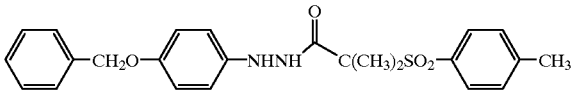 |
| 91 | 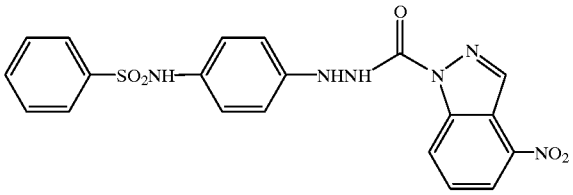 |
| 92 | 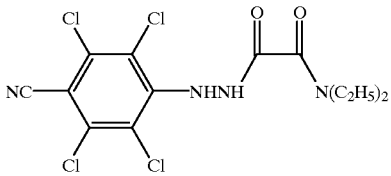 |
| 93 | 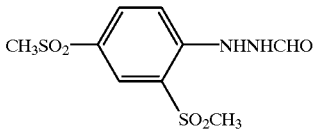 |
| 94 | 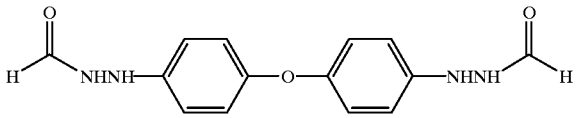 |
TABLE 23
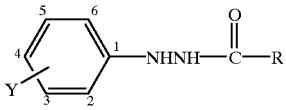
| Y = | R = |
|---|---|
| | 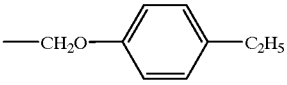 |
| | | |
|---|---|---|
| 95 | 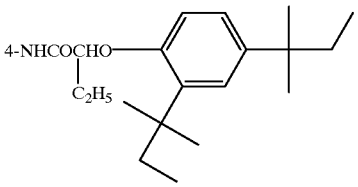 | 95-1 |
| 96 | 4-COOH | 96-1 |

TABLE 23-continued
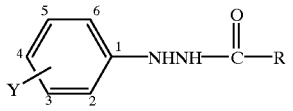
| | | |
|---|---|---|
| 97 | 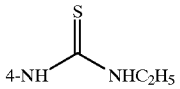 | 97-1 |
| 98 | 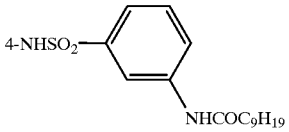 | 98-1 |
| 99 | 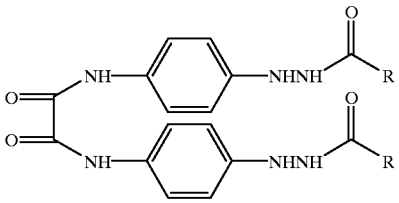 | 99-1 |
| 100 | 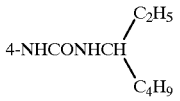 | 100-1 |
| | R = | | |
|---|---|---|---|
| | 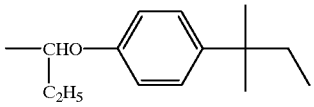 | 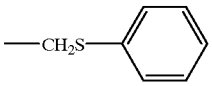 | 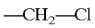 |
| 95 | 95-2 | 95-3 | 95-4 |
| 96 | 96-2 | 96-3 | 96-4 |
| 97 | 97-2 | 97-3 | 97-4 |
| 98 | 98-2 | 98-3 | 98-4 |
| 99 | 99-2 | 99-3 | 99-4 |
| 100 | 100-2 | 100-3 | 100-4 |
TABLE 24
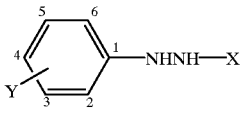
| | | X = | | | |
|---|---|---|---|---|---|
| | Y = | 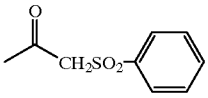 | 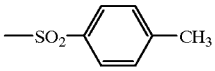 | 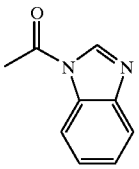 | 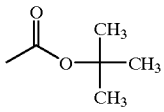 |
| 101 | 4-$NO_2$ | 101-5 | 101-6 | 101-7 | 101y |

TABLE 24-continued
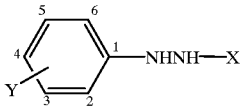
| | | | | | |
|---|---|---|---|---|---|
| 102 | 2,4-$OCH_3$ | 102-5 | 102-6 | 102-7 | 102y |
| 103 | 4-$NHCOCH_2O$ 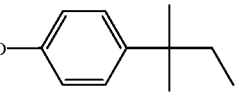 | 103-5 | 103-6 | 103-7 | 103y |
| | | X = | | | |
|---|---|---|---|---|---|
| | Y = | 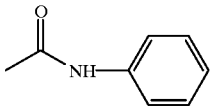 | 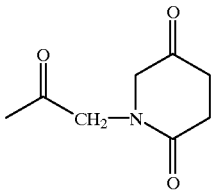 | 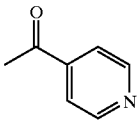 | 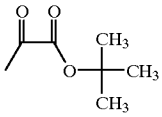 |
| 104 | 4-NHCONH 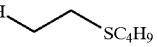 $SC_4H_9$ | 104-8 | 104-9 | 10w' | 104x |
| 105 | 4-$NHSO_2$ 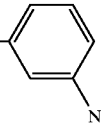 $NO_2$ | 105-8 | 105-9 | 105w' | 105x |
TABLE 25
| | | Y—NH NH—X | | | |
|---|---|---|---|---|---|
| | | X = | | | |
| | Y = | 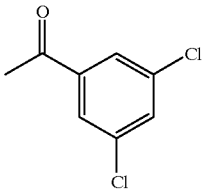 | 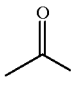 | 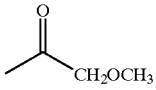 | 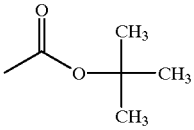 |
| 106 | 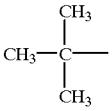 | 106-10 | 106a | 106m | 106y |
| 107 | 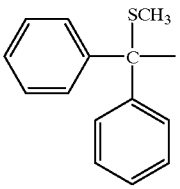 | 107-10 | 107a | 107m | 107y |

TABLE 25-continued
| | Y—NH NH—X | | | | |
|---|---|---|---|---|---|
| | X = | | | | |
| Y = | 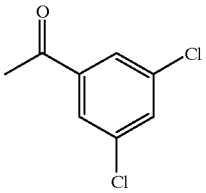 | 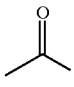 | 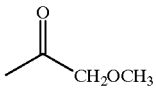 | 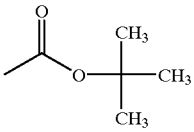 |
| 108 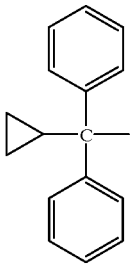 | 108-10 | 108a | 108m | 108y | |
| 109 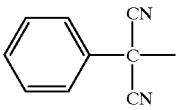 | 109-10 | 109a | 109m | 109y | |
| 110 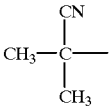 | 110-10 | 110a | 110m | 110y | |
| 111 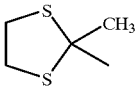 | 111-10 | 111a | 111m | 111y | |
TABLE 26
| | Y—NH NH—X | | | |
|---|---|---|---|---|
| | X = | | | |
| Y = | 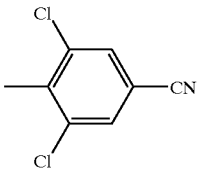 | 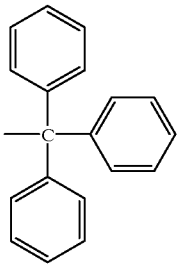 | 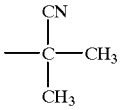 | 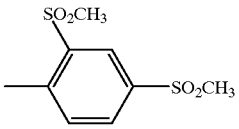 |
| 112 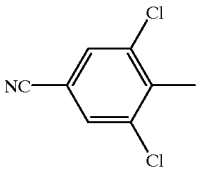 | 112-11 | 112-12 | 112-13 | 112-14 |

TABLE 26-continued
| | Y—NH NH—X | | | | |
|---|---|---|---|---|---|
| | | X = | | | |
| | Y = | 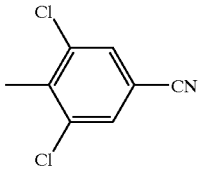 | 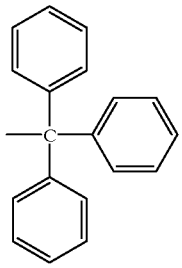 | 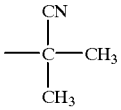 | 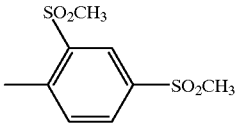 |
| 113 | 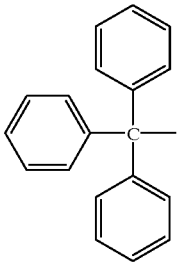 | 113-11 | 113-12 | 113-13 | 113-14 |
| 114 | 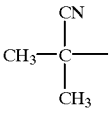 | 114-11 | 114-12 | 114-13 | 114-14 |
| 115 | 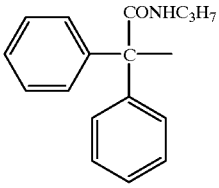 | 115-11 | 115-12 | 115-13 | 115-14 |
| 116 | 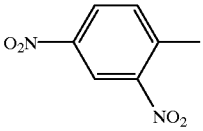 | 116-11 | 116-12 | 116-13 | 116-14 |
| 117 | 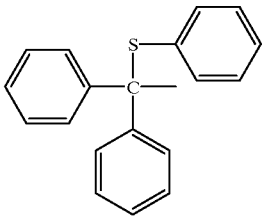 | 117-11 | 117-12 | 117-13 | 117-14 |

TABLE 27
118
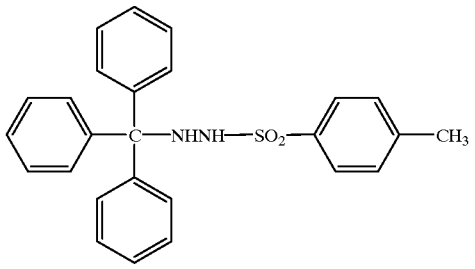
119
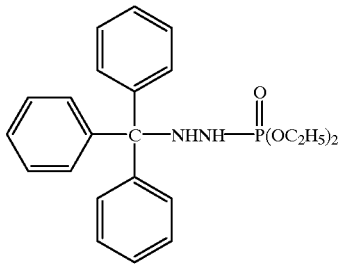
120
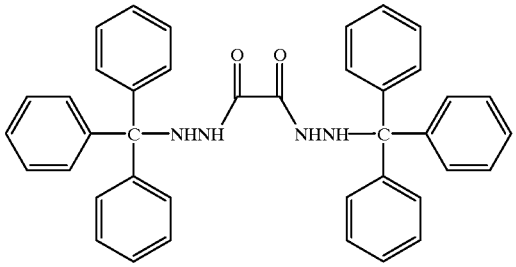
121
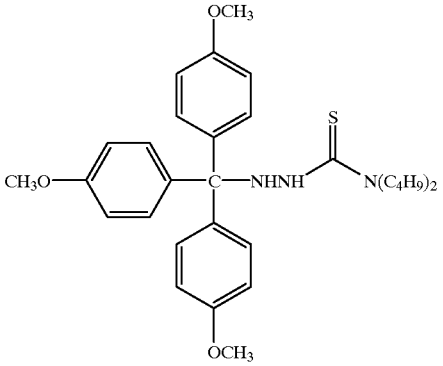
122
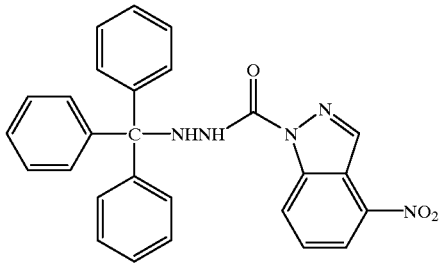

TABLE 27-continued
| | |
|---|---|
| 123 | 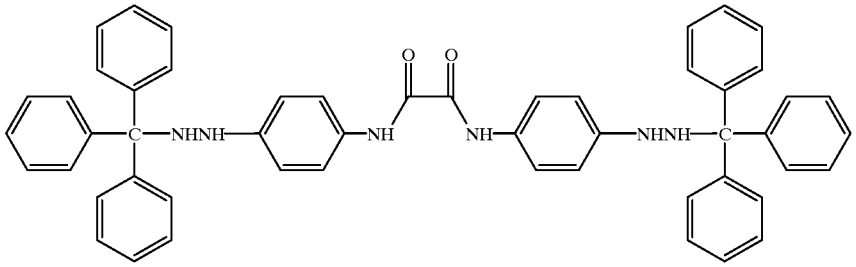 |
TABLE 28
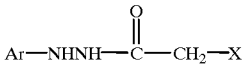
| | | X = | | | | | |
|---|---|---|---|---|---|---|---|
| | Ar = | —OH | —SH | —NHCOCF$_3$ | —NHSO$_2$CH$_3$ | —NHSO$_2$ph | —N(CH$_3$)$_2$ |
| 124 | 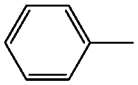 | 124a | 124b | 124c | 124d | 124e | 124f |
| 125 | 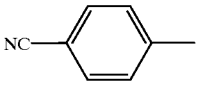 | 125a | 125b | 125c | 125d | 125e | 125f |
| 126 | 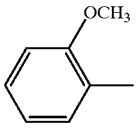 | 126a | 126b | 126c | 126d | 126e | 126f |
| 127 | 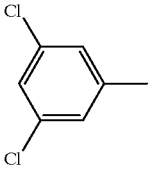 | 127a | 127b | 127c | 127d | 127e | 127f |
| 128 | 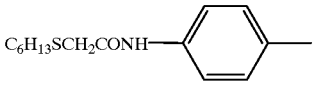 | 128a | 128b | 128c | 128d | 128e | 128f |
| 129 | 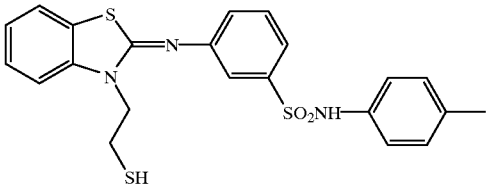 | 129a | 129b | 129c | 129d | 129e | 129f |
| 130 | 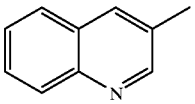 | 130a | 130b | 130c | 130d | 130e | 130f |

TABLE 28-continued
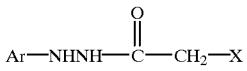
| | Ar = | X = —OH | —SH | —NHCOCF$_3$ | —NHSO$_2$CH$_3$ | —NHSO$_2$ph | —N(CH$_3$)$_2$ |
|---|---|---|---|---|---|---|---|
| 131 | 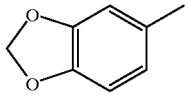 | 131a | 131b | 131c | 131d | 131e | 131f |
| 132 | 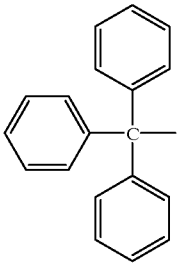 | 132a | 132b | 132c | 132d | 132e | 132f |
| 133 | 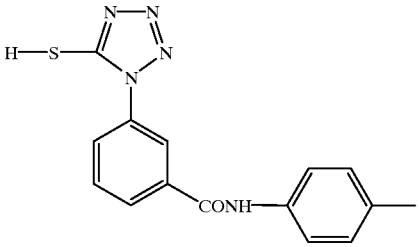 | 133a | 133b | 133c | 133d | 133e | 133f |
| 134 | 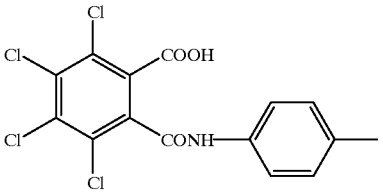 | 134a | 134b | 134c | 134d | 134e | 134f |
TABLE 29
135
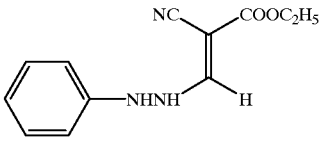
136
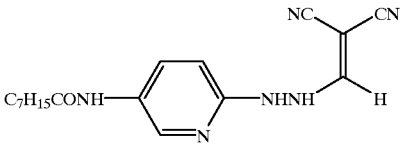
TABLE 29-continued
137
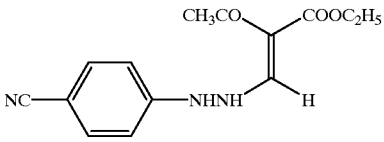
138
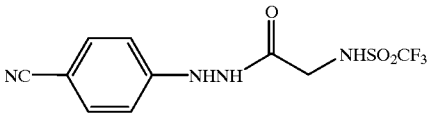

TABLE 29-continued

| | |
|---|---|
| 139 | 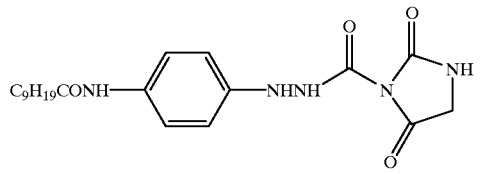 |
| 140 | 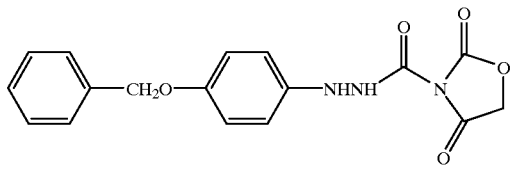 |

The hydrazine derivatives of formula (H) may be used alone or in admixture of two or more.

In addition to the above-described ones, the following hydrazine derivatives are also preferable for use in the practice of the invention. If desired, any of the following hydrazine derivatives may be used in combination with the hydrazine derivatives of formula (H). The hydrazine derivatives which are used herein can be synthesized by various methods as described in the following patents.

Exemplary hydrazine derivatives which can be used herein include the compounds of the chemical formula [1] in JP-B 77138/1994, more specifically the compounds described on pages 3 and 4 of the same; the compounds of the general formula (I) in JP-B 93082/1994, more specifically compound Nos. 1 to 38 described on pages 8 to 18 of the same; the compounds of the general formulae (4), (5) and (6) in JP-A 230497/1994, more specifically compounds 4-1 to 4-10 described on pages 25 and 26, compounds 5-1 to 5-42 described on pages 28 to 36, and compounds 6-1 to 6-7 described on pages 39 and 40 of the same; the compounds of the general formulae (1) and (2) in JP-A 289520/1994, more specifically compounds 1-1 to 1-17 and 2-1 described on pages 5 to 7 of the same; the compounds of the chemical formulae [2] and [3] in JP-A 313936/1994, more specifically the compounds described on pages 6 to 19 of the same; the compounds of the chemical formula [1] in JP-A 313951/1994, more specifically the compounds described on pages 3 to 5 of the same; the compounds of the general formula (I) in JP-A 5610/1995, more specifically compounds I-1 to I-38 described on pages 5 to 10 of the same; the compounds of the general formula (II) in JP-A 77783/1995, more specifically compounds II-1 to II-102 described on pages 10 to 27 of the same; the compounds of the general formulae (H) and (Ha) in JP-A 104426/1995, more specifically compounds H-1 to H-44 described on pages 8 to 15 of the same; the compounds having an anionic group in proximity to a hydrazine group or a nonionic group capable of forming an intramolecular hydrogen bond with the hydrogen atom of hydrazine described in EP 713131A, especially compounds of the general formulae (A), (B), (C), (D), (E), and (F), more specifically compounds N-1 to N-30 described therein; and the compounds of the general formula (H) in EP 713131A, more specifically compounds D-1 to D-55 described therein.

Also useful are the hydrazine derivatives described in "Known Technology," Aztech K.K., Mar. 22, 1991, pages 25–34 and Compounds D-2 and D-39 described in JP-A 86354/1987, pages 6–7.

In the practice of the invention, the hydrazine nucleating agents are used as solution in water or suitable organic solvents. Suitable solvents include alcohols (e.g., methanol, ethanol, propanol, and fluorinated alcohols), ketones (e.g., acetone and methyl ethyl ketone), dimethylformamide, dimethylsulfoxide and methyl cellosolve.

A well-known emulsifying dispersion method may be used for dissolving the hydrazine derivative with the aid of an oil such as dibutyl phthalate, tricresyl phosphate, glyceryl triacetate or diethyl phthalate or an auxiliary solvent such as ethyl acetate or cyclohexanone whereby an emulsified dispersion is mechanically prepared. Alternatively, a method known as a solid dispersion method is used for dispersing the hydrazine derivative in powder form in a suitable solvent, typically water, in a ball mill, colloidal mill or ultrasonic mixer.

The hydrazine nucleating agent may be added to an image forming layer or any other layer on the image forming layer side of a support, and preferably to the image forming layer or a layer disposed contiguous thereto.

The nucleating agent is preferably used in an amount of $1\times10^{-6}$ mol to 1 mol, more preferably $1\times10^{-5}$ mol to $5\times10^{-1}$ mol, and most preferably $2\times10^{5}$ mol to $2\times10^{-1}$ mol per mol of silver halide.

Oragnic Silver Salt

The organic silver salt which can be used herein is relatively stable to light, but forms a silver image when heated at 80° C. or higher in the presence of an exposed photocatalyst (as typified by a latent image of photosensitive silver halide) and a reducing agent. The organic silver salt may be of any desired organic compound containing a source capable of reducing silver ion. Preferred are silver salts of organic acids, typically long chain aliphatic carboxylic acids having 10 to 30 carbon atoms, especially 15 to 28 carbon atoms. Also preferred are complexes of organic or inorganic silver salts with ligands having a stability constant in the range of 4.0 to 10.0. A silver-providing substance is preferably used in an amount of about 5 to 70% by weight of the image forming layer. Preferred organic silver salts include silver salts of organic compounds having a carboxyl group. Examples include silver salts of aliphatic carboxylic acids and silver salts of aromatic carboxylic acids though not limited thereto. Preferred examples of the silver salt of aliphatic carboxylic acid include silver behenate, silver arachidate, silver stearate, silver oleate, silver laurate, silver caproate, silver myristate, silver palmitate, silver maleate, silver fumarate, silver tartrate, silver linolate, silver butyrate, silver camphorate and mixtures thereof.

Silver salts of compounds having a mercapto or thion group and derivatives thereof are also useful. Preferred examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-(ethylglycolamido)-benzothiazole, silver salts of thioglycolic acids such as silver salts of S-alkylthioglycolic acids wherein the alkyl group has 12 to 22 carbon atoms, silver salts of dithio-carboxylic acids such as a silver salt of dithioacetic acid, silver salts of thioamides, a silver salt of 5-carboxyl-1-methyl-2-phenyl-4-thiopyridine, silver salts of mercapto-triazines, a silver salt of 2-mercaptobenzoxazole as well as silver salts of 1,2,4-mercaptothiazole derivatives such as a silver salt of 3-amino-5-benzylthio-1,2,4-thiazole as described in U.S. Pat. No. 4,123,274 and silver salts of thion compounds such as a silver salt of 3-(3-carboxyethyl)-4-methyl-4-thiazoline-2-thione as described in U.S. Pat. No. 3,301,678. Compounds containing an imino group may also be used. Preferred examples of these compounds include silver salts of benzotriazole and derivatives thereof, for example, silver salts of benzotriazoles such as silver methyl-benzotriazole, silver salts of halogenated benzotriazoles such as silver 5-chlorobenzotriazole as well as silver salts of 1,2,4-triazole and 1-H-tetrazole and silver salts of imidazole and imidazole derivatives as described in U.S. Pat. No. 4,220,709. Also useful are various silver acetylide compounds as described, for example, in U.S. Pat. Nos. 4,761,361 and 4,775,613.

The organic silver salt which can be used herein may take any desired shape although needle crystals having a minor axis and a major axis are preferred. In the practice of the invention, grains should preferably have a minor axis of 0.01 $\mu$m to 0.20 $\mu$m and a major axis of 0.10 $\mu$m to 5.0 $\mu$m, more preferably a minor axis of 0.01 $\mu$m to 0.15 $\mu$m and a major axis of 0.10 $\mu$m to 4.0 $\mu$m. The grain size distribution is desirably monodisperse. The monodisperse distribution means that a standard deviation of the length of minor and major axes divided by the length, respectively, expressed in percent, is preferably up to 100%, more preferably up to 80%, most preferably up to 50%. It can be determined from the measurement of the shape of organic silver salt grains using an image obtained through a transmission electron microscope. Another method for determining a monodisperse distribution is to determine a standard deviation of a volume weighed mean diameter. The standard deviation divided by the volume weighed mean diameter, expressed in percent, which is a coefficient of variation, is preferably up to 100%, more preferably up to 80%, most preferably up to 50%. It may be determined by irradiating laser light, for example, to organic silver salt grains dispersed in liquid and determining the auto-correlation function of the fluctuation of scattering light relative to a time change, and obtaining the grain size (volume weighed mean diameter) therefrom.

The organic silver salt used herein is preferably desalted. The desalting method is not critical. Any well-known method may be used although well-known filtration methods such as centrifugation, suction filtration, ultrafiltration, and flocculation/water washing are preferred.

In the practice of the invention, the organic silver salt is prepared into a solid microparticulate dispersion using a dispersant, in order to provide fine particles of small size and free of flocculation. A solid micro-particulate dispersion of the organic silver salt may be prepared by mechanically dispersing the salt in the presence of dispersing aids by well-known comminuting means such as ball mills, vibrating ball mills, planetary ball mills, sand mills, colloidal mills, jet mills, and roller mills.

The dispersant used in the preparation of a solid microparticulate dispersion of the organic silver salt may be selected from synthetic anionic polymers such as polyacrylic acid, copolymers of acrylic acid, copolymers of maleic acid, copolymers of maleic acid monoester, and copolymers of acryloylmethylpropanesulfonic acid; semi-synthetic anionic polymers such as carboxymethyl starch and carboxymethyl cellulose; anionic polymers such as alginic acid and pectic acid; anionic surfactants as described in JP-A 92716/1977 and WO 88/04794; the compounds described in Japanese Patent Application No. 350753/1995; well-known anionic, nonionic and cationic surfactants; and well-known polymers such as polyvinyl alcohol, polyvinyl pyrrolidone, carboxymethyl cellulose, hydroxypropyl cellulose, and hydroxypropyl methyl cellulose, as well as naturally occurring high molecular weight compounds such as gelatin.

In general, the dispersant is mixed with the organic silver salt in powder or wet cake form prior to dispersion. The resulting slurry is fed into a dispersing machine. Alternatively, a mixture of the dispersant with the organic silver salt is subject to heat treatment or solvent treatment to form a dispersant-bearing powder or wet cake of the organic silver salt. It is acceptable to effect pH control with a suitable pH adjusting agent before, during or after dispersion.

Rather than mechanical dispersion, fine particles can be formed by roughly dispersing the organic silver salt in a solvent through pH control and thereafter, changing the pH in the presence of dispersing aids. An organic solvent can be used as the solvent for rough dispersion although the organic solvent is usually removed at the end of formation of fine particles.

The thus prepared dispersion may be stored while continuously stirring for the purpose of preventing fine particles from settling during storage. Alternatively, the dispersion is stored after adding hydrophilic colloid to establish a highly viscous state (for example, in a jelly-like state using gelatin). An antiseptic agent may be added to the dispersion in order to prevent the growth of bacteria during storage.

The organic silver salt is used in any desired amount, preferably about 0.1 to 5 g/m$^2$, more preferably about 1 to 3 g/m$^2$, as expressed by a silver coverage per square meter of the thermographic recording element.

Silver Halide

When it is desired to use the thermographic recording element of the invention as a photothermographic recording element, a photosensitive silver halide can be used.

A method for forming the photosensitive silver halide is well known in the art. Any of the methods disclosed in Research Disclosure No. 17029 (June 1978) and U.S. Pat. No. 3,700,458, for example, may be used. Illustrative methods which can be used herein are a method of preparing an organic silver salt and adding a halogen-containing compound to the organic silver salt to convert a part of silver of the organic silver salt into photosensitive silver halide and a method of adding a silver-providing compound and a halogen-providing compound to a solution of gelatin or another polymer to form photosensitive silver halide grains and mixing the grains with an organic silver salt. The latter method is preferred in the practice of the invention.

The photosensitive silver halide should preferably have a smaller mean grain size for the purpose of minimizing white turbidity after image formation. Specifically, the grain size is preferably up to 0.20 $\mu$m, more preferably 0.01 $\mu$m to 0.16 $\mu$m, most preferably 0.02 $\mu$m to 0.14 $\mu$m. The term grain size designates the length of an edge of a silver halide grain where silver halide grains are regular grains of cubic or octahedral shape. Where silver halide grains are tabular, the grain size is the diameter of an equivalent circle having the same area as the projected area of a major surface of a tabular grain. Where silver halide grains are not regular, for example, in the case of spherical or rod-shaped grains, the grain size is the diameter of an equivalent sphere having the same volume as a grain.

The shape of silver halide grains may be cubic, octahedral, tabular, spherical, rod-like and potato-like, with cubic and tabular grains being preferred in the practice of the invention. Where tabular silver halide grains are used, they should preferably have an average aspect ratio of from 100:1 to 2:1, more preferably from 50:1 to 3:1. Silver halide grains having rounded corners are also preferably used. No particular limit is imposed on the face indices (Miller indices) of an outer surface of photo-sensitive silver halide grains. Preferably silver halide grains have a high proportion of {100} face featuring high spectral sensitization efficiency upon adsorption of a spectral sensitizing dye. The proportion of {100} face is preferably at least 50%, more preferably at least 65%, most preferably at least 80%. Note that the proportion of Miller index {100} face can be determined by the method described in T. Tani, J. Imaging Sci., 29, 165 (1985), utilizing the adsorption dependency of {lll} face and {100} face upon adsorption of a sensitizing dye.

The halogen composition of photosensitive silver halide is not critical and may be any of silver chloride, silver chlorobromide, silver bromide, silver iodobromide, silver iodochlorobromide, and silver iodide. The halogen composition in grains may have a uniform distribution or a non-uniform distribution wherein the halogen concentration changes in a stepped or continuous manner. Preferred are silver iodobromide grains having a higher silver iodide content in the interior. Silver halide grains of the core/shell structure are also useful. Such core/shell grains preferably have a multilayer structure of 2 to 5 layers, more preferably 2 to 4 layers.

Preferably the photosensitive silver halide grains used herein contain at least one complex of a metal selected from the group consisting of rhodium, rhenium, ruthenium, osmium, iridium, cobalt, mercury, and iron. The metal complexes may be used alone or in admixture of two or more complexes of a common metal or different metals. The metal complex is preferably contained in an amount of 1 $\mu$mol to 10 mmol, more preferably 10 nmol to 100 $\mu$mol per mol of silver. Illustrative metal complex structures are those described in JP-A 225449/1995. The cobalt and iron compounds are preferably hexacyano metal complexes while illustrative, non-limiting examples include ferricyanate, ferrocyanate, and hexacyanocobaltate ions. The distribution of the metal complex in silver halide grains is not critical. That is, the metal complex may be contained in silver halide grains to form a uniform phase or at a high concentration in either the core or the shell.

Photosensitive silver halide grains may be desalted by any of well-known water washing methods such as noodle and flocculation methods although silver halide grains may be either desalted or not according to the invention.

The photosensitive silver halide grains used herein should preferably be chemically sensitized. Preferred chemical sensitization methods are sulfur, selenium, and tellurium sensitization methods which are well known in the art. Also useful are a noble metal sensitization method using compounds of gold, platinum, palladium, and iridium and a reduction sensitization method. In the sulfur, selenium, and tellurium sensitization methods, any of compounds well known for the purpose may be used. For example, the compounds described in JP-A 128768/1995 are useful. Exemplary tellurium sensitizing agents include diacyltellurides, bis(oxycarbonyl)tellurides, bis-(carbamoyl) tellurides, bis(oxycarbonyl)ditellurides, bis(carbamoyl) ditellurides, compounds having a P=Te bond, tellurocarboxylic salts, Te-organyltellurocarboxylic esters, di(poly) tellurides, tellurides, telluroles, telluroacetals, tellurosulfonates, compounds having a P-Te bond, Te-containing heterocycles, tellurocarbonyl compounds, inorganic tellurium compounds, and colloidal tellurium. The preferred compounds used in the noble metal sensitization method include chloroauric acid, potassium chloroaurate, potassium aurithiocyanate, gold sulfide, and gold selenide as well as the compounds described in U.S. Pat. No. 2,448,060 and BP 618,061. Illustrative examples of the compound used in the reduction sensitization method include ascorbic acid, thiourea dioxide, stannous chloride, aminoiminomethanesulfinic acid, hydrazine derivatives, borane compounds, silane compounds, and polyamine compounds. Reduction sensitization may also be accomplished by ripening the emulsion while maintaining it at pH 7 or higher or at pAg 8.3 or lower. Reduction sensitization may also be accomplished by introducing a single addition portion of silver ion during grain formation.

According to the invention, the photosensitive silver halide is preferably used in an amount of 0.01 to 0.5 mol, more preferably 0.02 to 0.3 mol, most preferably 0.03 to 0.25 mol per mol of the organic silver salt. With respect to a method and conditions of admixing the separately prepared photosensitive silver halide and organic silver salt, there may be used a method of admixing the separately prepared photosensitive silver halide and organic silver salt in a high speed agitator, ball mill, sand mill, colloidal mill, vibrating mill or homogenizer or a method of preparing an organic silver salt by adding the already prepared photosensitive silver halide at any timing during preparation of an organic silver salt. Any desired mixing method may be used insofar as the benefits of the invention are fully achievable.

One of the preferred methods for preparing the silver halide according to the invention is a so-called halidation method of partially halogenating the silver of an organic silver salt with an organic or inorganic halide. Any of organic halides which can react with organic silver salts to form silver halides may be used. Exemplary organic halides are N-halogenoimides (e.g., N-bromosuccinimide), halogenated quaternary nitrogen compounds (e.g., tetrabutylammonium bromide), and aggregates of a halogenated quaternary nitrogen salt and a molecular halogen (e.g., pyridinium bromide perbromide). Any of inorganic halides which can react with organic silver salts to form silver halides may be used. Exemplary inorganic halides are alkali metal and ammonium halides (e.g., sodium chloride, lithium bromide, potassium iodide, and ammonium bromide), alkaline earth metal halides (e.g., calcium bromide and magnesium chloride), transition metal halides (e.g., ferric chloride and cupric bromide), metal complexes having a halogen ligand (e.g., sodium iridate bromide and ammonium rhodate chloride), and molecular halogens (e.g., bromine, chlorine and iodine). A mixture of organic and inorganic halides may also be used.

The amount of the halide added for the halidation purpose is preferably 1 mmol to 500 mmol, especially 10 mmol to 250 mmol of halogen atom per mol of the organic silver salt.

Reducing Agent

The thermographic recording element of the invention contains a reducing agent for the organic silver salt. The reducing agent for the organic silver salt may be any of substances, preferably organic substances, that reduce silver ion into metallic silver. Conventional photographic developing agents such as Phenidone®, hydroquinone and catechol are useful although hindered phenols are preferred reducing agents. The reducing agent should preferably be contained in an amount of 5 to 50 mol%, more preferably 10 to 40 mol % per mol of silver on the image forming layer-bearing side. The reducing agent may be added to any layer on the image forming layer-bearing side. Where the reducing agent is added to a layer other than the image forming layer, the reducing agent should preferably be contained in a slightly greater amount of about 10 to 50 mol % per mol of silver. The reducing agent may take the form of a precursor which is modified so as to exert its effective function only at the time of development.

For thermographic recording elements using organic silver salts, a wide range of reducing agents are disclosed, for example, in JP-A 6074/1971, 1238/1972, 33621/1972, 46427/1974, 115540/1974, 14334/1975, 36110/1975, 147711/1975, 32632/1976, 1023721/1976, 32324/1976, 51933/1976, 84727/1977, 108654/1980, 146133/1981, 82828/1982, 82829/1982, 3793/1994, U.S. Pat. No. 3,667, 958, 3,679,426, 3,751,252, 3,751,255, 3,761,270, 3,782,949, 3,839,048, 3,928,686, 5,464,738, German Patent No. 2321328, and EP 692732. Exemplary reducing agents include amidoximes such as phenylamidoxime, 2-thienylamidoxime, and p-phenoxyphenyl-amidoxime; azines such as 4-hydroxy-3,5-dimethoxy-benzaldehydeazine; combinations of aliphatic carboxylic acid arylhydrazides with ascorbic acid such as a combination of 2,2-bis(hydroxymethyl)propionyl-β-phenylhydrazine with ascorbic acid; combinations of polyhydroxybenzenes with hydroxylamine, reductone and/or hydrazine, such as combinations of hydroquinone with bis(ethoxyethyl)hydroxyl-amine, piperidinohexosereductone or formyl-4-methylphenyl-hydrazine; hydroxamic acids such as phenylhydroxamic acid, p-hydroxyphenylhydroxamic acid, and β-anilinehydroxamic acid; combinations of azines with sulfonamidophenols such as a combination of phenothiazine with 2,6-dichloro-4-benzene-sulfonamidephenol; α-cyanophenyl acetic acid derivatives such as ethyl-α-cyano-2-methylphenyl acetate and ethyl-α-cyanophenyl acetate; bis-β-naphthols such as 2,2'-dihydroxy-1,1'-binaphthyl, 6,6'-dibromo-2,2'-dihydroxy-1,1'-binaphthyl, and bis(2-hydroxy-1-naphthyl) methane; combinations of bis-β-naphthols with 1,3-dihydroxybenzene derivatives such as 2,4-dihydroxybenzophenone and 2',4'-dihydroxyacetophenone; 5-pyrazolones such as 3-methyl-1-phenyl-5-pyrazolone; reductones such as dimethylaminohexose-reductone, anhydrodihydroaminohexosereductone and anhydrodihydropiperidonehexosereductone; sulfonamidephenol reducing agents such as 2,6-dichloro-4-benzenesulfonamidephenol and p-benzenesulfonamidephenol; 2-phenylindane-1,3-dione, etc.; chromans such as 2,2-dimethyl-7-t-butyl-6-hydroxychroman; 1,4-dihydropyridines such as 2,6-dimethoxy-3,5-dicarbo-ethoxy-1,4-dihydropyridine; bisphenols such as bis(2-hydroxy-3-t-butyl-5-methylphenyl)methane, 2,2-bis(4-hydroxy-3-methylphenyl) propane, 4,4-ethylidene-bis(2-t-butyl-6-methylphenol), 1,1-bis(2-hydroxy-3,5-dimethylphenyl)-3,5,5-trimethylhexane, and 2,2-bis(3,5-dimethyl-4-hydroxyphenyl)-propane; ascorbic acid derivatives such as 1-ascorbyl palmitate and ascorbyl stearate; aldehydes and ketones such as benzil and diacetyl; 3-pyrazolidones and certain indane-1,3-diones; and chromanols (tocopherols). Preferred reducing agents are bisphenols and chromanols.

The reducing agent may be added in any desired form such as solution, powder or solid particle dispersion. The solid particle dispersion of the reducing agent may be prepared by well-known comminuting means such as ball mills, vibrating ball mills, sand mills, colloidal mills, jet mills, and roller mills. Dispersing aids may be used for facilitating dispersion.

Toner

A higher optical density is sometimes achieved when an additive known as a "toner" for improving images is contained. The toner is also sometimes advantageous in forming black silver images. The toner is preferably used in an amount of 0.1 to 50 mol %, especially 0.5 to 20 mol % per mol of silver on the image forming layer-bearing side. The toner may take the form of a precursor which is modified so as to exert its effective function only at the time of development.

For thermographic recording elements using organic silver salts, a wide range of toners are disclosed, for example, in JP-A 6077/1971, 10282/1972, 5019/1974, 5020/1974, 91215/1974, 2524/1975, 32927/1975, 67132/1975, 67641/1975, 114217/1975, 3223/1976, 27923/1976, 14788/1977, 99813/1977, 1020/1978, 76020/1978, 156524/1979, 156525/1979, 183642/1986, and 56848/1992, JP-B 10727/1974 and 20333/1979, U.S. Pat. Nos. 3,080,254, 3,446,648, 3,782,941, 4,123,282, 4,510,236, BP 1,380,795, and Belgian Patent No. 841,910. Examples of the toner include phthalimide and N-hydroxyphthalimide; cyclic imides such as succinimide, pyrazolin-5-one, quinazolinone, 3-phenyl-2-pyrazolin-5-one, 1-phenylurazol, quinazoline and 2,4-thiazolidinedione; naphthalimides such as N-hydroxy-1,8-naphthalimide; cobalt complexes such as cobaltic hexamine trifluoroacetate; mercaptans as exemplified by 3-mercapto-1,2,4-triazole, 2,4-dimercapto-pyrimidine, 3-mercapto-4,5-diphenyl-1,2,4-triazole, and 2,5-dimercapto-1,3,4-thiadiazole; N-(aminomethyl)aryldicarboxy-imides such as (N,N-dimethylaminomethyl)phthalimide and N,N-(dimethylaminomethyl)-naphthalene-2,3-dicarboxyimide; blocked pyrazoles, isothiuronium derivatives and certain photo-bleach agents such as N,N'-hexamethylenebis(1-carbamoyl-3,5-dimethylpyrazole), 1,8-(3,6-diazaoctane))-bis(isothiuroniumtrifluoroacetate) and 2-tribromomethyl-sulfonyl-benzothiazole; 3-ethyl-5-{(3-ethyl-2-benzo-thiazolinylidene)-1-methylethylidene}-2-thio-2,4-oxazolidinedione; phthalazinone, phthalazinone derivatives or metal salts, or derivatives such as 4-(1-naphthyl)-phthalazinone, 6-chlorophthalazinone, 5,7-dimethoxy-phthalazinone and 2,3-dihydro-1,4-phthalazinedione; combinations of phthalazinones with phthalic acid derivatives (e.g., phthalic acid, 4-methylphthalic acid, 4-nitrophthalic acid and tetrachlorophthalic anhydride); phthalazine, phthalazine derivatives or metal salts such as 4-(l-naphthyl) phthalazine, 6-chlorophthalazine, 5,7-dimethoxyphthalazine and 2,3-dihydrophthalazine; combinations of phthalazine with phthalic acid derivatives (e.g., phthalic acid, 4-methylphthalic acid, 4-nitrophthalic acid and tetrachlorophthalic anhydride); quinazolinedione, benzoxazine or naphthoxazine derivatives; rhodium complexes which function not only as a tone regulating agent, but also as a source of halide ion for generating silver halide in situ, for example, ammonium hexachlororhodinate (III), rhodium bromide, rhodium nitrate and potassium hexachlororhodinate (III); inorganic peroxides and persulfates such as ammonium peroxide disulfide and hydrogen peroxide; benzoxazine-2,4-diones such as 1,3-benzoxazine-2,4-dione, 8-methyl-1,3-benzoxazine-2,4-dione, and 6-nitro-1,3-benzoxazine-2,4-dione; pyrimidine and asym-triazines such as 2,4-dihydroxypyrimidine and 2-hydroxy-4-aminopyrimidine; azauracil and tetraazapentalene derivatives such as 3,6-dimercapto-1,4-diphenyl-1H,4H-2,3a,5,6a-tetraazapentalene, and 1,4-di(o-chlorophenyl)-3,6-dimercapto-1H,4H-2,3a,5,6a -tetraazapentalene.

The toner may be added in any desired form, for example, as a solution, powder and solid particle dispersion. The solid particle dispersion of the toner is prepared by well-known finely dividing means such as ball mills, vibrating ball mills, sand mills, colloid mills, jet mills, and roller mills. Dispersing aids may be used in preparing the solid particle dispersion.

Binder

The image forming layer used herein is usually based on a binder. Exemplary binders are naturally occurring polymers and synthetic resins, for example, gelatin, polyvinyl acetal, polyvinyl chloride, polyvinyl acetate, cellulose acetate, polyolefins, polyesters, polystyrene, polyacrylonitrile, and polycarbonate. Of course, copolymers and terpolymers are included. Preferred polymers are polyvinyl butyral, butylethyl cellulose, methacrylate copolymers, maleic anhydride ester copolymers, polystyrene and butadiene-styrene copolymers. These polymers may be used alone or in admixture of two or more as desired. The polymer is used in such a range that it may effectively function as a binder to carry various components. The effective range may be properly determined by those skilled in the art without undue experimentation. Taken at least as a measure for carrying the organic silver salt in the film, the weight ratio of the binder to the organic silver salt is preferably in the range of from 15:1 to 1:2, more preferably from 8:1 to 1:1.

At least one layer of the image-forming layers used herein may be an image forming layer wherein a polymer latex constitutes more than 50% by weight of the entire binder. This image forming layer is sometimes referred to as "inventive image-forming layer" and the polymer latex used as the binder therefor is referred to as "inventive polymer latex," hereinafter. The term "polymer latex" used herein is a dispersion of a microparticulate water-insoluble hydrophobic polymer in a water-soluble dispersing medium. With respect to the dispersed state, a polymer emulsified in a dispersing medium, an emulsion polymerized polymer, a micelle dispersion, and a polymer having a hydrophilic structure in a part of its molecule so that the molecular chain itself is dispersed on a molecular basis are included. With respect to the polymer latex, reference is made to Okuda and Inagaki Ed., "Synthetic Resin Emulsion," Kobunshi Kankokai, 1978; Sugimura, Kataoka, Suzuki and Kasahara Ed., "Application of Synthetic Latex," Kobunshi Kankokai, 1993; and Muroi, "Chemistry of Synthetic Latex," Kobunshi Kankokai, 1970. Dispersed particles should preferably have a mean particle size of about 1 to 50,000 nm, more preferably about 5 to 1,000 nm. No particular limit is imposed on the particle size distribution of dispersed particles, and the dispersion may have either a wide particle size distribution or a monodisperse particle size distribution.

The inventive polymer latex used herein may be either a latex of the conventional uniform structure or a latex of the so-called core/shell type. In the latter case, better results are sometimes obtained when the core and the shell have different glass transition temperatures.

The inventive polymer latex should preferably have a minimum film-forming temperature (MFT) of about −30° C. to 90° C., more preferably about 0° C. to 70° C. A film-forming aid may be added in order to control the minimum film-forming temperature. The film-forming aid is also referred to as a plasticizer and includes organic compounds (typically organic solvents) for lowering the minimum film-forming temperature of a polymer latex. It is described in Muroi, "Chemistry of Synthetic Latex," Kobunshi Kankokai, 1970.

Polymers used in the inventive polymer latex include acrylic resins, vinyl acetate resins, polyester resins, polyurethane resins, rubbery resins, vinyl chloride resins, vinylidene chloride resins, polyolefin resins, and copolymers thereof. The polymer may be linear or branched or crosslinked. The polymer may be either a homopolymer or a copolymer having two or more monomers polymerized together. The copolymer may be either a random copolymer or a block copolymer. The polymer preferably has a number average molecule weight Mn of about 5,000 to about 1,000,000, more preferably about 10,000 to about 100,000. Polymers with a too lower molecular weight would generally provide a low film strength after coating whereas polymers with a too higher molecular weight are difficult to form films.

The polymer of the inventive polymer latex should preferably have an equilibrium moisture content at 25° C. and RH 60% of up to 2% by weight, more preferably up to 1% by weight. The lower limit of equilibrium moisture content is not critical although it is preferably 0.01% by weight, more preferably 0.03% by weight. With respect to the definition and measurement of equilibrium moisture content, reference should be made to "Polymer Engineering Series No. 14, Polymer Material Test Methods," Edited by Japanese Polymer Society, Chijin Shokan Publishing K.K., for example.

Illustrative examples of the polymer latex which can be used as the binder in the image-forming layer of the thermographic recording element of the invention include latexes of methyl methacrylate/ethyl acrylate/methacrylic acid copolymers, latexes of methyl methacrylate/2-ethylhexyl acrylate/styrene/acrylic acid copolymers, latexes of styrene/butadiene/acrylic acid copolymers, latexes of styrene/butadiene/divinyl benzene/methacrylic acid copolymers, latexes of methyl methacrylate/vinyl chloride/acrylic acid copolymers, and latexes of vinylidene chloride/ethyl acrylate/acrylonitrile/methacrylic acid copolymers. These polymers or polymer latexes are commercially available. Exemplary acrylic resins are Sebian A-4635, 46583 and 4601 (Daicell Chemical Industry K.K.) and Nipol LX811, 814, 820, 821 and 857 (Nippon Zeon K.K.). Exemplary polyester resins are FINETEX ES650, 611, 675, and 850 (Dai-Nippon Ink & Chemicals K.K.) and WD-size and WMS (Eastman Chemical Products, Inc.). Exemplary polyurethane resins are HYDRAN AP10, 20, 30 and 40 (Dai-Nippon Ink & Chemicals K.K.). Exemplary rubbery resins are LACSTAR 7310K, 3307B, 4700H and 7132C (Dai-Nippon Ink & Chemicals K.K.) and Nipol LX416, 410, 438C and 2507 (Nippon Zeon K.K.). Exemplary vinyl chloride resins are G351 and G576 (Nippon Zeon K.K.). Exemplary vinylidene chloride resins are L502 and L513 (Asahi Chemicals K.K.). Exemplary olefin resins are Chemipearl S120 and SA100 (Mitsui Petro-Chemical K.K.). These polymers may be used alone or in admixture of two or more.

In the inventive image-forming layer, the polymer latex described above is preferably used in an amount of at least 50% by weight, especially at least 70% by weight, of the entire binder. In the inventive image-forming layer, a hydrophilic polymer may be added in an amount of less than 50% by weight of the entire binder. Such hydrophilic polymers are gelatin, polyvinyl alcohol, methyl cellulose, hydroxypropyl cellulose, carboxymethyl cellulose, and hydroxypropyl methyl cellulose. The amount of the hydrophilic polymer added is preferably less than 30% by weight of the entire binder in the image-forming layer.

The inventive image-forming layer is preferably formed by applying an aqueous coating solution followed by drying. By the term "aqueous", it is meant that water accounts for at least 30% by weight of the solvent or dispersing medium of the coating solution. The component other than water of the coating solution may be a water-miscible organic solvent such as methyl alcohol, ethyl alcohol, isopropyl alcohol, methyl cellosolve, ethyl cellosolve, dimethylformamide or ethyl acetate. Exemplary solvent compositions include a 90/10 mixture of water/methanol, a 70/30 mixture of water/methanol, a 90/10 mixture of water/ethanol, a 90/10 mixture of water/isopropanol, a 95/5 mixture of water/dimethylformamide, a 80/15/5 mixture of water/methanol/dimethylformamide, and a 90/5/5 mixture of water/methanol/dimethylformamide, all expressed in a weight ratio.

The method described in U.S. Pat. No. 5,496,695 is also useful.

In the inventive image-forming layer, the total amount of binder is preferably 0.2 to 30 g/m$^2$, more preferably 1 to 15 g/m$^2$. To the image forming layer, crosslinking agents for crosslinking, surfactants for ease of application, and other addenda may be added.

Sensitizing Dye

A sensitizing dye may be used in the practice of the invention. There may be used any of sensitizing dyes which can spectrally sensitize silver halide grains in a desired wavelength region when adsorbed to the silver halide grains. The sensitizing dyes used herein include cyanine dyes, merocyanine dyes, complex cyanine dyes, complex merocyanine dyes, holopolar cyanine dyes, styryl dyes, hemicyanine dyes, oxonol dyes, and hemioxonol dyes. Useful sensitizing dyes which can be used herein are described in *Research Disclosure*, Item 17643 IV-A (December 1978, page 23), ibid., Item 1831 X (August 1979, page 437) and the references cited therein. It is advantageous to select a sensitizing dye having appropriate spectral sensitivity to the spectral properties of a particular light source of various laser imagers, scanners, image setters and process cameras.

Exemplary dyes for spectral sensitization to red light include compounds I-1 to I-38 described in JP-A 18726/1979, compounds I-1 to I-35 described in JP-A 75322/1994, compounds I-1 to I-34 described in JP-A 287338/1995, dyes 1 to 20 described in JP-B 39818/1980, compounds I-1 to I-37 described in JP-A 284343/1987, and compounds I-1 to I-34 described in JP-A 287338/1995 for red light sources such as He-Ne lasers, red semiconductor lasers and LED.

For semiconductor laser light sources in the wavelength range of 750 to 1,400 nm, spectral sensitization may be advantageously done with various known dyes including cyanine, merocyanine, styryl, hemicyanine, oxonol, hemioxonol, and xanthene dyes. Useful cyanine dyes are cyanine dyes having a basic nucleus such as a thiazoline, oxazoline, pyrroline, pyridine, oxazole, thiazole, selenazole and imidazole nucleus. Preferred examples of the useful merocyanine dye contain an acidic nucleus such as a thiohydantoin, rhodanine, oxazolidinedione, thiazolinedione, barbituric acid, thiazolinone, malononitrile, and pyrazolone nucleus in addition to the above-mentioned basic nucleus. Among the above-mentioned cyanine and merocyanine dyes, those having an imino or carboxyl group are especially effective. A suitable choice may be made of well-known dyes as described, for example, in U.S. Pat. Nos. 3,761,279, 3,719,495, and 3,877,943, BP 1,466,201, 1,469,117, and 1,422,057, JP-B 10391/1991 and 52387/1994, JP-A 341432/1993, 194781/1994, and 301141/1994.

Especially preferred dye structures are cyanine dyes having a thioether bond-containing substituent group, examples of which are the cyanine dyes described in JP-A 58239/1987, 138638/1991, 138642/1991, 255840/1992, 72659/1993, 72661/1993, 222491/1994, 230506/1990, 258757/1994, 317868/1994, and 324425/1994, Publication of International Patent Application No. 500926/1995, and U.S. Pat. No. 5,541,054; dyes having a carboxylic group, examples of which are the dyes described in JP-A 163440/1991, 301141/1994 and U.S. Pat. No. 5,441,899; and merocyanine dyes, polynuclear merocyanine dyes, and polynuclear cyanine dyes, examples of which are the dyes described in JP-A 6329/1972, 105524/1974, 127719/1976, 80829/1977, 61517/1979, 214846/1984, 6750/1985, 159841/1988, 35109/1994, 59381/1994, 146537/1995, Publication of International Patent Application No. 50111/1993, BP 1,467,638, and U.S. Pat. No. 5,281,515.

Also useful in the practice of the invention are dyes capable of forming the J-band as disclosed in U.S. Pat. Nos. 5,510,236, 3,871,887 (Example 5), JP-A 96131/1990 and 48753/1984.

These sensitizing dyes may be used alone or in admixture of two or more. A combination of sensitizing dyes is often used for the purpose of supersensitization. In addition to the sensitizing dye, the emulsion may contain a dye which itself has no spectral sensitization function or a compound which does not substantially absorb visible light, but is capable of supersensitization. Useful sensitizing dyes, combinations of dyes showing supersensitization, and compounds showing supersensitization are described in *Research Disclosure*, Vol. 176, 17643 (December 1978), page 23, IV J and JP-B 25500/1974 and 4933/1968, JP-A 19032/1984 and 192242/1984.

The sensitizing dye may be added to a silver halide emulsion by directly dispersing the dye in the emulsion or by dissolving the dye in a solvent and adding the solution to the emulsion. The solvent used herein includes water, methanol, ethanol, propanol, acetone, methyl cellosolve, 2,2,3,3-tetrafluoropropanol, 2,2,2-trifluoroethanol, 3-methoxy-1-propanol, 3-methoxy-l-butanol, 1-methoxy-2-propanol, N,N-dimethylformamide and mixtures thereof.

Also useful are a method of dissolving a dye in a volatile organic solvent, dispersing the solution in water or hydrophilic colloid and adding the dispersion to an emulsion as disclosed in U.S. Pat. No. 3,469,987, a method of dissolving a dye in an acid and adding the solution to an emulsion or forming an aqueous solution of a dye with the aid of an acid or base and adding it to an emulsion as disclosed in JP-B 23389/1969, 27555/1969 and 22091/1982, a method of forming an aqueous solution or colloidal dispersion of a dye with the aid of a surfactant and adding it to an emulsion as disclosed in U.S. Pat. Nos. 3,822,135 and 4,006,025, a method of directly dispersing a dye in hydrophilic colloid and adding the dispersion to an emulsion as disclosed in JP-A 102733/1978 and 105141/1983, and a method of dissolving a dye using a compound capable of red shift and adding the solution to an emulsion as disclosed in JP-A 74624/1976. It is also acceptable to apply ultrasonic waves to form a solution.

The time when the sensitizing dye is added to the silver halide emulsion according to the invention is at any step of an emulsion preparing process which has been ascertained effective. The sensitizing dye may be added to the emulsion at any stage or step before the emulsion is coated, for example, at a stage prior to the silver halide grain forming step and/or desalting step, during the desalting step and/or a stage from desalting to the start of chemical ripening as disclosed in U.S. Pat. Nos. 2,735,766, 3,628,960, 4,183,756, and 4,225,666, JP-A 184142/1983 and 196749/1985, and a stage immediately before or during chemical ripening and a stage from chemical ripening to emulsion coating as disclosed in JP-A 113920/1983. Also as disclosed in U.S. Pat. No. 4,225,666 and JP-A 7629/1983, an identical compound may be added alone or in combination with a compound of different structure in divided portions, for example, in divided portions during a grain forming step and during a chemical ripening step or after the completion of chemical ripening, or before or during chemical ripening and after the completion thereof. The type of compound or the combination of compounds to be added in divided portions may be changed.

The amount of the sensitizing dye used may be an appropriate amount complying with sensitivity and fog although the preferred amount is about $10^{-6}$ to 1 mol, more preferably $10^{-4}$ to $10^{-1}$ mol per mol of the silver halide in the image forming layer.

Antifoagant

With antifoggants, stabilizers and stabilizer precursors, the silver halide emulsion and/or organic silver salt according to the invention can be further protected against formation of additional fog and stabilized against lowering of sensitivity during shelf storage. Suitable antifoggants, stabilizers and stabilizer precursors which can be used alone or in combination include thiazonium salts as described in U.S. Pat. Nos. 2,131,038 and 2,694,716, azaindenes as described in U.S. Pat. Nos. 2,886,437 and 2,444,605, mercury salts as described in U.S. Pat. No. 2,728,663, urazoles as described in U.S. Pat. No. 3,287,135, sulfocatechols as described in U.S. Pat. No. 3,235,652, oximes, nitrons and nitroindazoles as described in BP 623,448, polyvalent metal salts as described in U.S. Pat. No. 2,839,405, thiuronium salts as described in U.S. Pat. No. 3,220,839, palladium, platinum and gold salts as described in U.S. Pat. Nos. 2,566,263 and 2,597,915, halogen-substituted organic compounds as described in U.S. Pat. Nos. 4,108,665 and 4,442,202, triazines as described in U.S. Pat. Nos. 4,128,557, 4,137,079, 4,138,365 and 4,459,350, and phosphorus compounds as described in U.S. Pat. No. 4,411,985.

Preferred antifoggants are organic halides, for example, the compounds described in JP-A 119624/1975, 120328/1975, 121332/1976, 58022/1979, 70543/1981, 99335/1981, 90842/1984, 129642/1986, 129845/1987, 208191/1994, 5621/1995, 2781/1995, 15809/1996, U.S. Pat. Nos. 5,340,712, 5,369,000, and 5,464,737.

The antifoggant may be added in any desired form such as solution, powder or solid particle dispersion. The solid particle dispersion of the antifoggant may be prepared by well-known comminuting means such as ball mills, vibrating ball mills, sand mills, colloidal mills, jet mills, and roller mills. Dispersing aids may be used for facilitating dispersion.

It is sometimes advantageous to add a mercury (II) salt to an emulsion layer as an antifoggant though not necessary in the practice of the invention. Mercury (II) salts .preferred to this end are mercury acetate and mercury ebromide. The mercury (II) salt is preferably added in an amount of $1\times10^{-9}$ mol to $1\times10^{-3}$ mol, more preferably $1\times10^{-8}$ mol to $1\times10^{-4}$ mol per mol of silver coated.

Still further, the thermographic recording element of the invention may contain a benzoic acid type compound for the purposes of increasing sensitivity and restraining fog. Any of benzoic acid type compounds may be used although examples of the preferred structure are described in U.S. Pat. Nos. 4,784,939 and 4,152,160, Japanese Patent Application Nos. 98051/1996, 151241/1996, and 151242/1996. The benzoic acid type compound may be added to any site in the recording element, preferably to a layer on the same side as the photosensitive layer serving as the image forming layer, and more preferably an organic silver salt-containing layer. The benzoic acid type compound may be added at any step in the preparation of a coating solution. Where it is contained in an organic silver salt-containing layer, it may be added at any step from the preparation of the organic silver salt to the preparation of a coating solution, preferably after the preparation of the organic silver salt and immediately before coating. The benzoic acid type compound may be added in any desired form including powder, solution and fine particle dispersion. Alternatively, it may be added in a solution form after mixing it with other additives such as a sensitizing dye, reducing agent and toner. The benzoic acid type compound may be added in any desired amount, preferably $1\times10^{-6}$ mol to 2 mol, more preferably $1\times10^{-3}$ mol to 0.5 mol per mol of silver.

In the recording element of the invention, mercapto, disulfide and thion compounds may be added for the purposes of retarding or accelerating development to control development, improving spectral sensitization efficiency, and improving storage stability before and after development.

Where mercapto compounds are used herein, any structure is acceptable. Preferred are structures represented by Ar—S—M and Ar—S—S—Ar wherein M is a hydrogen atom or alkali metal atom, and Ar is an aromatic ring or fused aromatic ring having at least one nitrogen, sulfur, oxygen, selenium or tellurium atom. Preferred hetero-aromatic rings are benzimidazole, naphthimidazole, benzothiazole, naphtho-thiazole, benzoxazole, naphthoxazole, benzoselenazole, benzotellurazole, imidazole, oxazole, pyrrazole, triazole, thiadiazole, tetrazole, triazine, pyrimidine, pyridazine, pyrazine, pyridine, purine, quinoline and quinazolinone rings. These hetero-aromatic rings may have a substituent selected from the group consisting of halogen (e.g., Br and Cl), hydroxy, amino, carboxy, alkyl groups (having at least 1 carbon atom, preferably 1 to 4 carbon atoms), and alkoxy groups (having at least 1 carbon atom, preferably 1 to 4 carbon atoms). Illustrative, non-limiting examples of the mercapto-substituted hetero-aromatic compound include 2-mercaptobenzimidazole, 2-mercaptobenzoxazole, 2-mercapto -benzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)) -quinazolinone, 7-trifluoromethyl-4-quinolinethiol, 2,3,5,6-tetrachloro-4-pyridinethiol, 4-amino-6-hydroxy-2-mercapto-pyrimidine monohydrate, 2-amino-5-mercapto-1,3,4 -thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydro-chloride, 3-mercapto-5-phenyl-1,2,4-triazole, and 2-mercapto-4-phenyloxazole.

These mercapto compounds are preferably added to the emulsion layer in amounts of 0.001 to 1.0 mol, more preferably 0.01 to 0.3 mol per mol of silver.

In the thermographic recording element of the invention, a nucleation promoter may be added for promoting the action of the nucleating agent. The nucleation promoter used herein includes amine derivatives, onium salts, *r disulfide derivatives, hydroxymethyl derivatives, hydroxamic acid derivatives, acylhydrazide derivatives, acrylonitrile derivatives and hydrogen donors.

Examples of the nucleation promoter include the compounds described in JP-A 77783/1995, page 48, lines 2–37, more specifically Compounds A-1 to A-73 described on pages 49–58 of the same; the compounds of the chemical formulae [21], [22] and [23] described in JP-A 84331/1995, more specifically the compounds described on pages 6–8 of the same; the compounds of the general formulae [Na] and [Nb] described in JP-A 104426/1995, more specifically Compounds Na-1 to Na-22 and Nb-1 to Nb-12 described on pages 16–20 of the same; the compounds of the general formulae (1), (2), (3), (4), (5), (6) and (7) described in Japanese Patent Application No. 37817/1995, more specifically Compounds 1-1 to 1-19, Compounds 2-1 to 2-22, Compounds 3-1 to 3-36, Compounds 4-1 to 4-5, Compounds 5-1 to 5-41, Compounds 6-1 to 6-58 and Compounds 7-1 to 7-38 described therein; the compounds described in U.S. Pat. No. 5,545,505, page 19, line 43 to page 22, line 3; the compounds described in U.S. Pat. No. 5,545,507, page 17, line 43 to page 18, line 53; the compounds described in U.S. Pat. No. 5,545,515, page 12, line 31 to page 14, line 14; the compounds described in U.S. Pat. No. 5,558,983, page 16, line 31 to page 17, line 12; the compounds described in WO 97/11407, page 27, line 4 to page 32, line 7; and the nucleation promoters described in Japanese Patent Application No. 70908/1996.

In the practice of the invention, the nucleation promoter is used as solution in water or a suitable organic solvent. Suitable solvents include alcohols (e.g., methanol, ethanol, propanol, and fluorinated alcohols), ketones (e.g., acetone and methyl ethyl ketone), dimethylformamide, dimethylsulfoxide and methyl cellosolve.

A well-known emulsifying dispersion method is used for dissolving the nucleation promoter with the aid of an oil such as dibutyl phthalate, tricresyl phosphate, glyceryl triacetate or diethyl phthalate or an auxiliary solvent such as ethyl acetate or cyclohexanone whereby an emulsified dispersion is mechanically prepared. Alternatively, a method known as a solid dispersion method is used for dispersing the nucleation promoter in powder form in water in a ball mill, colloidal mill or ultrasonic mixer.

The nucleation promoter may be added to an image forming layer or any other layer on the image forming layer side of a support, and preferably to the image forming layer or a layer disposed adjacent thereto.

The nucleation promoter is preferably used in an amount of $1\times10^{-6}$ mol to $2\times10^{-1}$ mol, more preferably $1\times10^{-5}$ mol to $2\times10^{-2}$ mol, most preferably $2\times10^{-5}$ to $1\times10^{-2}$ mol per mol of silver.

In the image forming layer, polyhydric alcohols (e.g., glycerin and diols as described in U.S. Pat. No. 2,960,404), fatty acids and esters thereof as described in U.S. Pat. Nos. 2,588,765 and 3,121,060, and silicone resins as described in BP 955,061 may be added as a plasticizer and lubricant.

Protective Layer

A surface protective layer may be provided in the thermographic recording element according to the present invention for the purpose of preventing sticking of the image forming layer.

The surface protective layer is based on a binder which may be any desired polymer, although the layer preferably contains 100 mg/m$^2$ to 5 g/m$^2$ of a polymer having a carboxylic acid residue. The polymers having a carboxylic acid residue include natural polymers (e.g., gelatin and alginic acid), modified natural polymers (e.g., carboxymethyl cellulose and phthalated gelatin), and synthetic polymers (e.g., poly-methacrylate, polyacrylate, polyalkyl methacrylate/acrylate copolymers, and polystyrene/polymethacrylate copolymers). The content of the carboxylic acid residue is preferably 10 mmol to 1.4 mol per 100 grams of the polymer. The carboxylic acid residue may form a salt with an alkali metal ion, alkaline earth metal ion or organic cation.

In the surface protective layer, any desired anti-sticking material may be used. Examples of the anti-sticking material include wax, silica particles, styrene-containing elastomeric block copolymers (e.g., styrene-butadiene-styrene and styrene-isoprene-styrene), cellulose acetate, cellulose acetate butyrate, cellulose propionate and mixtures thereof. Crosslinking agents for crosslinking, surfactants for ease of application, and other addenda are optionally added to the surface protective layer.

In the image forming layer or a protective layer therefor according to the invention, there may be used light absorbing substances and filter dyes as described in U.S. Pat. Nos. 3,253,921, 2,274,782, 2,527,583, and 2,956,879. The dyes may be mordanted as described in U.S. Pat. No. 3,282,699. The filer dyes are used in such amounts that the layer may have an absorbance of 0.1 to 3, especially 0.2 to 1.5 at the exposure wavelength.

In the image forming layer or a protective layer therefor according to the invention, there may be used matte agents, for example, starch, titanium dioxide, zinc oxide, and silica as well as polymer beads including beads of the type described in U.S. Pat. Nos. 2,992,101 and 2,701,245. The image forming or protective layer surface may have any degree of matte insofar as no star dust failures occur although a Bekk smoothness of 200 to 10,000 seconds, especially 300 to 10,000 seconds is preferred.

The thermographic photographic emulsion used in the thermographic recording element according to the one preferred embodiment of the invention is contained in one or more layers on a support. In the event of single layer construction, it should contain an organic silver salt, silver halide, developing agent, and binder, and other optional additives such as a toner, coating aid and other auxiliary agents. In the event of two-layer construction, a first emulsion layer which is generally a layer disposed adjacent to the support should contain an organic silver salt and silver halide and a second emulsion layer or both the layers contain other components. Also envisioned herein is a two-layer construction consisting of a single emulsion layer containing all the components and a protective topcoat. In the case of multi-color sensitive photothermographic material, a combination of such two layers may be employed for each color. Also a single layer may contain all necessary components as described in U.S. Pat. No. 4,708,928. In the case of multi-dye, multi-color sensitive photothermographic material, emulsion layers are distinctly supported by providing a functional or non-functional barrier layer therebetween as described in U.S. Pat. No. 4,460,681.

In the image forming layer, a variety of dyes and pigments may be used from the standpoints of improving tone and preventing irradiation. Any desired dyes and pigments may be used in the invention. Useful pigments and dyes include those described in Colour Index and both organic and inorganic, for example, pyrazoloazole dyes, anthraquinone dyes, azo dyes, azomethine dyes, oxonol dyes, carbocyanine dyes, styryl dyes, triphenylmethane dyes, indoaniline dyes, indophenol dyes, and phthalocyanine dyes. The preferred dyes used herein include anthraquinone dyes (e.g., Compounds 1 to 9 described in JP-A 341441/1993 and Compounds 3-6 to 3-18 and 3-23 to 3-38 described in JP-A 165147/1993), azomethine dyes (e.g., Compounds 17 to 47 described in JP-A 341441/1993), indoaniline dyes (e.g., Compounds 11 to 19 described in JP-A 289227/1993, Compound 47 described in JP-A 341441/1993 and Compounds 2-10 to 2-11 described in JP-A 165147/1993), and azo dyes (e.g., Compounds 10 to 16 described in JP-A 341441/1993). The dyes and pigments may be added in any desired form such as solution, emulsion or solid particle dispersion or in a form mordanted with polymeric mordants. The amounts of these compounds used are determined in accordance with the desired absorption although the compounds are generally used in amounts of 1 $\mu$g to 1 g per square meter of the recording element.

In the practice of the invention, an antihalation layer may be disposed on the side of the image forming layer remote from the light source. The antihalation layer preferably has a maximum absorbance of 0.1 to 2 in the desired wavelength range, more preferably an absorbance of 0.2 to 1.5 at the exposure wavelength, and an absorbance of 0.001 to less than 0.2 in the visible region after processing, and is also preferably a layer having an optical density of 0.001 to less than 0.15.

Where an antihalation dye is used in the invention, it may be selected from various compounds insofar as it has the desired absorption in the wavelength range, is sufficiently low absorptive in the visible region after processing, and provides the antihalation layer with the preferred absorbance profile. Exemplary antihalation dyes are given below though the dyes are not limited thereto. Useful dyes which are used alone are described in JP-A 56458/1984, 216140/1990, 13295/1995, 11432/1995, U.S. Pat. No. 5,380,635, JP-A 68539/1990, page 13, lower-left column, line 1 to page 14, lower-left column, line 9, and JP-A 24539/1991, page 14, lower-left column to page 16, lower-right column. It is further preferable in the practice of the invention to use a dye which will decolorize during processing. Illustrative, non-limiting, examples of decolorizable dyes are disclosed in JP-A 139136/1977, 132334/1978, 501480/1981, 16060/1982, 68831/1982, 101835/1982, 182436/1984, 36145/1995, 199409/1995, JP-B 33692/1973, 16648/1975, 41734/1990, U.S. Pat. Nos. 4,088,497, 4,283,487, 4,548,896, and 5,187,049.

In one preferred embodiment, the thermographic recording element of the invention is a one-side recording element having at least one image forming layer on one side and a back layer on the other side of the support.

In the practice of the invention, a matte agent may be added to the one-side imaging element for improving feed efficiency. The matte agents used herein are generally microparticulate water-insoluble organic or inorganic compounds. There may be used any desired one of matte agents, for example, well-known matte agents including organic matte agents as described in U.S. Pat. Nos. 1,939,213, 2,701,245, 2,322,037, 3,262,782, 3,539,344, and 3,767,448 and inorganic matte agents as described in U.S. Pat. Nos. 1,260,772, 2,192,241, 3,257,206, 3,370,951, 3,523,022, and 3,769,020. Illustrative examples of the organic compound which can be used as the matte agent are given below; exemplary water-dispersible vinyl polymers include polymethyl acrylate, polymethyl methacrylate, polyacrylonitrile, acrylonitrile-α-methylstyrene copolymers, polystyrene, styrene-divinylbenzene copolymers, polyvinyl acetate, polyethylene carbonate, and polytetrafluoroethylene; exemplary cellulose derivatives include methyl cellulose, cellulose acetate, and cellulose acetate propionate; exemplary starch derivatives include carboxystarch, carboxynitrophenyl starch, urea-formaldehyde-starch reaction products, gelatin hardened with well-known curing agents, and hardened gelatin which has been coaceruvation hardened into microcapsulated hollow particles. Preferred examples of the inorganic compound which can be used as the matte agent include silicon dioxide, titanium dioxide, magnesium dioxide, aluminum oxide, barium sulfate, calcium carbonate, silver chloride and silver bromide desensitized by a well-known method, glass, and diatomaceous earth. The aforementioned matte agents may be used as a mixture of substances of different types if necessary. The size and shape of the matte agent are not critical. The matte agent of any particle size may be used although matte agents having a particle size of 0.1 μm to 30 μm are preferably used in the practice of the invention. The particle size distribution of the matte agent may be either narrow or wide. Nevertheless, since the haze and surface luster of coating are largely affected by the matte agent, it is preferred to adjust the particle size, shape and particle size distribution of a matte agent as desired during preparation of the matte agent or by mixing plural matte agents.

In the practice of the invention, the back layer should preferably have a degree of matte as expressed by a Bekk smoothness of 10 to 250 seconds, more preferably 50 to 180 seconds.

In the recording element of the invention, the matte agent is preferably contained in an outermost surface layer, a layer functioning as an outermost surface layer, a layer close to the outer surface or a layer functioning as a so-called protective layer.

In the practice of the invention, the binder used in the back layer is preferably transparent or translucent and generally colorless. Exemplary binders are naturally occurring polymers, synthetic resins, polymers and copolymers, and other film-forming media, for example, gelatin, gum arabic, poly(vinyl alcohol), hydroxyethyl cellulose, cellulose acetate, cellulose acetate butyrate, polylvinyl pyrrolidone), casein, starch, poly(acrylic acid), poly(methyl methacrylate), polyvinyl chloride, poly-(methacrylic acid), copoly(styrene-maleic anhydride), copoly(styrene-acrylonitrile), copoly(styrene-butadiene), polyvinyl acetals (e.g., polyvinyl formal and polyvinyl butyral), polyesters, polyurethanes, phenoxy resins, poly(vinylidene chloride), polyepoxides, polycarbonates, polylvinyl acetate), cellulose esters, and polyamides. The binder may be dispersed in water, organic solvent or emulsion to form a dispersion which is coated to form a layer.

The back layer preferably exhibits a maximum absorbance of 0.3 to 2, more preferably 0.5 to 2 in the predetermined wavelength range and an absorbance of 0.001 to less than 0.5 in the visible range after processing. Further preferably, the back layer has an optical density of 0.001 to less than 0.3. Examples of the antihalation dye used in the back layer are the same as previously described for the antihalation layer.

A backside resistive heating layer as described in U.S. Pat. Nos. 4,460,681 and 4,374,921 may be used in a photographic thermographic image recording system according to the present invention.

According to the invention, a hardener may be used in various layers including an image forming layer, protective layer, and back layer. Examples of the hardener include polyisocyanates as described in U.S. Pat. No. 4,281,060 and JP-A 208193/1994, epoxy compounds as described in U.S. Pat. No. 4,791,042, and vinyl sulfones as described in JP-A 89048/1987.

A surfactant may be used for the purposes of improving coating and electric charging properties. The surfactants used herein may be nonionic, anionic, cationic and fluorinated ones. Examples include fluorinated polymer surfactants as described in JP-A 170950/1987 and U.S. Pat. No. 5,380,644, fluorinated surfactants as described in JP-A 244945/1985 and 188135/1988, polysiloxane surfactants as described in U.S. Pat. No. 3,885,965, and polyalkylene oxide and anionic surfactants as described in JP-A 301140/1994.

Examples of the solvent used herein are described in "New Solvent Pocket Book," Ohm K.K., 1994, though not limited thereto. The solvent used herein should preferably have a boiling point of 40 to 180° C. Exemplary solvents include hexane, cyclohexane, toluene, methanol, ethanol, isopropanol, acetone, methyl ethyl ketone, ethyl acetate, 1,1,1-trichloroethane, tetrahydrofuran, triethylamine, thiophene, trifluoroethanol, perfluoropentane, xylene, n-butanol, phenol, methyl isobutyl ketone, cyclohexanone, butyl acetate, diethyl carbonate, chlorobenzene, dibutyl ether, anisole, ethylene glycol diethyl ether, N,N-dimethylformamide, morpholine, propanesultone, perfluorotributylamine, and water.

Support

According to the invention, the thermographic emulsion may be coated on a variety of supports. Typical supports include polyester film, subbed polyester film, poly(ethylene terephthalate) film, polyethylene naphthalate film, cellulose nitrate film, cellulose ester film, poly(vinyl acetal) film, polycarbonate film and related or resinous materials, as well as glass, paper, metals, etc. Often used are flexible substrates, typically paper supports, specifically baryta paper and paper supports coated with partially acetylated α-olefin polymers, especially polymers of (α-olefins having 2 to 10 carbon atoms such as polyethylene, polypropylene, and ethylene-butene copolymers. The supports are either transparent or opaque, preferably transparent.

The thermographic recording element of the invention may have an antistatic or electroconductive layer, for example, a layer containing soluble salts (e.g., chlorides and nitrates), an evaporated metal layer, or a layer containing ionic polymers as described in U.S. Pat. Nos. 2,861,056 and 3,206,312 or insoluble inorganic salts as described in U.S. Pat. No. 3,428,451.

A method for producing color images using the thermographic recording element of the invention is as described in JP-A 13295/1995, page 10, left column, line 43 to page 11, left column, line 40. Stabilizers for color dye images are exemplified in BP 1,326,889, U.S. Pat. Nos. 3,432,300, 3,698,909, 3,574,627, 3,573,050, 3,764,337, and 4,042,394.

In the practice of the invention, the thermographic photographic emulsion can be applied by various coating procedures including dip coating, air knife coating, flow coating, and extrusion coating using a hopper of the type described in U.S. Pat. No. 2,681,294. If desired, two or more layers may be concurrently coated by the methods described in U.S. Pat. No. 2,761,791 and BP 837,095.

In the thermographic recording element of the invention, there may be contained additional layers, for example, a dye accepting layer for accepting a mobile dye image, an opacifying layer when reflection printing is desired, a protective topcoat layer, and a primer layer well known in the photothermographic art. The recording material of the invention is preferably such that only a single sheet of the recording material can form an image. That is, it is preferred that a functional layer necessary to form an image such as an image receiving layer does not constitute a separate member.

The thermographic recording element of the invention may be developed by any desired method although it is generally developed by heating after imagewise exposure. The preferred developing temperature is about 80 to 250° C., more preferably 100 to 140° C. The preferred developing time is about 1 to 180 seconds, more preferably about 10 to 90 seconds.

Any desired technique may be used for the exposure of the thermographic recording element of the invention. The preferred light source for exposure is a laser, for example, a gas laser, YAG laser, dye laser or semiconductor laser. A :semiconductor laser combined with a second harmonic generating device is also useful.

Where the thermographic recording element of the invention does not contain the photosensitive silver halide, latent images can be formed by heating. Heating may be effected by various ways, for example, by direct heating using a thermal head. Indirect heating is also possible if a substance (e.g., a dyestuff or pigment) capable of absorbing radiation of a specific wavelength and converting it into heat is incorporated in the recording element. The light source used in this embodiment is preferably a laser as mentioned above. A combination of these techniques is possible. Where a latent image is formed by heating, the process may involve two stages, a first stage of heating to form a latent image and a second stage of heating to form an image. A single stage of heating can complete image formation.

EXAMPLE

Examples of the invention are given below by way of illustration and not by way of limitation.

The trade names used in Examples have the following meaning.

Denka Butyral: polyvinyl butyral by Denki Kagaku Kogyo K.K. CAB 171-15S: cellulose acetate butyrate by Eastman Chemical Products, Inc.

Sildex: spherical silica by Dokai Chemical K.K. Sumidur N3500: polyisocyanate by Sumitomo-Bayern Urethane K.K.

Megafax F-176P: fluorinated surfactant by Dai-Nippon Ink Chemicals K.K.

LACSTAR 3307B: styrene-butadiene rubber (SBR) latex by Dai-Nippon Ink & Chemicals K.K. The polymer has an equilibrium moisture content of 0.6 wt % at 25° C. and RH 60% and the dispersed particles have a mean particle diameter of about 0.1 to 0.15 μm.

The compounds used in Examples have the following structural formulae.

(C-1)

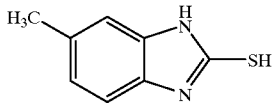

(C-2)

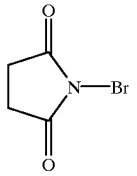

(C-3)

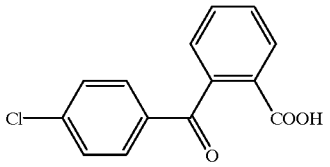

(C-4)

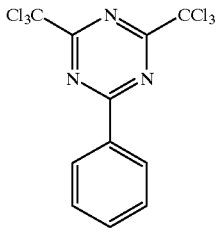

-continued
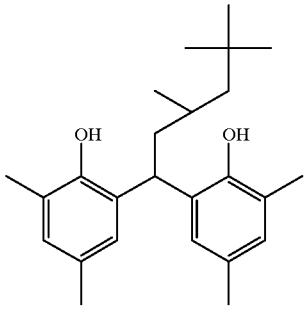
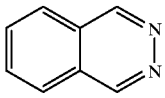
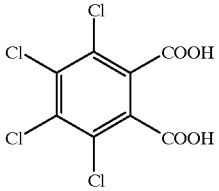
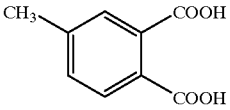
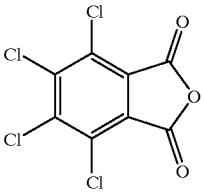
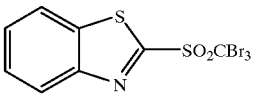
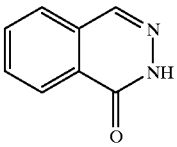
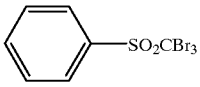
Disulfide compound A
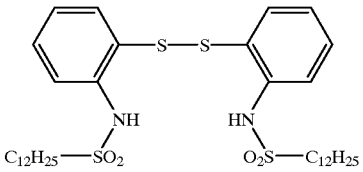
-continued
(C-5) Sensitzing compound A
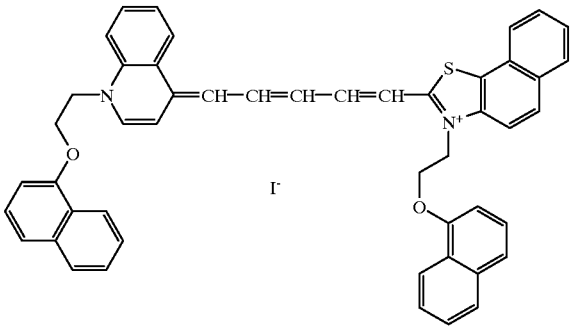
(C-6) Sensitizing compound B
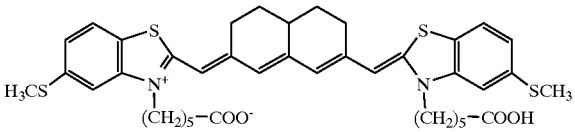
(C-7) Sensitizing compound C
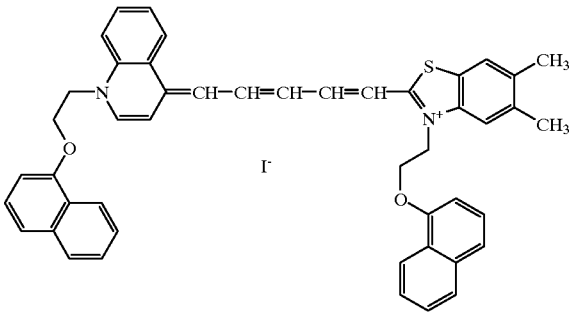
(C-8)
(C-9) Dye A
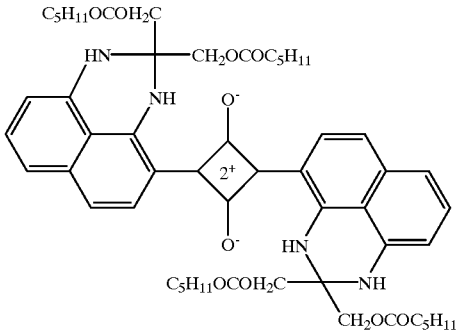
(C-10)
(C-11) Dye B
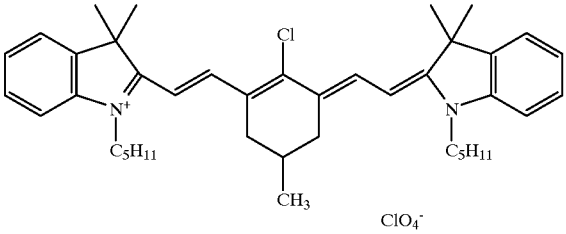
(C-12)

RF-1 (CN-03 described in U.S. Pat. No. 5,545,515)

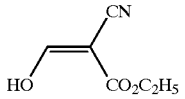

RF-2 (HET-01 described in U.S. Pat. No. 5,635,339)

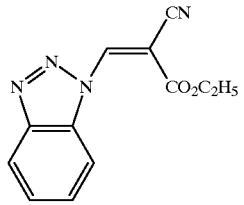

RF-3 (HET-02 described in U.S. Pat. No. 5,635,339)

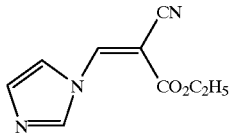

Tellurium compound 1

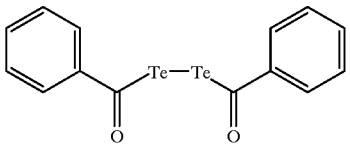

Surfactant A

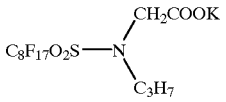

Surfactant B

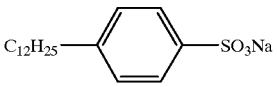

Dye C

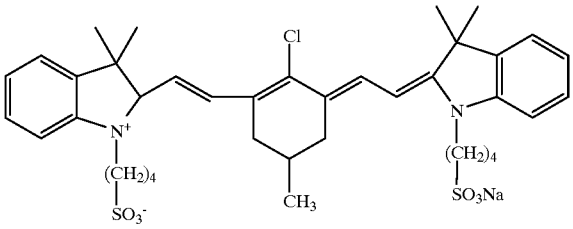

Example 1

Preparation of Silver Halide Grains A

In 900 ml of water were dissolved 7.5 grams of inert gelatin and 10 mg of potassium bromide. The solution was adjusted to pH 3.0 at a temperature of 35° C. To the solution, 370 ml of an aqueous solution containing 74 grams of silver nitrate and an aqueous solution containing potassium bromide and potassium iodide in a molar ratio of 94:6 and $K_3[IrCl_6]$ were added over 10 minutes by the controlled double jet method while maintaining the solution at pAg 7.7. Note that $[IrCl_6]^{-3}$ was added in an amount of $3\times10^{-7}$ mol/mol of silver. Thereafter, 0.3 gram of 4-hydroxy-6-methyl-1,3,3a,7-tetrazaindene was added to the solution, which was adjusted to pH 5 with NaOH. There were obtained cubic silver iodobromide grains A having a mean grain size of 0.06 $\mu$m, a coefficient of variation of projected area of 8%, and a {100} face ratio of 87%. The emulsion was desalted by adding a gelatin flocculant thereto to cause flocculation and sedimentation and then adjusted to pH 5.9 and pAg 7.5 by adding 0.1 gram of phenoxyethanol.

Preparation of Organic Acid Silver Emulsion A

A mixture of 10.6 grams of behenic acid and 300 ml of distilled water was mixed for 15 minutes at 90° C. With vigorous stirring, 31.1 ml of lN sodium hydroxide was added over 15 minutes to the solution, which was allowed to stand at the temperature for one hour. The solution was then cooled to 30° C., 7 ml of 1N phosphoric acid was added thereto, and with more vigorous stirring, 0.13 gram of N-bromosuccinimide (C-2) was added. Thereafter, with stirring, the above-prepared silver halide grains A were added to the solution in such an amount as to give 2.5 mmol of silver halide. Further, 25 ml of iN silver nitrate aqueous solution was continuously added over 2 minutes, with stirring continued for a further 90 minutes. With stirring, 37 grams of a 1.2 wt % butyl acetate solution of polyvinyl acetate was slowly added to the aqueous mixture to form flocs in the dispersion. Water was removed, and water washing and water removal were repeated twice. With stirring, 20 grams of a solution of 2.5% by weight polyvinyl butyral (Denka Butyral #3000-K) in a ½ solvent mixture of butyl acetate and isopropyl alcohol was added. To the thus obtained gel-like mixture of organic acid silver and silver halide, 7.8 grams of polyvinyl butyral (Denka Butyral #4000 -2) and 57 grams of 2-butanone were added. The mixture was dispersed by a homogenizer, obtaining a silver behenate salt emulsion A of needle grains having a mean minor diameter of 0.04 $\mu$m, a mean major diameter of 1 $\mu$m and a coefficient of variation of 30%.

Preparation of Emulsion Layer Coating Solution A The following chemicals were added to the above-prepared organic acid silver salt emulsion A in amounts per mol of silver. With stirring at 25° C., 10 mg of sodium phenylthiosulfonate, 25 mg of Sensitizing Dye A, 20 mg of Sensitizing Dye B, 18 mg of Sensitizing Dye C, 2 grams of 2-mercapto-5-methylbenzimidazole (C-1), 21.5 grams of 4-chlorobenzophenone-2-carboxylic acid (C-3), 580 grams of 2-butanone and 220 grams of dimethylformamide were added to the emulsion, which was allowed to stand for 3 hours. With stirring, 4 grams of 4,6-ditrichloromethyl-2-phenyltriazine (C-4), 2 grams of Disulfide compound A, 170 grams of 1,1-bis(2-hydroxy-3,5-dimethylphenyl)-3,5,5-trimethylhexane (C -5), 15 grams of phthalazine (C-6), 5 grams of tetrachloro -phthalic acid (C-7), an amount of a compound as shown in Table 30, 1.1 grams of fluorinated surfactant Megafax F-176P, 590 grams of 2-butanone, and 10 grams of methyl isobutyl ketone were added to the emulsion.

Preparation of Emulsion Surface Protective Layer Coating Solution A

A coating solution A for an emulsion layer surface protective layer was prepared by dissolving 75 grams of CAB 171-15S, 5.7 grams of 4-methylphthalic acid (C-8), 1.5 grams of tetrachlorophthalic anhydride (C-9), 8 grams of tribromomethylsulfonylbenzene (C-12), 6 grams of 2-tribromomethylsulfonylbenzothiazole (C-10), 3 grams of phthalazone (C-11), 0.3 gram of fluorinated surfactant Megafax F-176P, 2 grams of spherical silica Sildex H31 (mean size 3 μm), and 6 grams of polyisocyanate Sumidur N3500 in 3070 grams of 2-butanone and 30 grams of ethyl acetate.

Preparation of Coated Sample

A back layer coating solution was prepared by adding 6 grams of polyvinyl butyral Denka Butyral #4000-2, 0.2 gram of spherical silica Sildex H121 (mean size 12 μm), 0.2 gram of spherical silica Sildex H51 (mean size 5 μm), and 0.1 gram of Megafax F-176P to 64 grams of 2-propanol and mixing them into a solution. Further, a mixed solution of 210 mg of Dye A and 210 mg of Dye B in 10 grams of methanol and 20 grams of acetone and a solution of 0.8 gram of 3-isocyanatomethyl-3,5,5-trimethylhexyl isocyanate in 6 grams of ethyl acetate were added to the solution.

A polyethylene terephthalate film having a moisture-proof undercoat of vinylidene chloride on either surface was coated on one surface with the back surface coating solution so as to give an optical density of 0.7 at 780 nm.

On the thus prepared support, the emulsion layer coating solution was coated so as to give a coverage of 2 gim$^2$ of silver and the emulsion surface protective layer coating solution was then coated on the emulsion layer so as to give a dry thickness of 5 μm. In this way, samples of thermographic recording element were prepared.

Exposure and Development

The samples prepared above were exposed to xenon flash light for an emission time of $10^{-4}$ sec through an interference filter having a peak at 780 nm and a step wedge and heated for development at 115° C. for 25 seconds. The resulting images were determined for density by a densitometer, from which a characteristic curve was obtained.

Contrast

The gradient of a straight line connecting points of density 0.3 and 3.0 on the characteristic curve is reported as gradation (γ). Gamma values of 15 and more are satisfactory.

Shelf Stability

To estimate how photographic properties change during a long term of storage, a sample was aged for 5 days at 50° C. and RH 50% and examined for a sensitivity change. The sensitivity (S) was evaluated by a logarithmic value of an exposure providing a density of Dmin plus 1.5. The sensitivity change (ΔS) is given by $$\Delta S = S(\text{aged}) - S(\text{fresh})$$

wherein S(aged) is the sensitivity of the aged sample and S(fresh) is the sensitivity of the fresh sample. Values of ΔS closer to 0 indicate better shelf stability.

The results are shown in Table 30.

TABLE 30

| Run | Compound of formula (I) | | Compound of formula (H) | | Comparative compound | | | | |
|---|---|---|---|---|---|---|---|---|---|
| No. | No. | Amount (mol/m$^2$) | No. | Amount (mol/m$^2$) | No. | Amount (mol/m$^2$) | γ | ΔS | Remarks |
| 1-1 | — | — | — | — | RF-1 | $1.0 \times 10^{-5}$ | 6.5 | 0.03 | Comparison |
| 1-2 | — | — | — | — | RF-1 | $8.0 \times 10^{-5}$ | 13.4 | 0.15 | Comparison |
| 1-3 | — | — | — | — | RF-2 | $1.0 \times 10^{-5}$ | 5.8 | 0.04 | Comparison |
| 1-4 | — | — | — | — | RF-2 | $8.0 \times 10^{-5}$ | 13.4 | 0.16 | Comparison |
| 1-5 | — | — | — | — | RF-3 | $1.0 \times 10^{-5}$ | 6.6 | 0.03 | Comparison |
| 1-6 | — | — | — | — | RF-3 | $8.0 \times 10^{-5}$ | 13.3 | 0.18 | Comparison |
| 1-7 | — | — | 54a | $1.0 \times 10^{-5}$ | — | — | 7.8 | 0.03 | Comparison |
| 1-8 | — | — | 54a | $8.0 \times 10^{-5}$ | — | — | 13.5 | 0.18 | Comparison |
| 1-9 | — | — | 54a | $0.5 \times 10^{-5}$ | RF-1 | $0.5 \times 10^{-5}$ | 7.3 | 0.01 | Comparison |
| 1-10 | — | — | 54a | $0.5 \times 10^{-5}$ | RF-2 | $0.5 \times 10^{-5}$ | 7.1 | 0.02 | Comparison |
| 1-11 | — | — | 54a | $0.5 \times 10^{-5}$ | RF-3 | $0.5 \times 10^{-5}$ | 7.5 | 0.02 | Comparison |
| 1-12 | I-1a | $1.0 \times 10^{-5}$ | — | — | — | — | 14.0 | 0.03 | Invention |
| 1-13 | I-1c | $1.0 \times 10^{-5}$ | — | — | — | — | 14.1 | 0.03 | Invention |
| 1-14 | I-6b | $1.0 \times 10^{-5}$ | — | — | — | — | 14.2 | 0.01 | Invention |
| 1-15 | I-15b | $1.0 \times 10^{-5}$ | — | — | — | — | 13.9 | 0.02 | Invention |
| 1-16 | I-26a | $1.0 \times 10^{-5}$ | — | — | — | — | 13.9 | 0.03 | Invention |
| 1-17 | I-1a | $0.5 \times 10^{-5}$ | 54a | $0.5 \times 10^{-5}$ | — | — | 14.1 | 0.02 | Invention |
| 1-18 | I-1c | $0.5 \times 10^{-5}$ | 54a | $0.5 \times 10^{-5}$ | — | — | 14.3 | 0.03 | Invention |
| 1-19 | I-6b | $0.5 \times 10^{-5}$ | 54a | $0.5 \times 10^{-5}$ | — | — | 14.4 | 0.02 | Invention |
| 1-20 | I-15b | $0.5 \times 10^{-5}$ | 54a | $0.5 \times 10^{-5}$ | — | — | 13.8 | 0.04 | Invention |
| 1-21 | I-26a | $0.5 \times 10^{-5}$ | 54a | $0.5 \times 10^{-5}$ | — | — | 13.9 | 0.02 | Invention |
| 1-22 | I-1a | $0.5 \times 10^{-5}$ | 58a | $0.5 \times 10^{-5}$ | — | — | 14.5 | 0.02 | Invention |
| 1-23 | I-1a | $0.5 \times 10^{-5}$ | 124a | $0.5 \times 10^{-5}$ | — | — | 14.0 | 0.02 | Invention |
| 1-24 | I-1a | $0.5 \times 10^{-5}$ | 125a | $0.5 \times 10^{-5}$ | — | — | 14.2 | 0.01 | Invention |

It is evident that using copounds within the scope of the invention, thermographic recording elements satisfying the requirements of ultrahigh contrast and shelf stability are obtained. The fresh samples (prior to aging) within the scope of the invention also showed fully high values of sensitivity and Dmax.

Example 2

Preparation of Silver Halide Emulsion B

In 700 ml of water were dissolved 22 grams of phthalated gelatin and 30 mg of potassium bromide. The solution was adjusted to pH 5.0 at a temperature of 40° C. To the solution, 159 ml of an aqueous solution containing 18.6 grams of silver nitrate and an aqueous solution containing potassium bromide were added over 10 minutes by the controlled double jet method while maintaining the solution at pAg 7.7. Then, an aqueous solution containing $8 \times 10^{-6}$ mol/liter of $K_3[IrCl_6]$ and 1 mol/liter of potassium bromide was added over 30 minutes by the controlled double jet method while maintaining the solution at pAg 7.7. The emulsion was adjusted to pH 5.9 and pAg 8.0. There were obtained cubic grains having a mean grain size of 0.07 μm, a coefficient of variation of the projected area diameter of 8%, and a (100) face proportion of 86%.

The thus obtained silver halide grains B were heated at 60° C., to which $8.5\times10^{-5}$ mol of sodium thiosulfate, $1.1\times10^{-5}$ mol of 2,3,4,5,6-pentafluorophenyldiphenylsulfin selenide, $2\times10^{-6}$ mol of Tellurium Compound 1, $3.3\times10^{-6}$ mol of chloroauric acid, and $2.3\times10^{-4}$ mol of thiocyanic acid were added per mol of silver. The emulsion was ripened for 120 minutes and then quenched to 50° C. With stirring, $8\times10^{-4}$ mol of Sensitizing Dye C was added, and $3.5\times10^{-2}$ mol of potassium iodide was added to the emulsion, which was stirred for 30 minutes and then quenched to 30° C., completing the preparation of a silver halide emulsion B.

Preparation of Organic Acid Silver Microcrystalline Dispersion

A mixture of 40 grams of behenic acid, 7.3 grams of stearic acid, and 500 ml of distilled water was stirred at 90° C. for 15 minutes. With vigorous stirring, 187 ml of 1N NaOH aqueous solution was added over 15 minutes, 61 ml of 1N nitric acid was added, and the solution was cooled to 500° C. Then, 124 ml of an aqueous solution of iN silver nitrate was added and stirring was continued for 30 minutes. Thereafter, the solids were separated by suction filtration and washed with water until the water filtrate reached a conductivity of 30 μS/cm. The thus obtained solids were handled as a wet cake without drying. To 34.8 grams as dry solids of the wet cake were added 12 grams of polyvinyl alcohol and 150 ml of water. They were thoroughly mixed to form a slurry. A vessel was charged with the slurry together with 840 grams of zirconia beads having a mean diameter of 0.5 mm. A dispersing machine (¼ G Sand Grinder Mill by Imex K.K.) was operated for 5 hours for dispersion, completing the preparation of a microcrystalline dispersion * of organic acid silver grains having a volume weighed mean grain diameter of 1.5 μm as measured by Master Sizer X (Malvern Instruments Ltd.).

Preparation of Solid Darticle Dispersions of Chemical Addenda

Solid particle dispersions of tetrachlorophthalic acid (C-7), 4-methylphthalic acid (C-8), 1,1-bis(2-hydroxy-3,5-dimethylphenyl)-3,5,5-trimethylhexane (C-5), phthalazine (C -6), and tribromomethylsulfonylbenzene (C-12) were prepared.

To tetrachlorophthalic acid were added 0.81 gram of hydroxypropyl cellulose and 94.2 ml of water. They were thoroughly agitated to form a slurry, which was allowed to stand for 10 hours. A vessel was charged with the slurry together with 100 ml of zirconia beads having a mean diameter of 0.5 mm. A dispersing machine as above was operated for 5 hours for dispersion, obtaining a solid particle dispersion of tetrachlorophthalic acid in which particles with a diameter of up to 1.0 μm accounted for 70% by weight. Solid particle dispersions of the remaining chemical addenda were similarly prepared by properly changing the amount of dispersant and the dispersion time to achieve a desired mean particle size.

Preparation of Emulsion Layer Coating Solution

An emulsion layer coating solution was prepared by adding the following compositions to the organic acid silver microparticulate dispersion prepared above.

Organic acid silver particle dispersion 1 mol

Silver halide emulsion B 0.05 mol

Binder: LACSTAR 3307B SBR latex 430 g

Addenda for development:

Tetrachlorophthalic acid 5 g 1,1-bis(2-hydroxy-3,5-dimethylphenyl)-3,5,5-trimethylhexane 98 g Phthalazine 9.2 g Tribromomethylphenylsulfone 12 g 4-methylphthalic acid 7 g Compound shown in Table 31 (see Table 31)

Preparation of Emulsion Surface Protective Layer Coating Solution

A surface protective layer coating solution was prepared by adding 0.26 gram of Surfactant A, 0.09 gram of Surfactant B. 0.9 gram of silica microparticulates having a mean particle size of 2.5 μm, 0.3 gram of 1,2-bis(vinylsulfonylacetamide)ethane and 64 grams of water to 10 grams of inert gelatin.

Preparation of Back Surface Coating Solution

A back surface coating solution was prepared by adding 5 grams of Dye C, 250 grams of water, and 1.8 grams of spherical silica Sildex H121 (mean size 12 μm) to 30 grams of polyvinyl alcohol.

Coated Sample

The emulsion layer coating solution was applied to a polyethylene terephthalate support so as to give a silver coverage of 1.6 g/m$^2$. The emulsion surface protective layer coating solution was coated thereto so as to give a gelatin coverage of 1.8 g/m$^2$. After drying, the back surface coating solution was applied to the back surface of the support opposite to the emulsion layer so as to give an optical density of 0.7 at 780 nm. Coated samples were prepared in this way.

Photographic Property Tests

The samples were exposed, developed and tested as in Example 1. The results are shown in Table 31.

TABLE 31

| Run | Compound of formula (I) | | Compound of formula (H) | | Comparative compound | | | | |
|---|---|---|---|---|---|---|---|---|---|
| No. | No. | Amount (mol/m$^2$) | No. | Amount (mol/m$^2$) | No. | Amount (mol/m$^2$) | γ | ΔS | Remarks |
| 2-1 | — | — | — | — | RF-1 | $2.0\times10^{-5}$ | 6.3 | 0.02 | Comparison |
| 2-2 | — | — | — | — | RF-1 | $1.6\times10^{-4}$ | 13.3 | 0.16 | Comparison |
| 2-3 | — | — | — | — | RF-2 | $2.0\times10^{-5}$ | 6.9 | 0.03 | Comparison |
| 2-4 | — | — | — | — | RF-2 | $1.6\times10^{-4}$ | 13.1 | 0.14 | Comparison |
| 2-5 | — | — | — | — | RF-3 | $2.0\times10^{-5}$ | 7.0 | 0.03 | Comparison |
| 2-6 | — | — | — | — | RF-3 | $1.6\times10^{-4}$ | 13.5 | 0.13 | Comparison |
| 2-7 | — | — | 56a | $2.0\times10^{-5}$ | — | — | 7.2 | 0.03 | Comparison |
| 2-8 | — | — | 56a | $1.6\times10^{-4}$ | — | — | 13.2 | 0.13 | Comparison |
| 2-9 | — | — | 56a | $1.0\times10^{-5}$ | RF-1 | $1.0\times10^{-5}$ | 7.6 | 0.02 | Comparison |
| 2-10 | — | — | 56a | $1.0\times10^{-5}$ | RF-2 | $1.0\times10^{-5}$ | 6.5 | 0.02 | Comparison |
| 2-11 | — | — | 56a | $1.0\times10^{-5}$ | RF-3 | $1.0\times10^{-5}$ | 6.9 | 0.03 | Comparison |
| 2-12 | I-1b | $2.0\times10^{-5}$ | — | — | — | — | 14.1 | 0.03 | Invention |
| 2-13 | I-6a | $2.0\times10^{-5}$ | — | — | — | — | 14.3 | 0.02 | Invention |

TABLE 31-continued

| Run | Compound of formula (I) | | Compound of formula (H) | | Comparative compound | | | | |
|---|---|---|---|---|---|---|---|---|---|
| No. | No. | Amount (mol/m$^2$) | No. | Amount (mol/m$^2$) | No. | Amount (mol/m$^2$) | γ | ΔS | Remarks |
| 2-14 | I-15a | $2.0 \times 10^{-5}$ | — | — | — | — | 13.8 | 0.01 | Invention |
| 2-15 | I-23a | $2.0 \times 10^{-5}$ | — | — | — | — | 13.5 | 0.02 | Invention |
| 2-16 | I-14b | $2.0 \times 10^{-5}$ | — | — | — | — | 14.3 | 0.02 | Invention |
| 2-17 | I-1b | $1.0 \times 10^{-5}$ | 56a | $1.0 \times 10^{-5}$ | — | — | 14.2 | 0.02 | Invention |
| 2-18 | I-6a | $1.0 \times 10^{-5}$ | 56a | $1.0 \times 10^{-5}$ | — | — | 14.8 | 0.01 | Invention |
| 2-19 | I-15a | $1.0 \times 10^{-5}$ | 56a | $1.0 \times 10^{-5}$ | — | — | 13.9 | 0.02 | Invention |
| 2-20 | I-23a | $1.0 \times 10^{-5}$ | 56a | $1.0 \times 10^{-5}$ | — | — | 14.1 | 0.02 | Invention |
| 2-21 | I-14b | $1.0 \times 10^{-5}$ | 56a | $1.0 \times 10^{-5}$ | — | — | 14.5 | 0.02 | Invention |
| 2-22 | I-1b | $1.0 \times 10^{-5}$ | 127c | $1.0 \times 10^{-5}$ | — | — | 14.4 | 0.03 | Invention |
| 2-23 | I-1b | $1.0 \times 10^{-5}$ | 129a | $1.0 \times 10^{-5}$ | — | — | 14.3 | 0.01 | Invention |
| 2-24 | I-1b | $1.0 \times 10^{-5}$ | 133e | $1.0 \times 10^{-5}$ | — | — | 14.5 | 0.01 | Invention |

It is evident that using compounds within the scope of the invention, thermographic recording elements satisfying the requirements of ultrahigh contrast and shelf stability are obtained. The fresh samples (prior to aging) within the scope of the invention also showed fully high values of sensitivity and Dmax.

There has been described a thermographic recording element featuring high Dmax, high sensitivity, satisfactory contrast and shelf stability.

Japanese Patent Application No. 296174/1997 is incorporated herein by reference.

Reasonable modifications and variations are possible from the foregoing disclosure without departing from either the spirit or scope of the present invention as defined by the claims.

What is claimed is:

1. A thermographic recording element comprising at least one mage forming layer and containing an organic silver salt, a reducing agent, a binder and a compound of the following formula (I):

(I)

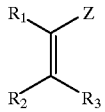

wherein $R_1$, $R_2$ and $R_3$ are independently selected from the group consisting of hydrogen, an optionally substituted aliphatic group, halogen, alkyl, aralkyl, cycloalkyl, methine, alkenyl, alkynyl, optionally substituted aryl, optionally substituted heterocyclic groups, quaternized nitrogen atom-containing heterocyclic groups, acyl, alkoxycarbonyl, aryloxvcarbonyl, carbamoyl, carboxy groups or salts thereof, sulfonylcarbamoyl, acylcarbamoyl, sulfamoylcarbamoyl, carbazoyl, oxalyl, oxamoyl, cyano, thiocarbamoyl, hydroxy or salts thereof, alkoxy, aryloxy, heterocyclic oxy groups, acyloxy, (alkoxy or aryloxy)carbonyloxy, carbamoyloxy, sulfonyloxy, amino, (alkyl, aryl or heterocyclic) amino, N -substituted nitrogenous heterocyclic groups, acylamino, amide, sulfonamide, ureido, thioureido, imino, (alkoxy or aryloxy)carbonylamino, sulfamoylamino, semicarbazide groups, thiosemicarbazide groups, hydrazino, quaternary ammonio groups, oxamoylamino, (alkyl or aryl)sulfonylureido groups, acylureido, acylsulfamoylamino, nitro, mercapto or salts thereof, (alkyl, aryl or heterocyclic) thio groups, (alkyl or aryl)sulfonyl groups, (alkyl or aryl)sulfinyl groups, sulfo or salts thereof, sulfamoyl, acylsulfamoyl, sulfonylsulfamoyl or salts thereof, phosphoramide, phosphate ester structure-bearing groups, silyl, and stannyl groups, Z is an electron attractive group or silyl group, or $R_1$ and Z, R2 and $R_3$, $R_1$ and $R_2$, and $R_3$ and Z, taken together, may form a saturated carbocyclic or heterocyclic group, at least one of $R_1$, $R_2$, $R_3$ and Z has a group represented by $—L_1—(R_4—L_2)_{nl}—(R_5)_{n2}—X$ wherein $R_4$ and $R_5$ are independently divalent aliphatic or aromatic groups, $L_1$ and L2 are independently divalent linking groups, X is selected from the group consisting of thioamide, mercapto, and 5- or 6-membered nitrogenous heterocyclic groups, and $n_1$and n2 are independently equal to 0 or 1.

2. The thermographic recording element of claim 1 further comprising a hydrazine derivative of the following formula (H):

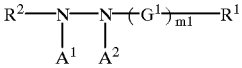

wherein $R_1$ and $R^3$ are independently selected from the group consisting of hydrogen, an aliphatic group, an aromatic group, a heterocyclic group, alkoxy, aryloxy, amino and hydrazino groups, $R^2$ is an optionally substituted aliphatic, aromatic or heterocyclic group, $G^1$ is —CO—, —COCO—, —C(=S)—, —$SO_2$—, —SO—, —PO($R^3$)— or iminomethylene group, $A^1$ and $A^2$ are hydrogen, alkylsulfonyl, arylsulfonyl or acyl groups, at least one of $A^1$ and $A^2$ is hydrogen, $m_1$ is equal to 0 or 1, with the proviso that $R^1$ is an aliphatic, aromatic or heterocyclic group when $m_1$ is 0.

3. The thermographic recording element of claim 1 further comprising a photosensitive silver halide.

4. The thermographic recording element of claim 1 wherein in formula (I), $R_1$ is an electron attractive group or aryl group.

5. The thermographic recording element of claim 1 wherein in formula (I), one of $R_2$ and $R_3$ is hydrogen and the other is a hydroxy (or a sodium, potassium or calcium salt thereof), mercapto (or a sodium, potassium or calcium salt thereof), alkoxy, alkylthio, heterocyclic oxy, heterocyclic thio or heterocyclic group.

6. The thermographic recording element of claim 1 wherein in formula (I), one of R2 and $R_3$ is hydrogen and the other is a hydroxy (or a sodium, potassium or calcium salt thereo) or mercapto (or a sodium, potassium or calcium salt thereof) group, and wherein the group represented by $—L_1—(R_4—L_2)_{n1}—(R_5)_{n2}—X$ is bonded to $R_1$.

7. The thermographic recording element of claim 1 wherein in formula (I), Z forms a saturated carbocyclic or heterocyclic group with $R_1$.

8. The thermographic recording element of claim 2 wherein in formula (H), $R^2$ is a substituted phenyl, substituted or unsubstituted alkyl of 1 to 3 carbon atoms or aromatic heterocyclic group.

9. The thermographic recording element of claim 2 wherein in formula (H), both $A^1$ and $A^2$ are hydrogen.

10. The thermographic recording element of claim 2 wherein in formula (H), $R^2$ is a substituted phenyl group.

11. The thermographic recording element of claim 1 wherein the organic silver salt is a silver salt of a long-chain aliphatic carboxylic acid having 10 to 30 carbon atoms.

12. The thermographic recording element of claim 1 wherein the image forming layer contains a binder, a latex of a polymer having a minimum film-forming temperature of −30° C. to 90° C. which accounts for at least 50% by weight of the binder, and wherein said image forming layer is formed by applying a coating solution in a solvent containing at least 30% by weight of water.

13. The thermographic recording element of claim 1 wherein the binder is selected from the group consisting of polyvinyl butyral, butylethyl cellulose, methacrylate copolymers, maleic anhydride ester copolymers, polystyrene, and butadiene-styrene copolymers.

14. The thermographic recording element of claim 1 wherein the reducing agent is a bisphenol.

15. The thermographic recording element of claim 1, wherein X is selected from the group consisting of 2-mercaptothiadiazolyl, 5-mercaptotetrazolyl, 3-mercapto-1,2,4-triazolyl, and benzotriazolyl.

16. The thermographic recording element of claim 1 further comprising two or more hydrazine derivatives of the following formula (H):

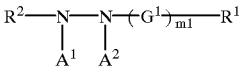

wherein $R^1$ and $R^3$ are independently selected from the group consisting of hydrogen, an aliphatic group, an aromatic group, a heterocyclic group, alkoxy, aryloxy, amino and hydrazino groups, $R^2$ is an optionally substituted aliphatic, aromatic or heterocyclic group, $G^1$ is —CO—, —COCO—,—C(=S)—, $—SO_2—$, —SO—, $—PO(R^3)—$ or iminomethylene group, $A^1$ and $A^2$ are hydrogen, alkylsulfonyl, arylsulfonyl or acyl groups, at least one of $A^1$ and $A^2$ is hydrogen, $m_1$ is equal to 0 or 1, with the proviso that $R^1$ is an aliphatic, aromatic or heterocyclic group when ml is 0.

17. The thermographic recording element of claim 1, wherein the organic silver salt is present at 0.1 to 5 $g/m^2$.

18. The thermographic recording element of claim 3, wherein the photosensitive silver halide is present in an amount of 0.01 to 0.5 moles.

19. The thermographic recording element of claim 1, further comprising a toner.

* * * * *

UNITED STATES PATENT AND TRADEMARK OFFICE

CERTIFICATE OF CORRECTION

PATENT NO. : 6,297,000 B1
DATED : October 2, 2001
INVENTOR(S) : Suzuki et al.

It is certified that error appears in the above-identified patent and that said Letters Patent is hereby corrected as shown below:

Column 109,
Line 36, change “mage” to -- image --
Line 54, change “aryloxvcarbonyl” to -- aryloxycarbonyl --

Column 111,
Line 2, change “thereo)” to -- thereof) --

Signed and Sealed this

Thirtieth Day of July, 2002

*Attest:*

*Attesting Officer*

JAMES E. ROGAN
*Director of the United States Patent and Trademark Office*